US007422658B2

(12) United States Patent
Hermans et al.

(10) Patent No.: US 7,422,658 B2
(45) **Date of Patent: *Sep. 9, 2008**

(54) TWO-SIDED CLOTH LIKE TISSUE WEBS

(75) Inventors: Michael Alan Hermans, Neenah, WI (US); Mike T. Goulet, Neenah, WI (US); Mark Hassman, Appleton, WI (US); Rebecca C. Mohr, Appleton, WI (US); Jeffrey J. Johnson, Neenah, WI (US); Maurizio Tirimacco, Appleton, WI (US); Jeffrey Dean Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 591 days.

This patent is subject to a terminal disclaimer.

(21) Appl. No.: 10/749,476

(22) Filed: Dec. 31, 2003

(65) Prior Publication Data

US 2005/0148257 A1 Jul. 7, 2005

(51) Int. Cl.
*B31F 1/12* (2006.01)
*D21H 17/00* (2006.01)
*D21H 23/22* (2006.01)

(52) U.S. Cl. ..... 162/112; 162/125; 162/136; 162/158; 162/179; 162/164.1; 162/168.1; 428/195.1; 428/156; 428/172

(58) Field of Classification Search ..... 162/109, 162/111–113, 117, 123–133, 157.6, 135–137, 162/179, 158, 164.1, 168.1; 156/183, 220, 156/277–278, 291; 264/282–283, 128; 428/152–153, 428/156, 172, 195.1
See application file for complete search history.

(56) References Cited

U.S. PATENT DOCUMENTS 3,556,932 A 1/1971 Coscia et al.
3,556,933 A 1/1971 Williams et al.
3,700,623 A 10/1972 Keim
3,772,076 A 11/1973 Keim
3,844,880 A 10/1974 Meisel, Jr. et al.
3,879,257 A 4/1975 Gentile et al.
3,885,158 A 5/1975 Flutie et al.
3,899,388 A 8/1975 Petrovich et al.
3,903,342 A 9/1975 Roberts, Jr.
3,994,771 A 11/1976 Morgan, Jr. et al.
4,000,237 A 12/1976 Roberts, Jr.
4,129,528 A 12/1978 Petrovich et al.
4,147,586 A 4/1979 Petrovich et al.
4,166,001 A 8/1979 Dunning et al.
4,222,921 A 9/1980 Van Eenam
4,225,382 A 9/1980 Kearney et al.
4,277,529 A 7/1981 Friedman
4,482,429 A 11/1984 Klowak
4,529,480 A 7/1985 Trokhan
4,675,394 A 6/1987 Solarek et al.
4,849,054 A 7/1989 Klowak
4,919,877 A 4/1990 Parsons et al.
4,981,557 A 1/1991 Bjorkquist
5,008,344 A 4/1991 Bjorkquist
5,048,589 A 9/1991 Cook et al.
5,069,548 A 12/1991 Boehnlein
5,085,736 A 2/1992 Bjorkquist
5,087,324 A 2/1992 Awofeso et al.
5,129,988 A 7/1992 Farrington, Jr.
5,164,045 A 11/1992 Awofeso et al.
5,200,037 A 4/1993 Noda
5,429,686 A 7/1995 Chiu et al.
5,494,554 A 2/1996 Edwards et al.
5,529,665 A 6/1996 Kaun
5,607,551 A 3/1997 Farrington, Jr. et al.
5,645,112 A 7/1997 Lee
5,656,132 A 8/1997 Farrington, Jr. et al.
5,672,248 A 9/1997 Wendt et al.
5,674,590 A * 10/1997 Anderson et al. ..... 428/154
5,694,702 A 12/1997 Anderson
5,702,571 A 12/1997 Kamps et al.
5,746,887 A 5/1998 Wendt et al.

(Continued)

FOREIGN PATENT DOCUMENTS

EP 0003377 A1 8/1979

(Continued)

OTHER PUBLICATIONS

Article—*Absolute measurement using field shifted moiré*, Leonard H. Bieman, Kevin G. Harding, and Albert Bohnlein. SPIE. vol. 1614 Optics, Illumination, and Image Sensing for Machine Vision VI. 1991. pp. 259-264.

(Continued)

*Primary Examiner*—José A Fortuna
(74) *Attorney, Agent, or Firm*—Dority & Manning, P.A.

(57) ABSTRACT

The present invention is generally directed to paper products having great softness and strength. The paper products are formed from one or more paper webs that can be made according to various methods. In one embodiment, the paper web is an uncreped through-air dried web. According to the present invention, at least one side of the paper web is treated with a bonding material according to a preselected pattern and creped from a creping surface. Through the process, a two-sided tissue web is formed having a smooth side and a textured side.

65 Claims, 35 Drawing Sheets

U.S. PATENT DOCUMENTS

| | | | | | |
|---|---|---|---|---|---|
| 5,776,306 | A | | 7/1998 | Hepford | |
| 5,839,479 | A | | 11/1998 | Gulya et al. | |
| 5,874,157 | A | | 2/1999 | Robinson et al. | |
| 5,885,418 | A | * | 3/1999 | Anderson et al. | 162/112 |
| 5,989,682 | A | * | 11/1999 | Anderson | 428/152 |
| 6,017,417 | A | | 1/2000 | Wendt et al. | |
| 6,033,761 | A | | 3/2000 | Dwiggins et al. | |
| 6,080,279 | A | | 6/2000 | Hada et al. | |
| 6,080,691 | A | | 6/2000 | Lindsay et al. | |
| 6,096,152 | A | * | 8/2000 | Anderson et al. | 156/183 |
| 6,096,169 | A | | 8/2000 | Hermans et al. | |
| 6,103,061 | A | * | 8/2000 | Anderson et al. | 162/108 |
| 6,113,740 | A | | 9/2000 | Oriaran et al. | |
| 6,120,642 | A | | 9/2000 | Lindsay et al. | |
| 6,129,815 | A | * | 10/2000 | Larson et al. | 162/112 |
| 6,143,135 | A | | 11/2000 | Hada et al. | |
| 6,149,768 | A | * | 11/2000 | Hepford | 162/109 |
| 6,165,319 | A | | 12/2000 | Heath et al. | |
| 6,187,137 | B1 | | 2/2001 | Druecke et al. | |
| 6,187,140 | B1 | * | 2/2001 | Anderson et al. | 162/112 |
| 6,197,154 | B1 | | 3/2001 | Chen et al. | |
| 6,214,146 | B1 | * | 4/2001 | Merker | 156/183 |
| 6,248,212 | B1 | * | 6/2001 | Anderson et al. | 162/112 |
| 6,299,729 | B1 | | 10/2001 | Heath et al. | |
| 6,315,864 | B2 | * | 11/2001 | Anderson et al. | 162/109 |
| 6,318,727 | B1 | | 11/2001 | Hada | |
| 6,331,228 | B1 | | 12/2001 | Heath et al. | |
| 6,395,957 | B1 | | 5/2002 | Chen et al. | |
| 6,420,013 | B1 | * | 7/2002 | Vinson et al. | 428/154 |
| 6,423,180 | B1 | | 7/2002 | Behnke et al. | |
| 6,436,234 | B1 | | 8/2002 | Chen et al. | |
| 6,500,289 | B2 | * | 12/2002 | Merker et al. | 156/183 |
| 6,517,673 | B1 | | 2/2003 | Heath et al. | |
| 6,534,151 | B2 | * | 3/2003 | Merker | 428/154 |
| 6,541,099 | B1 | * | 4/2003 | Merker et al. | 428/194 |
| 6,565,707 | B2 | | 5/2003 | Behnke et al. | |
| 6,846,383 | B2 | * | 1/2005 | Tirimacco | 162/112 |
| 6,918,993 | B2 | * | 7/2005 | Tirimacco | 162/111 |
| 6,939,440 | B2 | * | 9/2005 | Drew et al. | 162/113 |
| 7,022,201 | B2 | * | 4/2006 | Anderson et al. | 156/183 |
| 7,156,953 | B2 | * | 1/2007 | Tirimacco et al. | 162/112 |
| 7,303,650 | B2 | * | 12/2007 | Hermans et al. | 162/112 |
| 2003/0102096 | A1 | | 6/2003 | Dwiggins et al. | |
| 2004/0118544 | A1 | | 6/2004 | Tirimacco et al. | |
| 2005/0045293 | A1 | * | 3/2005 | Hermans et al. | 162/109 |
| 2005/0045295 | A1 | | 3/2005 | Goulet et al. | |
| 2005/0133175 | A1 | * | 6/2005 | Hada et al. | 162/109 |
| 2005/0145352 | A1 | * | 7/2005 | Hermans et al. | 162/112 |

FOREIGN PATENT DOCUMENTS

| | | | | |
|---|---|---|---|---|
| EP | 1236827 | A1 | | 9/2002 |
| WO | WO 9934057 | A1 | | 7/1999 |
| WO | WO 9934060 | A1 | * | 7/1999 |
| WO | WO 0066835 | A1 | | 11/2000 |
| WO | WO 0250371 | A1 | | 6/2002 |
| WO | WO 03057989 | A1 | | 7/2003 |
| WO | WO 03059139 | A1 | | 7/2003 |

OTHER PUBLICATIONS

U.S. Appl. No. 10/749,477, filed Dec. 31, 2003, Hermans, et al., Splittable Cloth Like Tissue Webs.

PCT Search Report and Written Opinion for PCT/US2004/042248 Jul. 6, 2005.

* cited by examiner

TWO-SIDED CLOTH LIKE TISSUE WEBS

BACKGROUND OF THE INVENTION

Absorbent paper products such as paper towels, facial tissues and other similar products are designed to include several important properties. For example, the products should have good bulk, a soft feel and should be highly absorbent. The product should also have good strength even while wet and should resist tearing. Unfortunately, it is very difficult to produce a high strength paper product that is also soft and highly absorbent. Usually, when steps are taken to increase one property of the product, other characteristics of the product are adversely affected. For instance, softness is typically increased by decreasing or reducing fiber bonding within the paper product. Inhibiting or reducing fiber bonding, however, adversely affects the strength of the paper web.

One particular process that has proved to be very successful in producing paper towels and wipers is disclosed in U.S. Pat. No. 3,879,257 to Gentile, et al., which is incorporated herein by reference in its entirety. In Gentile, et al., a process is disclosed in which a bonding material is applied in a fine, spaced apart pattern to one side of a fibrous web. The web is then adhered to a heated creping surface and creped from the surface. A bonding material is applied to the opposite side of the web and the web is similarly creped. The process disclosed in Gentile, et al. produces wiper products having exceptional bulk, outstanding softness and good absorbency. The surface regions of the web also provide excellent strength, abrasion resistance, and wipe-dry properties.

Although the process and products disclosed in Gentile, et al. have provided many advances in the art of making paper wiping products, further improvements in various aspects of paper wiping products remain desired. For example, the products described above made according to Gentile, et al. are relatively expensive to produce not only from a materials standpoint but also from the amount of processing that is required to produce the product. A need currently exists for a more economical tissue product that has similar properties to a double printed and double creped tissue product as disclosed in Gentile, et al. A need also exists for a tissue product that possesses properties and characteristics not present in the products described in Gentile, et al.

SUMMARY OF THE INVENTION

In general, the present invention is directed to a method for producing tissue products and to tissue products made from the method. The tissue products can be, for instance, paper towels, industrial wipers, facial tissues, bath tissues, napkins, and the like. The process includes the steps of providing a paper web containing papermaking fibers. A bonding material is applied to at least one side of the web, in a preselected pattern. In some embodiments, a bonding material is applied only to a first side of the web, while in other embodiments a bonding material is applied to the first side and to the opposing second side of the web (either the same or different bonding materials may be used on each side in the latter case). After application of the bonding material to at least the first side of the web, the first side and only the first side of the web is then adhered to a creping surface and creped from the creping surface using a creping blade.

In accordance with the present invention, the tissue web that is treated with the bonding material is a highly textured web. For instance, the tissue web may be an uncreped through-air dried web. After one side of the web is treated with a bonding material and creped from a creping surface, the creped side of the web becomes relatively smooth. The opposite side of the web, however, maintains a textured feel and appearance. Thus, according to one embodiment of the present invention, a tissue web is produced having much different characteristics on each side of the web, with one side of the web being relatively smooth and one side of the web being textured. For instance, in one embodiment, the first side or the creped side of the tissue web may have a surface depth of less than about 0.15 mm, such as less than about 0.12 mm, such as less than about 0.1 mm. The second side or textured side of the tissue web, on the other hand, may have a dry surface depth of greater than about 0.2 mm, such as greater than about 0.25 mm, such as greater than about 0.30 mm, or, in one embodiment, even greater than about 0.33 mm.

Of particular advantage, the present inventors have also discovered that when the first side or smooth side of the tissue web is wetted, the first side of the web becomes highly textured in a wet state. For instance, after becoming wetted and dried, the surface depth of the first side of the tissue web may be greater than about 0.2 mm, such as greater than about 0.25 mm, and, in one embodiment, greater than about 0.3 mm.

Besides having unique and desirable surface properties, tissue webs made according to the present invention also have cloth-like properties. For instance, the tissue web may have a falling drape (as defined hereinafter) of less than about 1.5 seconds, such as less than about 1.3 seconds. When falling drape is normalized to a basis weight of 30 gsm, tissue webs made according to the present invention may have a normalized falling drape of also less than about 1.5 seconds, such as less than about 1.3 seconds, and, in one embodiment, less than about 1.0 seconds. Falling drape refers to the ability of the web to drape and bend under the influence of gravity. Materials with good drape show little stiffness and feel more like cloth than stiffer paper webs.

As described above, the tissue web is a highly textured web and may be an uncreped through-air dried web. The tissue web may have a basis weight of from about 10 gsm to about 150 gsm, such as from about 35 gsm to about 80 gsm. The tissue web may have a high bulk and relatively low density. For instance, the bulk of the tissue web may be greater than about 8 cc/g, such as greater than about 10 cc/g, and, in one embodiment, can be greater than about 11 cc/g. For example, in one embodiment, the bulk may be from about 9 cc/g to about 12 cc/g.

In general, any suitable bonding material may be applied to the tissue web in accordance with the present invention. The bonding material may be, for instance, an ethylene vinyl acetate copolymer. The bonding material may be applied to one side of the tissue web in an amount from about 2% to about 10% based on the weight of the web. Depending on the desired result, the bonding material may be applied only to one side of the web or to both sides of the web. In either case, only one side of the web is creped.

Various patterns may be used to apply the bonding material to the tissue web. The pattern may comprise a grid or, alternatively, a succession of discrete shapes. Once applied to the tissue web, the bonding material may cover from about 20% to about 80% of the surface area of one side of the web, such as in an amount greater than about 50% of the surface area.

When the tissue web comprises an uncreped through-air dried web, the web may include a fabric side that is placed against a throughdrying fabric during a through-air drying process and an opposite air side. The creped side of the web may be either the fabric side or the air side.

The process of the present invention is particularly well suited to producing single ply tissue products. In other embodiments, however, multi-ply tissue products may be formed containing one or more plies of tissue webs made according to the present invention. For instance, the products may contain two, three, four, five or more plies.

For economy, single-ply or two-ply products are advantageous. The various plies within any given multi-ply product can be the same or different. By way of example, the various plies can contain different fibers, different chemicals, different basis weights, or be made differently to impart different topography or pore structure. Different processes include throughdrying (creped or uncreped), air-laying and wet-pressing (including modified wet-pressing).

As used herein, "modified wet pressing" refers to wetlaid tissue manufacturing in which tissue is pressed onto a drying drum such as a Yankee dryer in a relatively three-dimensional, bulky state, as opposed to the entirely flat, dense state of the web on a traditional Yankee dryer prior to creping. Modified wet pressing typically entails use of a three-dimensional fabric to add texture to a web as it is pressed on a drying drum and also can entail the use of non-compressive dewatering means prior to the drum dryer to compensate for the decreased drying rate that may occur due to decreased contact area of the three-dimensional tissue on the drying drum. Apparatus and methods for making modified wet press tissue are disclosed in U.S. Pat. No. 6,143,135, issued Nov. 7, 2000 to Hada, et al.; U.S. Pat. No. 6,096,169, issued Aug. 1, 2000 to Hermans, et al.; U.S. Pat. No. 6,080,279, issued Jun. 27, 2000 to Hada, et al.; and U.S. Pat. No. 6,318,727, issued Nov. 20, 2001 to Hada, et al., each of which is herein incorporated by reference.

Wet-molded throughdried plies, such as uncreped throughdried plies, have been found to be particularly advantageous because of their wet resiliency and three-dimensional topography.

The sheets can be apertured, slit, embossed, laminated with adhesive means to similar or different layers, crimped, perforated, etc., and that it can comprise skin care additives, odor control agents, antimicrobials, perfumes, dyes, mineral fillers, and the like.

The fibers used to form the sheets or plies useful for purposes of this invention can be substantially entirely hardwood kraft or softwood kraft fibers, or blends thereof. However, other fibers can also be used for part of the furnish, such as sulfite pulp, mechanical pulp fibers, bleached chemithermomechanical pulp (BCTMP) fibers, synthetic fibers, precrosslinked fibers, non-woody plant fibers, and the like. More specifically, by way of example, the fibers can be from about 50 to about 100 percent softwood kraft fibers, more specifically from about 60 to about 100 percent softwood kraft fibers, still more specifically from about 70 to about 100 percent softwood kraft fibers, still more specifically from about 80 to about 100 percent softwood kraft fibers, and still more specifically from about 90 to about 100 percent softwood kraft fibers.

The tensile strengths of the products of this invention, which are expressed as the geometric mean tensile strength, can be from about 500 grams per 3 inches of width to about 3000 grams or more per 3 inches of width depending on the intended use of the product. For paper towels, a preferred embodiment of this invention, geometric mean tensile strengths of about 1000-2000 grams per 3 inches are preferred. The ratio of the machine direction tensile strength to the cross-machine direction tensile strength can vary from about 1:1 to about 4:1.

As used herein, dry machine direction (MD) tensile strengths represent the peak load per sample width when a sample is pulled to rupture in the machine direction. In comparison, dry cross-machine direction (CD) tensile strengths represent the peak load per sample width when a sample is pulled to rupture in the cross-machine direction. Samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as either the "MD dry tensile strength" or the "CD dry tensile strength" of the specimen depending on the sample being tested. At least six (6) representative specimens are tested for each product and the arithmetic average of all individual specimen tests is either the MD or CD tensile strength for the product.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
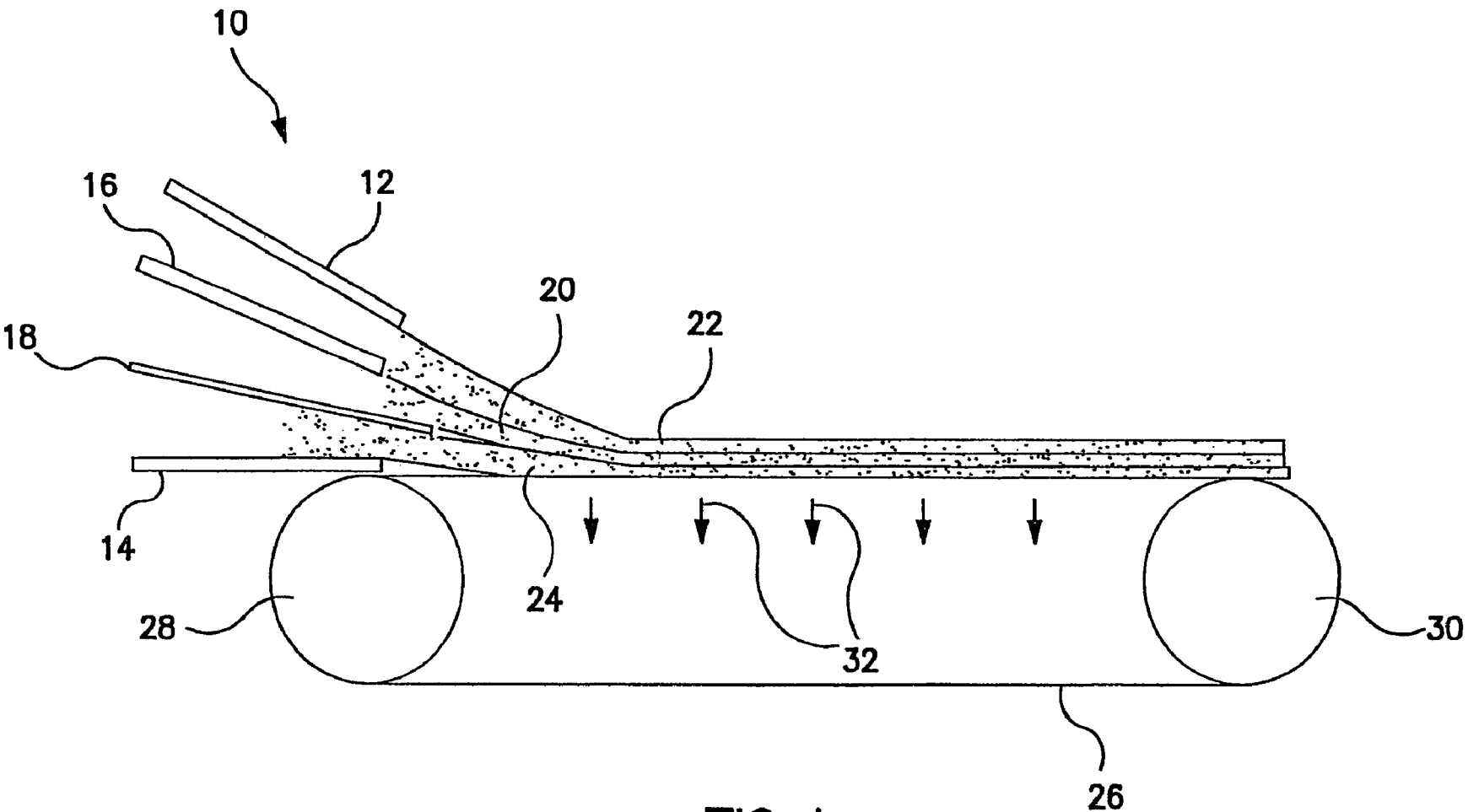
FIG. 1 is a schematic diagram of a paper web forming machine, illustrating the formation of a stratified paper web having multiple layers in accordance with the present invention.

Repeat use of reference characters in the present specification and drawings is intended to represent same or analogous features or elements of the present invention.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing paper wiping products having great softness and strength characteristics. In particular, the wiping products have high strength values when either dry or wet. Further, the products have good stretch characteristics and are tear resistant. The products also have an increased sheet caliper, and increased bulk.

The process of the present invention generally involves first producing a tissue web having at least one highly textured surface. For instance, in one embodiment, the tissue web may be an uncreped through-air dried web that has been formed on a 3-dimensional surface in a manner that produces surface texture. A bonding material is applied to at least a first side of the base sheet or the tissue web according to, for instance, a preselected pattern that includes treated areas and untreated areas. The first side of the tissue web is then adhered to a creping surface and creped from the surface. Through the above process, tissue webs are produced that not only possess great softness and strength characteristics, but also possess opposite sides with very different characteristics. For instance, the creped side of the tissue web is relatively smooth while the uncreped side of the tissue web remains highly textured. The two-sided properties of the tissue web provide various advantages and benefits. For instance, consumers may find different uses for each side of the web. For example, the untreated, textured side of the web may serve as the surface contacting liquids when cleaning spills and drying surfaces. The smooth side of the web, on the other hand, may be better suited for use in polishing applications.

One technique used to measure the topographical features of a tissue web or surface texture is Moiré Interferometry. Moiré Interferometry, for instance, may be used to measure surface depth which is a measurement of the height of peaks relative to surrounding valleys in a representative portion of the tissue web. The test for surface depth is described in detail in the examples that follow.

Tissue webs made according the present invention, for instance, may have a surface depth difference between the first, textured side of the web and the second, smooth side of the web of greater than about 0.07 mm, such as greater than about 0.1 mm. For instance, in one embodiment, the difference in surface depth between both sides of the web in a dry state may be greater than about 0.15 mm.

For example, the textured side of the tissue web made according to the present invention may have a dry surface depth of greater than about 0.2 mm, such as greater than about 0.25 mm, such as greater than about 0.30 mm, such as greater than about 0.33 mm. In some embodiments, for instance, the surface depth of the textured side of the web may be greater than about 0.34 mm. The smooth side of the web, on the other hand, may have a dry surface depth of less than about 0.15 mm, such as less than about 0.12 mm, such as less than about 0.1 mm. For example, in one embodiment, the smooth side of the tissue web may have a dry surface depth of less than about 0.09 mm.

Of particular advantage, it has been further discovered by the present inventors that once the smooth side of the tissue web is wetted, the smooth side becomes highly textured. In particular, for reasons unknown, when wetted, the relatively smooth print-creped side of the web can display increased topography, regaining the original texture of the web. In contrast, previously produced tissue webs that have been print-creped on each side of the web can become relatively flatter and less bulky when wetted, or display no visible repeating 3-dimensional pattern.

For instance, the creped, smooth side of tissue webs made according to the present invention may have a surface depth when wetted and dried of greater than about 0.2 mm, such as greater than about 0.25 mm, such as greater than about 0.3 mm. In one embodiment, for instance, the creped side of the web may display a surface depth of greater than about 0.32 mm when wetted.

In addition to displaying two-sided surface characteristics, tissue webs made according to the present invention also have low stiffness, thereby having cloth-like properties. One measure of stiffness, for instance, is the falling drape test which is described in detail in the examples that follow. The falling drape test measures the ability of the tissue web to bend freely and drape under the influence of gravity. Tissue webs made according to the present invention, for instance, may have a falling drape of less than about 1.5 seconds, such as less than about 1.3 seconds. When falling drape is normalized to a tissue web having a basis weight of 30 gsm, the normalized falling drape of tissue webs made according to the present invention may also be less than about 1.5 seconds, such as less than about 1.3 seconds. For instance, tissue webs made according to the present invention may have a normalized falling drape of less than about 1.1 seconds.

Paper webs processed according to the present invention can be made in different manners and can contain various different types of fibers. In general, however, the paper web contains papermaking fibers, such as softwood fibers. In addition to softwood fibers, the paper web can also contain hardwood fibers such as eucalyptus fibers and/or high-yield pulp fibers.

As used herein, "high-yield pulp fibers" are those papermaking fibers produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. Such pulping processes include bleached chemithermomechanical pulp (BCTMP), chemithermomechanical pulp (CTMP) pressure/pressure thermomechanical pulp (PTMP), thermomechanical pulp (TMP), thermomechanical chemical pulp (TMCP), high-yield sulfite pulps, and high-yield kraft pulps, all of which leave the resulting fibers with high levels of lignin. High-yield fibers are well known for their stiffness (in both dry and wet states) relative to typical chemically pulped fibers. The cell wall of kraft and other non-high-yield fibers tends to be more flexible because lignin, the "mortar" or "glue" on and in part of the cell wall, has been largely removed. Lignin is also nonswelling in water and hydrophobic, and resists the softening effect of water on the fiber, maintaining the stiffness of the cell wall in wetted high-yield fibers relative to kraft fibers. The preferred high-yield pulp fibers can also be characterized by being comprised of comparatively whole, relatively undamaged fibers, high freeness (250 Canadian Standard Freeness (CSF) or greater, more specifically 350 CFS or greater, and still more specifically 400 CFS or greater), and low fines content (less than 25 percent, more specifically less than 20 percent, still more specifically less that 15 percent, and still more specifically less than 10 percent by the Brift jar test).

In one embodiment of the present invention, the paper web contains softwood fibers in combination with high-yield pulp fibers, particularly BCTMP fibers. BCTMP fibers can be added to the web in order to increase the bulk and caliper of the web, while also reducing the cost of the web.

The amount of high-yield pulp fibers present in the sheet can vary depending upon the particular application. For instance, the high-yield pulp fibers can be present in an amount of about 2 dry weight percent or greater, particularly about 15 dry weight percent or greater, and more particularly from about 5 dry weight percent to about 40 dry weight percent, based upon the total weight of fibers present within the web.

In one embodiment, the paper web can be formed from multiple layers of a fiber furnish. The paper web can be produced, for instance, from a stratified headbox. Layered structures produced by any means known in the art are within the scope of the present invention, including those disclosed in U.S. Pat. No. 5,494,554 to Edwards, et al., which is incorporated herein by reference.

In one embodiment, for instance, a layered or stratified web is formed that contains high-yield pulp fibers in the center. Because high-yield pulp fibers are generally less soft than other papermaking fibers, in some applications, it is advantageous to incorporate them into the middle of the paper web, such as by being placed in the center of a 3-layered sheet. The outer layers of the sheet can then be made from softwood fibers and/or hardwood fibers.

For example, in one particular embodiment of the present invention, the paper web contains outer layers made from softwood fibers. Each outer layer can comprise from about 15% to about 40% by weight of the web and particularly can comprise about 25% by weight of the web. The middle layer, however, can comprise from about 40% to about 60% by weight of the web, and particularly about 50% by weight of the web. The middle layer can contain a mixture of softwood fibers and BCTMP fibers. The BCTMP fibers can be present in the middle layer in an amount from about 40% to about 60% by weight of the middle layer, and particularly in an amount of about 50% by weight of the middle layer.

The paper web of the present invention can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly into the head box. Suitable debonding agents that may be used in the present invention include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present invention is an organic quaternary ammonium chloride and particularly a silicone based amine salt of a quaternary ammonium chloride. For example, the debonding agent can be PROSOFT TQ1003 marketed by the Hercules Corporation. The debonding agent can be added to the fiber slurry in an amount of from about 1 kg per metric tonne to about 10 kg per metric tonne of fibers present within the slurry.

In an alternative embodiment, the debonding agent can be an imidazoline-based agent. The imidazoline-based debonding agent can be obtained, for instance, from the Witco Corp. The imidazoline-based debonding agent can be added in an amount of between 2.0 to about 15 kg per metric tonne.

In one embodiment, the debonding agent can be added to the fiber furnish according to a process as disclosed in PCT Application having an International Publication No. WO 99/34057 filed on Dec. 17, 1998 to Georger, et al. or in PCT Published Application having an International Publication No. WO 00/66835 filed on Apr. 28, 2000 to Georger, et al., which are both incorporated herein by reference. In the above publications, a process is disclosed in which a chemical additive, such as a debonding agent, is adsorbed onto cellulosic papermaking fibers at high levels. The process includes the steps of treating a fiber slurry with an excess of the chemical additive, allowing sufficient residence time for adsorption to occur, filtering the slurry to remove unadsorbed chemical additives, and redispursing the filtered pulp with fresh water prior to forming a nonwoven web.

In another embodiment, a layer or other portion of the web, including the entire web, can be provided with wet or dry strength agents. For example, the side of a web that is not creped may sometimes be susceptible to linting or sloughing due to the disruption of the web induced by creping. The tendency to release lint or dust in use can be reduced in some embodiments by adding suitable wet strength agents or dry strength agents to the furnish, particularly in an outer layer of the furnish. Such strength agents can include any wet strength resin known in the art of papermaking such as KYMENE® resins (Hercules, Inc., Wilmington, Del.) as well as dry strength aids such as starch, cationic starch, gums, anionic acrylamide copolymers, alum systems, various sizing agents such as alkenylsuccinic anhydride (ASA) or alkyl ketone dimmers (AKD) or rosin dispersion sizing agents such as Neutral Sizing Agent (NSA) from Georgia-Pacific Paper & Pulp Chemicals (Atlanta, Ga.), or retention aids such as HARMIDE resin from Harima Corp. (Osaka, Japan). In a related embodiment, one side of the web before or after drying or before or after creping of the web can be coated, sprayed, or printed with an aqueous solution or aqueous dispersion comprising a strength aid to increase the strength or lint resistance of that side.

As used herein, "wet strength agents" are materials used to immobilize the bonds between fibers in the wet state. Any material that when added to a paper web or sheet at an effective level results in providing the sheet with a wet geometric tensile strength:dry geometric tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet tensile strength after exposure to water for a period of at least five minutes. Temporary wet strength agents are those which show less than 50% of their original wet strength after being saturated with water for five minutes. Both classes of material find application in the present invention. The amount of wet strength agent or dry strength added to the pulp fibers can be at least about 0.1 dry weight percent, more specifically about 0.2 dry weight percent or greater, and still more specifically from about 0.1 to about 3 dry weight percent, based on the dry weight of the fibers.

Suitable permanent wet strength agents are typically water soluble, cationic oligomeric or polymeric resins that are capable of either crosslinking with themselves (homocrosslinking) or with the cellulose or other constituent of the wood fiber. The most widely-used materials for this purpose are the class of polymer known as polyamide-polyamine-epichlorohydrin type resins. These materials have been described in patents issued to Keim (U.S. Pat. No. 3,700,623 and U.S. Pat. No. 3,772,076) and are sold by Hercules, Inc., located in Wilmington, Del., as KYMENE 557H polyamine-epichlorohydrin resins. Related materials are marketed by Henkel Chemical Co., located in Charlotte, N.C., and Georgia-Pacific Resins, Inc., located in Atlanta, Ga.

Polyamide-epichlorohydrin resins are also useful as bonding resins in this invention. Materials developed by Monsanto and marketed under the SANTO RES™ label are base-activated polyamide-epichlorohydrin resins that can be used in the present invention. These materials are described in patents issued to Petrovich (U.S. Pat. No. 3,885,158; U.S. Pat. No. 3,899,388; U.S. Pat. No. 4,129,528 and U.S. Pat. No. 4,147,586) and van Eenam (U.S. Pat. No. 4,222,921). Although they are not as commonly used in consumer products, polyethylenimine resins are also suitable for immobilizing the bond points in the products of this invention. Another class of permanent-type wet strength agents are exemplified by the aminoplast resins obtained by reaction of formaldehyde with melamine or urea.

Suitable temporary wet strength resins include, but are not limited to, those resins that have been developed by American Cyanamid and are marketed under the name PAREZ™ 631 NC wet strength resin (now available from Cytec Industries, located in West Paterson, N.J.). This and similar resins are described in U.S. Pat. No. 3,556,932 to Coscia et al. and U.S. Pat. No. 3,556,933 to Williams et al. Other temporary wet strength agents that should find application in this invention include modified starches such as those available from National Starch and marketed as CO BOND™ 1000 modified starch. It is believed that these and related starches are disclosed in U.S. Pat. No. 4,675,394 to Solarek et al. Derivatized dialdehyde starches may also provide temporary wet strength. It is also expected that other temporary wet strength materials such as those described in U.S. Pat. No. 4,981,557; U.S. Pat. No. 5,008,344 and U.S. Pat. No. 5,085,736 all to Bjorkguist would be of use in this invention. With respect to the classes and the types of wet strength resins listed, it should be understood that this listing is simply to provide examples and that this is neither meant to exclude other types of wet strength resins, nor is it meant to limit the scope of this invention.

Although wet strength agents as described above find particular advantage for use in connection with this invention, other types of bonding agents can also be used to provide the necessary wet resiliency. They can be applied at the wet end of the basesheet manufacturing process or applied by spraying or printing after the basesheet is formed or after it is dried.

In another embodiment, one or more portions of the web can contain sizing agents to provide a degree of hydrophobicity. The sizing agent can be applied to one or both sides of the web, either uniformly or in a pattern, and may be present in the papermaking furnish or applied as an external treatment to the web, with levels of application such as 0.1 kg/tonne or greater, or 0.3 kg/tonne or greater.

The aforementioned strength or sizing aids can be provided in the furnish of the web or as a treatment to one or more sides of the web prior to printing with a bonding material. In addition, the strength and/or sizing aids can be provided in any, some, or all layers of a multiple layered web.

Referring to FIG. 1, one embodiment of a device for forming a multi-layered stratified pulp furnish is illustrated. As shown, a three-layered head box generally 10 includes an upper head box wall 12 and a lower head box wall 14. Head box 10 further includes a first divider 16 and a second divider 18, which separate three fiber stock layers.

Each of the fiber layers comprise a dilute aqueous suspension of papermaking fibers. In one embodiment, for instance, middle layer 20 contains southern softwood kraft fibers either alone or in combination with other fibers such as high yield fibers. Outer layers 22 and 24, on the other hand, contain softwood fibers, such as northern softwood kraft.

An endless traveling forming fabric 26, suitably supported and driven by rolls 28 and 30, receives the layered papermaking stock issuing from head box 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr., which is incorporated herein by reference.

The basis weight of paper webs used in the process of the present invention can vary depending upon the final product. For example, the process of the present invention can be used to produce facial tissues, bath tissues, paper towels, industrial wipers, and the like. For these products, the basis weight of the paper web can vary from about 10 gsm to about 120 gsm, and particularly from about 35 gsm to about 80 gsm. In one particular embodiment, it has been discovered that the present invention is particularly well suited for the production of wiping products having a basis weight of from about 53 gsm to about 63 gsm.

As stated above, the manner in which the paper web is formed can also vary depending upon the particular application. In general, the paper web can be formed by any of a variety of papermaking processes known in the art as long as the process is capable of forming a textured web. For example, the paper web may comprise a through-air dried web such as an uncreped through-air dried web. Other textured through-air dried webs that may be used in the present invention include pattern-densified or imprinted webs. In another alternative embodiment, the tissue web may be made according to an air forming process.

Figure 2:
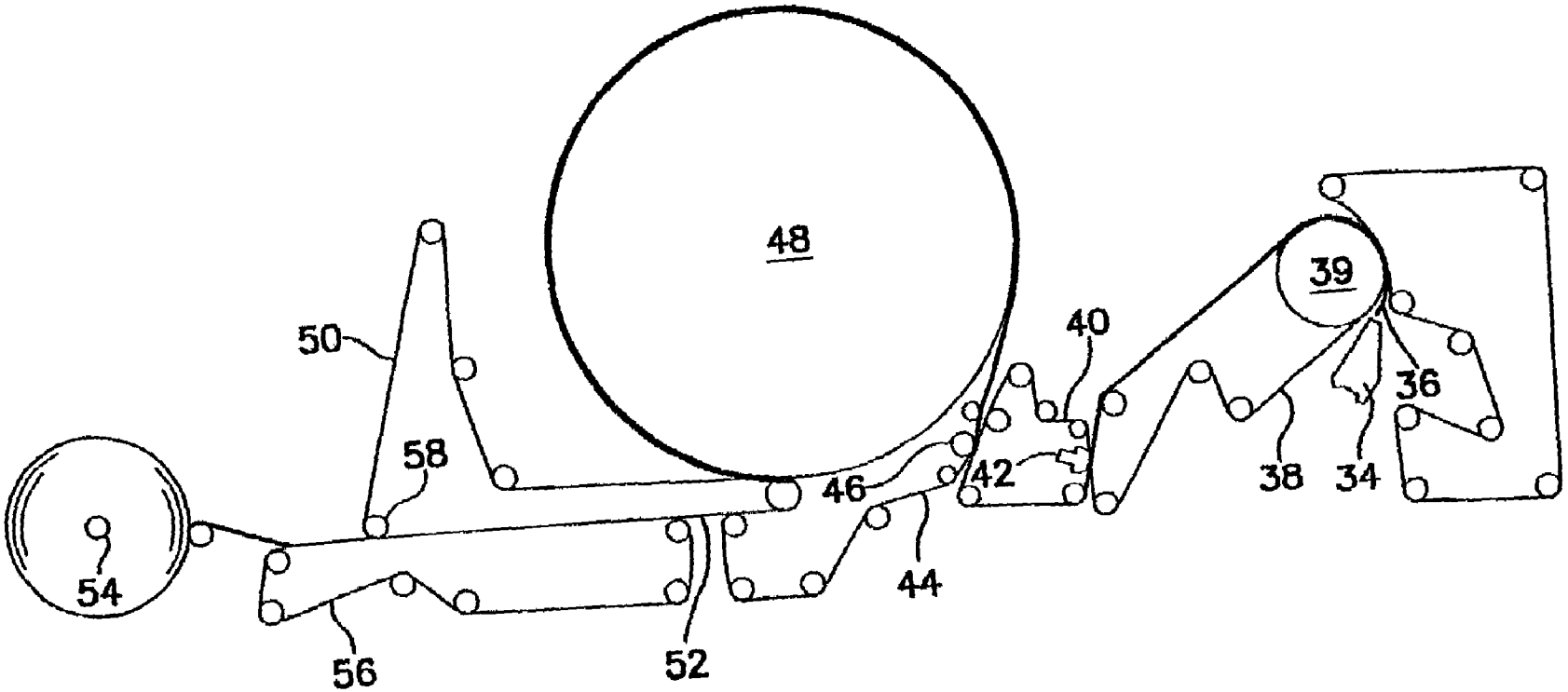
FIG. 2 is a schematic diagram of one embodiment of a process for forming uncreped through-dried paper webs for use in the present invention.

For example, referring to FIG. 2, shown is a method for making throughdried paper sheets that may be used in accordance with this invention. (For simplicity, the various tensioning rolls schematically used to define the several fabric runs are shown but not numbered. It will be appreciated that variations from the apparatus and method illustrated in FIG. 2 can be made without departing from the scope of the invention). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0-60 percent, more specifically from about 15-45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and texture. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be macroscopically arranged to conform to the surface of the throughdrying fabric and form a textured, three-dimensional surface.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web may be smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering or embossing may be used.

In one embodiment, the reel 54 shown in FIG. 2 can run at a speed slower than the fabric 56 in a rush transfer process for building bulk into the paper web 52. For instance, the relative speed difference between the reel and the fabric can be from about 5% to about 25% and, particularly from about 12% to about 14%. Rush transfer at the reel can occur either alone or in conjunction with a rush transfer process upstream, such as between the forming fabric and the transfer fabric.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance, disclosed in U.S. Pat. No. 5,672,248 to Wendt, et al.; U.S. Pat. No. 5,656,132 to Farrinqton, et al.; U.S. Pat. No. 6,120,642 to Lindsay and Burazin; U.S. Pat. No. 6,096,169 to Hermans, et al.; U.S. Pat. No. 6,197,154 to Chen, et al.; and U.S. Pat. No. 6,143,135 to Hada, et al., all of which are herein incorporated by reference in their entireties.

As mentioned above, uncreped through-air dried paper webs made according to the process illustrated in FIG. 2 provide various advantages in the process of the present invention. It should be understood, however, that other types of paper webs can be used in the present invention. For example, in an alternative embodiment, pattern-densified or imprinted throughdried webs may be used. In still another embodiment, a highly textured airform web may be incorporated into the present invention.

Figure 3:
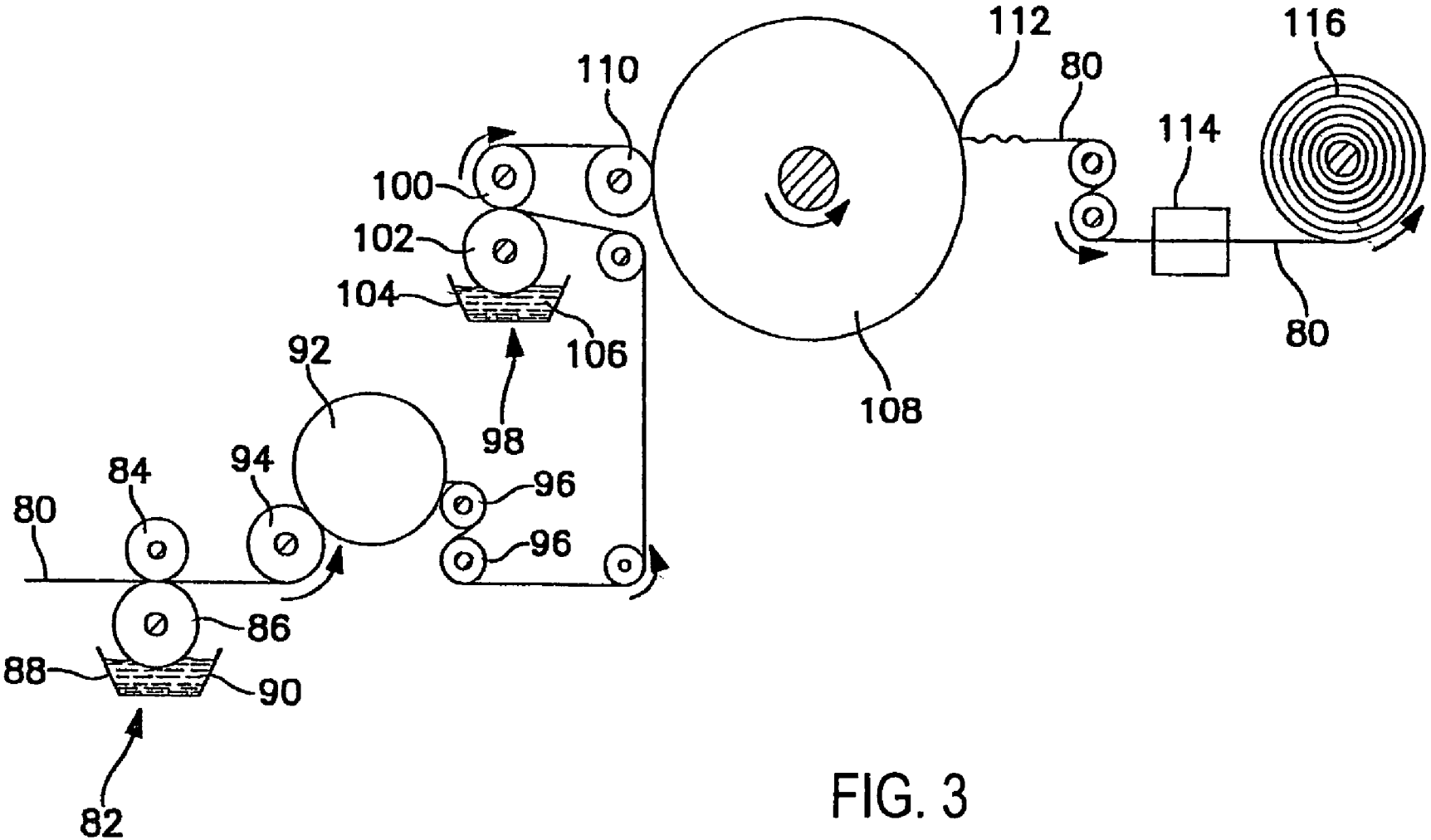
FIG. 3 is a schematic diagram of one embodiment of a process for applying a first bonding material to one side of the paper web, applying a second bonding material to an opposite side of the paper web and then creping one side of the web in accordance with the present invention.

Once the paper web is formed, a bonding material is applied to at least one side of the web and the treated side of the web is then creped. Referring to FIG. 3, one embodiment of a system that may be used to apply bonding materials to the paper web and to crepe one side of the web is illustrated. In the process shown in FIG. 3, the bonding materials are applied to both sides of the tissue web. It should be understood, however, that in other embodiments only one side of the tissue web may be treated with a bonding material. The embodiment shown in FIG. 3 can be an in-line or off-line process. As shown, paper web 80 made according to the process illustrated in FIG. 2 or according to a similar process, is passed through a first bonding agent application station generally 82. Station 82 includes a nip formed by a smooth rubber press roll 84 and a patterned rotogravure roll 86. Rotogravure roll 86 is in communication with a reservoir 88 containing a first bonding material 90. Rotogravure roll 86 applies the bonding material 90 to one side of web 80 in a preselected pattern.

Web 80 is then contacted with a heated roll 92 after passing a roll 94. The heated roll 92 is for partially drying the web. The heated roll 92 can be heated to a temperature, for instance, up to about 250° F. and particularly from about 180° F. to about 220° F. In general, the web can be heated to a temperature sufficient to dry the web and evaporate any water.

It should be understood, that besides the heated roll 92, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll 92, the web 80 can be advanced by pull rolls 96 to a second bonding material application station generally 98. Station 98 includes a transfer roll 100 in contact with a rotogravure roll 102, which is in communication with a reservoir 104 containing a second bonding material 106. Similar to station 82, second bonding material 106 is applied to the opposite side of web 80 in a preselected pattern. Once the second bonding material is applied, web 80 is adhered to a creping roll 108 by a press roll 110. Web 80 is carried on the surface of the creping drum 108 for a distance and then removed therefrom by the action of a creping blade 112. The creping blade 112 performs a controlled pattern creping operation on the second side of the paper web.

Once creped, paper web 80, in this embodiment, is pulled through a drying station 114. Drying station 114 can include any form of a heating unit, such as an oven energized by infrared heat, microwave energy, hot air or the like. Drying station 114 may be necessary in some applications to dry the web and/or cure the bonding materials. Depending upon the bonding materials selected, however, in other applications drying station 114 may not be needed.

The amount that the paper web is heated within the drying station 114 can depend upon the particular bonding materials used, the amount of bonding materials applied to the web, and the type of web used. In some applications, for instance, the paper web can be heated using a gas stream such as air at a temperature of about 510° F. in order to cure the bonding materials.

Once passed through drying station 114, web 80 can be wound into a roll of material 116.

The bonding materials applied to each side of the paper web are selected for not only assisting in creping the web but also for adding dry strength, wet strength, stretchability, and tear resistance to the tissue web. Particular bonding materials that may be used in the present invention include latex compositions, such as acrylates, vinyl acetates, vinyl chlorides and methacrylates. Some water-soluble bonding materials may also be used including polyacrylamides, polyvinyl alcohols and cellulose derivatives such as carboxymethyl cellulose. Other bonding materials include styrene-butadiene copolymers, polyvinyl acetate polymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, nitrile polymers, and the like. Other examples of suitable latex polymers may be described in U.S. Pat. No. 3,844,880 to Meisel, which is incorporated herein by reference.

In one embodiment, the bonding materials used in the process of the present invention comprise an ethylene vinyl acetate copolymer. In particular, the ethylene vinyl acetate copolymer can be cross-linked with N-methyl acrylamide groups using an acid catalyst. Suitable acid catalysts include ammonium chloride, citric acid and maleic acid.

The bonding materials are applied to the base web as described above in a preselected pattern. In one embodiment, for instance, the bonding materials can be applied to the web in a reticular pattern, such that the pattern is interconnected forming a net-like design or grid on the surface.

In an alternative embodiment, however, the bonding materials are applied to the web in a pattern that represents a succession of discrete shapes. Applying the bonding material in discrete shapes, such as dots, provides sufficient strength to the web without covering a substantial portion of the surface area of the web.

According to the present invention, the bonding materials are applied to each side of the tissue web so as to cover from about 15% to about 75% of the surface area of the web. More particularly, in most applications, the bonding material will cover from about 20% to about 60% of the surface area of each side of the web. The total amount of bonding material applied to each side of the web can be in the range of from about 1% to about 25% by weight, such as from about 2% to about 10% by weight, based upon the total weight of the web.

At the above amounts, the bonding materials can penetrate the paper web from about 10% to about 70% of the total thickness of the web. In many applications, the bonding material may penetrate from about 10% to about 15% of the thickness of the web.

Figure 5:
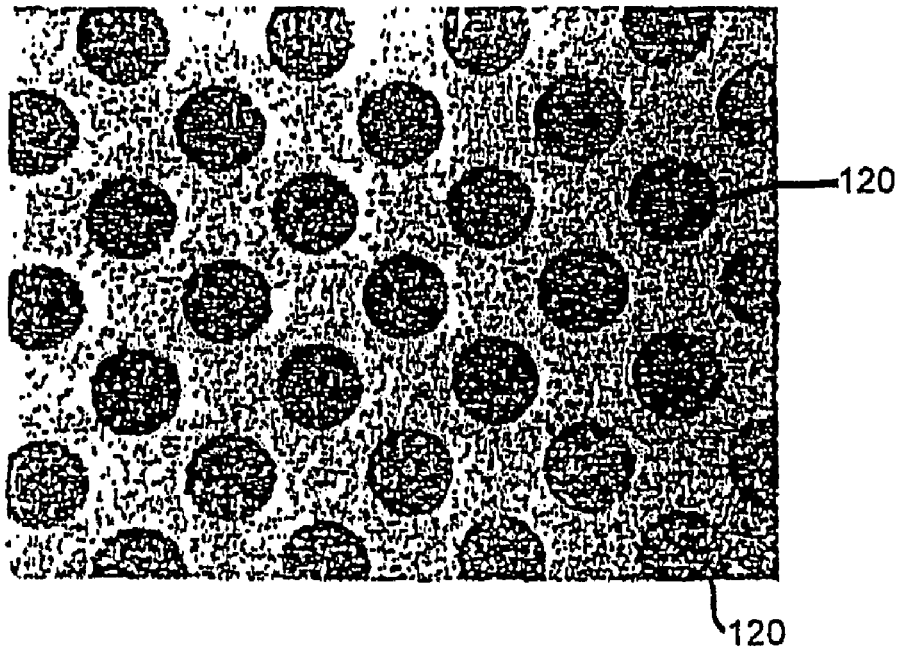
FIG. 5 is a plan view of one embodiment of a pattern that is used to apply bonding materials to paper webs made in accordance with the present invention.

Referring to FIG. 5, one embodiment of a pattern that can be used for applying a bonding material to a tissue web in accordance with the present invention is shown. As illustrated, the pattern shown in FIG. 5 represents a succession of discrete dots 120. In one embodiment, for instance, the dots can be spaced so that there are approximately from about 25 to about 35 dots per inch in the machine direction or the cross-machine direction. The dots can have a diameter, for example, of from about 0.01 inches to about 0.03 inches. In one particular embodiment, the dots can have a diameter of about 0.02 inches and can be present in the pattern so that approximately 28 dots per inch extend in either the machine direction or the cross-machine direction. In this embodiment, the dots can cover from about 20% to about 30% of the surface area of one side of the paper web and, more particularly, can cover about 25% of the surface area of the web.

Figure 7:
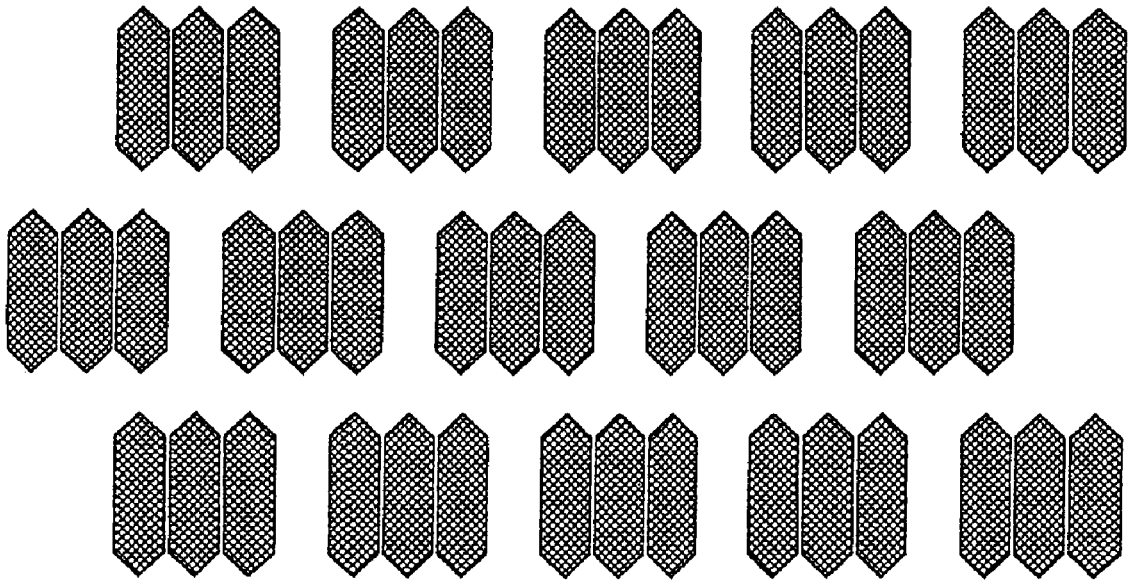
FIG. 7 is a plan view of another alternative embodiment of a pattern that is used to apply bonding materials to paper webs in accordance with the present invention.

Besides dots, various other discrete shapes can also be used. For example, as shown in FIG. 7, a pattern is illustrated in which the pattern is made up of discrete shapes that are each comprised of three elongated hexagons. In one embodiment, the hexagons can be about 0.02 inches long and can have a width of about 0.006 inches. Approximately 35 to 40 hexagon groups as shown per inch can be spaced in the machine direction and the cross-machine direction. When using hexagons as shown in FIG. 7, the pattern can cover from about 40% to about 60% of the surface area of one side of the web, and more particularly can cover about 50% of the surface area of the web.

Figure 6:
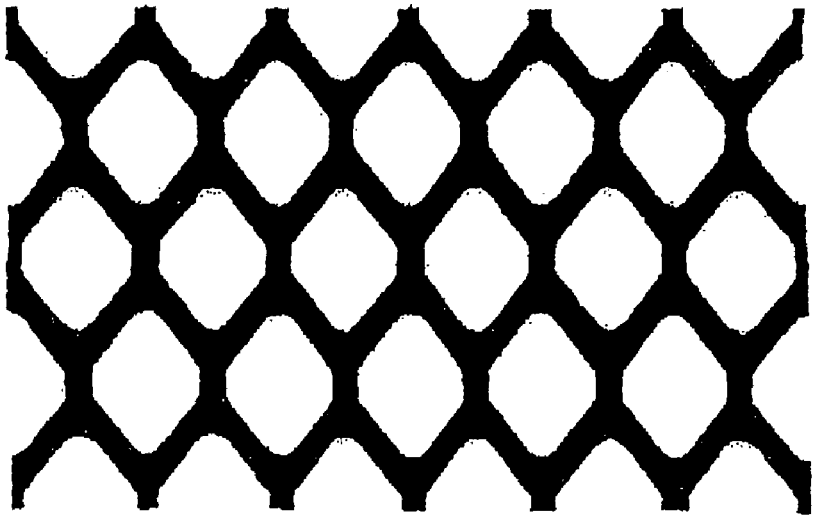
FIG. 6 is another embodiment of a pattern that is used to apply bonding materials to paper webs in accordance with the present invention.

Referring to FIG. 6, another embodiment of a pattern for applying a bonding material to a paper web is shown. In this embodiment, the pattern is a reticulated grid. More specifically, the reticulated pattern is in the shape of diamonds. When used, a reticulated pattern may provide more strength to the web in comparison to patterns that are made up on a succession of discrete shapes.

In one particular embodiment of the present invention especially well suited to constructing single ply products, a first bonding material is applied to a paper web according to the pattern shown in FIG. 5. A second bonding material, on the other hand, is applied to a second side of the paper web according to the pattern illustrated in FIG. 7. The second bonding material is applied to a greater amount of the surface area than the first bonding material. For example, the first bonding material can be applied according to the pattern shown in FIG. 5 and can cover approximately 25% of the surface area of the first side of the web. The second bonding material, however, is applied according to the pattern shown in FIG. 7 and covers approximately 50% of the surface area of the second side of the web. Through this process, a paper product is formed having enhanced overall properties.

The process that is used to apply the bonding materials to the paper web in accordance with the present invention can vary. For example, various printing methods can be used to print the bonding materials onto the base sheet depending upon the particular application. Such printing methods can include direct gravure printing using two separate gravures for each side, offset gravure printing using duplex printing (both sides printed simultaneously) or station-to-station printing (consecutive printing of each side in one pass). In another embodiment, a combination of offset and direct gravure printing can be used. In still another embodiment, flexographic printing using either duplex or station-to-station printing can also be utilized to apply the bonding materials.

In the embodiment shown in FIG. 3, each side of the tissue web 80 is treated with a bonding material and only one side of the web is creped. This may be referred to as a print-print-crepe process. As described above, applying bonding materials to both sides of the web is optional. In an alternative embodiment, for instance, only one side of the web is treated with a bonding material leaving an untreated side. Leaving one side of the tissue web untreated may provide various benefits and advantages under some circumstances. For instance, the untreated side may increase the ability of the tissue web to absorb liquids faster. Further, the untreated side may have a greater texture than if the side were treated with a bonding material.

Figure 4:
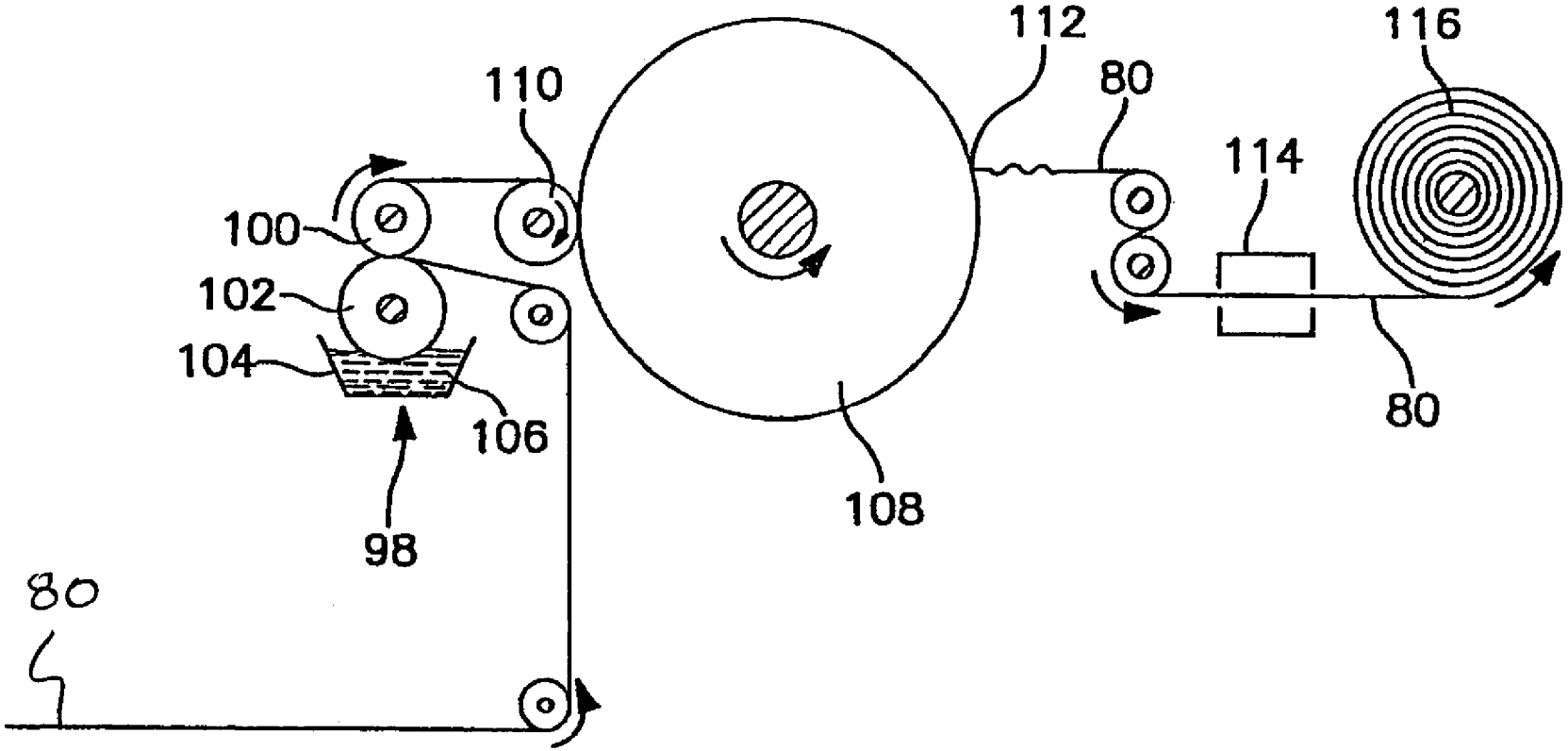
FIG. 4 is a schematic diagram of one embodiment of a process for applying a bonding material to one side of a paper web and creping the web in accordance with the present invention.

Referring to FIG. 4, one embodiment of a process for applying a bonding material to only one side of a tissue web in accordance with the present invention is shown. The process illustrated in FIG. 4 is similar to the process shown in FIG. 3. In this regard, like reference numerals have been used to indicate similar elements.

As shown, a web 80 is advanced to a bonding material application station generally 98. Station 98 includes a transfer roll 100 in contact with a rotogravure roll 102, which is in communication with a reservoir 104 containing a bonding material 106. At station 98, the bonding material 106 is applied to one side of the web 80 in a preselected pattern.

Once the bonding material is applied, web 80 is adhered to a creping drum 108 by a press roll 110. Web 80 is carried on the surface of the creping drum 108 for a distance and then removed therefrom by the action of a creping blade 112. The creping blade 112 performs a controlled pattern creping operation on the treated side of the web.

From the creping drum 108, the paper web 80 is fed through a drying station 114 which dries and/or cures the bonding material 106. The web 80 is then wound into a roll 116 for use in forming tissue products.

When only treating one side of the paper web 80 with a bonding material, in one embodiment, it may be desirable to apply the bonding material according to a pattern that covers greater than about 40% of the surface area of one side of the web. For instance, the pattern may cover from about 40% to about 60% of the surface area of one side of the web. In one particular example, for instance, the bonding material can be applied according to the pattern shown in FIG. 7.

According to the process of the current invention, numerous and different tissue products can be formed. For instance, the tissue products may be single-ply wiper products. The products can be, for instance, facial tissues, bath tissues, paper towels, napkins, industrial wipers, and the like. As stated above, the basis weight can range anywhere from about 10 gsm to about 120 gsm. In one particular embodiment, the present invention is directed to the production of a single ply paper towel product having a basis weight of from about 35 gsm to about 80 gsm.

Tissue products made according to the present invention may have a relatively high bulk. Tissue products made in accordance to the present invention, for instance, may have a bulk greater than 10 cc/g. For example, in one embodiment, the bulk of tissue products made in according to the present invention can be greater than about 11 cc/g, such as greater than about 12 cc/g.

In an alternative embodiment, tissue webs made according to the present invention can be incorporated into multiple ply products. For instance, in one embodiment, a tissue web made according to the present invention can be attached to one or more other tissue webs for forming a wiping product having desired characteristics. The other webs laminated to the tissue web of the present invention can be, for instance, a wet-creped web, a calendered web, an embossed web, a through-air dried web, a creped through-air dried web, an uncreped through-air dried web, an airlaid web, and the like.

The present invention may be better understood with reference to the following examples.

EXAMPLES

The following examples were completed in order to demonstrate the properties of tissue webs made in accordance with the present invention. The following are various tests that were conducted on the samples.

Topographical Evaluation

Moiré interferometry can be applied to obtain various measures of the topographical features of tissue made according to the present invention. One measure of the topography in a tissue web is Surface Depth. As used herein, "Surface Depth" refers to the characteristic height of peaks relative to surrounding valleys in a portion of a tissue web. The characteristic elevation relative to a baseline defined by surrounding valleys is the surface depth of a particular portion of the structure being measured. Unless otherwise stated, Surface Depth measurements are taken for characteristic profiles in the machine direction of the web, and should be measured along characteristic structures having the greatest typical peak-to-valley heights.

A suitable method for measurement of Surface Depth is moiré interferometry, which permits accurate measurement without deformation of the surface of the tissue web. The surface topography of the tissue webs should be measured using a computer-controlled white-light field-shifted moiré interferometer with about a 38 mm field of view. The principles of a useful implementation of such a system are described in Bieman et al. (L. Bieman, K. Harding, and A. Boehnlein, "Absolute Measurement Using Field-Shifted Moiré," *SPIE Optical Conference Proceedings*, Vol. 1614, pp. 259-264,1991). A suitable commercial instrument for moiré interferometry is the CADEYES® interferometer produced by Integral Vision (Farmington Hills, Mich.), constructed for a 38-mm field-of-view (a field of view within the range of 37 to 39.5 mm is adequate). The CADEYES® system uses white light which is projected through a grid to project fine black lines onto the sample surface. The surface is viewed through a similar grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera.

In the CADEYES moiré interferometry system, each pixel in the CCD video image is said to belong to a moiré fringe that is associated with a particular height range. The method of field-shifting, as described in the aforementioned work of Bieman et al. and as originally patented by Boehnlein (U.S. Pat. No. 5,069,548, herein incorporated by reference), is used to identify the fringe number for each point in the video image (indicating which fringe a point belongs). The fringe number is needed to determine the absolute height at the measurement point relative to a reference plane. A field-shifting technique (sometimes termed phase-shifting in the art) is also used for sub-fringe analysis (accurate determination of the height of the measurement point within the height range occupied by its fringe). These field-shifting methods coupled with a camera-based interferometry approach allows accurate and rapid absolute height measurement, permitting measurement to be made in spite of possible height discontinuities in the surface. The technique allows absolute height of each of the roughly 250,000 discrete points (pixels) on the sample surface to be obtained, if suitable optics, video hardware, data acquisition equipment, and software are used that incorporates the principles of moiré interferometry with field-shifting. Each point measured has a resolution of approximately 1.5 microns in its height measurement.

The computerized interferometer system is used to acquire topographical data and then to generate a grayscale image of the topographical data, said image to be hereinafter called "the height map". The height map is displayed on a computer monitor, typically in 256 shades of gray and is quantitatively based on the topographical data obtained for the sample being measured. The resulting height map for the 38-mm square measurement area should contain approximately 250,000 data points corresponding to approximately 500 pixels in both the horizontal and vertical directions of the displayed height map. The pixel dimensions of the height map are based on a 512×512 CCD camera which provides images of moiré patterns on the sample which can be analyzed by computer software. Each pixel in the height map represents a height measurement at the corresponding x- and y-location on the sample. In the recommended system, each pixel has a width of approximately 70 microns, i.e. represents a region on the sample surface about 70 microns long in both orthogonal in-plane directions). This level of resolution prevents single fibers projecting above the surface from having a significant effect on the surface height measurement. The z-direction height measurement must have a nominal accuracy of less than 2 microns and a z-direction range of at least 1.5 mm. (For further background on the measurement method, see the CADEYES Product Guide, Integral Vision, Farmington Hills, Mich., 1994, or other CADEYES manuals and publications of Integral Vision, formerly known as Medar, Inc.).

The CADEYES system can measure up to 8 moiré fringes, with each fringe being divided into 256 depth counts (sub-fringe height increments, the smallest resolvable height difference). There will be 2048 height counts over the measurement range. This determines the total z-direction range, which is approximately 3 mm in the 38-mm field-of-view instrument. If the height variation in the field of view covers more than eight fringes, a wrap-around effect occurs, in which the ninth fringe is labeled as if it were the first fringe and the tenth fringe is labeled as the second, etc. In other words, the measured height will be shifted by 2048 depth counts. Accurate measurement is limited to the main field of 8 fringes.

The moiré interferometer system, once installed and factory calibrated to provide the accuracy and z-direction range stated above, can provide accurate topographical data for materials such as paper towels. (Those skilled in the art may confirm the accuracy of factory calibration by performing measurements on surfaces with known dimensions). Tests are performed in a room under Tappi conditions (23° C., 50% relative humidity). The sample must be placed flat on a surface lying aligned or nearly aligned with the measurement plane of the instrument and should be at such a height that both the lowest and highest regions of interest are within the measurement region of the instrument.

Once properly placed, data acquisition is initiated using Integral Visions' PC software and a height map of 250,000 data points is acquired and displayed, typically within 30 seconds from the time data acquisition was initiated. (Using the CADEYES® system, the "contrast threshold level" for noise rejection is set to 1, providing some noise rejection without excessive rejection of data points). Data reduction and display are achieved using CADEYES® software for PCs, which incorporates a customizable interface based on Microsoft Visual Basic Professional for Windows (version 3.0). The Visual Basic interface allows users to add custom analysis tools.

The height map of the topographical data can then be used by those skilled in the art to determine characteristic peak to valley depth of individual structures, or Surface Depth.

Figure 26:
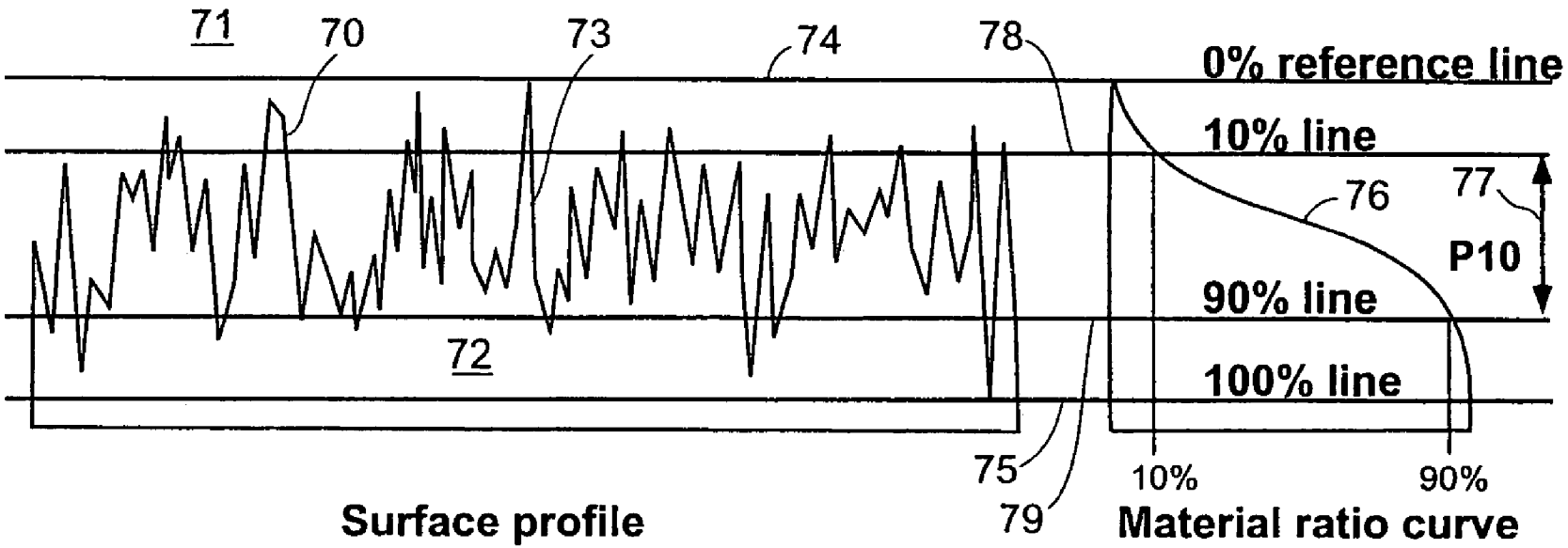
FIG. 26 is a diagram illustrating the process by which surface depth is measured according to the present invention.

For purposes of the present determinations, embossed regions and perforations should generally be avoided, and the web should be held flat. To facilitate holding of the web in a flat state, the web, resting on a flat, stable surface, should be restrained with a metal weight such as an aluminum plate about 2-cm thick having a 50-cm square central opening through which moiré interferometry measurements can be made of the tissue in the open area. Profile lines showing the topography along a line over the surface of the tissue in the measured area should be taken in areas free of embossed marks or perforations, focusing instead on characteristic structures that define the texture of the web prior to converting operations such as embossing and perforating. The profiles can then be analyzed for the peak to valley distance. To eliminate the effect of occasional optical noise and possible outliers, the highest 10% and the lowest 10% of the profile should be excluded, and the height range of the remaining points is taken as the surface depth. Technically, the procedure requires calculating the variable which we term "P10," defined at the height difference between the 10% and 90% material lines, with the concept of material lines being well known in the art, as explained by L. Mummery, in *Surface Texture Analysis: The Handbook*, Hommelwerke GmbH, Mühlhausen, Germany, 1990. In this approach, which will be illustrated with respect to FIG. 26, the surface 70 is viewed as a transition from air 71 to material 72. For a given profile 73, taken from a flat-lying sheet, the greatest height at which the surface begins—the height of the highest peak—is the elevation of the "0% reference line" 74 or the "0% material line," meaning that 0% of the length of the horizontal line at that height is occupied by material 72. Along the horizontal line passing through the lowest point of the profile 73, 100% of the line is occupied by material 72, making that line the "100% material line" 75. In between the 0% and 100% material lines 74 and 75 (between the maximum and minimum points of the profile), the fraction of horizontal line length occupied by material 72 will increase monotonically as the line elevation is decreased. The material ratio curve 76 gives the relationship between material fraction along a horizontal line passing through the profile 73 and the height of the line. The material ratio curve 76 is also the cumulative height distribution of a profile 73. (A more accurate term might be "material fraction curve").

Once the material ratio curve 76 is established, one can use it to define a characteristic peak height of the profile 73. The P10 "typical peak-to-valley height" parameter is defined as the difference 77 between the heights of the 10% material line 78 and the 90% material line 79. This parameter is relatively robust in that outliers or unusual excursions from the typical profile structure have little influence on the P10 height. The units of P10 are millimeters (mm). The Overall Surface Depth of a material 72 is reported as the P10 surface depth value for profile lines encompassing the height extremes of a characteristic region of that surface 70.

Falling Drape Test

One measure of the flexibility of a paper towel is its ability to bend freely. "Drape" is a term used in the textile arts to refer to the ability of a textile to bend and drape under the influence of gravity. Materials with good drape are those that show little stiffness and easily deform under the influence of gravity. In some applications, drape can be a useful feature in tissue products as well, particularly when stiff or sharp edges are undesirable in a wadded or folded product. Soft, highly flexible tissue webs with good drape can be obtained in at least some embodiments of the present invention.

Previously, measures of drape have measured the stiffness of a small portion of sample or the flexibility about a line of flexure in a web. A measure that can give a representation of the draping ability of an full-sized paper towel has been developed which can reflect the drapability of the entire web rather than just a small portion or single bending axis thereof. This measure reflects the aerodynamic drag offered by a sheet as it falls with a central weight attached to sheet. Sheets with good drape can yield under aerodynamic stress and present a small effective diameter and somewhat streamlined shape, allowing the web to fall more rapidly that a stiff web with poor drape. The "Falling Drape" value, as used herein, refers to the time required for a paper towel web to fall a predetermined distance under conditions set forth below.

To conduct the Falling Drape test, a full-size paper towel sheet having dimensions of about 26 to 29 cm square is conditioned under TAPPI conditions (73° F. and 50% relative humidity). The test is conducted in a room at TAPPI conditions at normal atmospheric pressure corresponding to an altitude of about 770 feet above sea level. The sheet is removed from a roll of perforated product with the outer surface of the sheet (the surface that was away from the core of the role) oriented to be the lower surface of the sheet. A weight is prepared comprising a 1989 United States dime and about 0.55 g of coral-colored Dow Corning 3179 Dilatant Compound (believed to be the original "Silly Putty®" material—a similar silicone putty can be used), jointly having a mass of 2.86 g. The putty is shaped into a disk about 1 cm in diameter and pressed against the surface of the dime to adhere to it. The putty side of the combination is then placed in contact with the center of the lower surface of the paper towel sheet and pressed to adhere the putty to the web. Generally the putty should not extrude past the edges of the dime after being joined to the center of the sheet. The perforated edges of the sheet are then held by hand in a horizontal orientation such that the sheet is generally horizontal, with the center portion being about 2 inches lower than the perforated edges. The sheet is held such that the dime is six feet above the floor. For example, a first relatively tall person having eyes at a height of six feet above the floor can visually align the dime with a six-foot mark on a wall about 4 feet away to hold the dime at a six-foot height. The dime should be held directly over a marked target on the floor in the center of a circle with a three-foot diameter. A second person with a digital stop watch having a resolution of 0.01 seconds can begin the stop watch and count the time to a predetermined time such as 5 seconds, whereupon the first person releases the sheet at the predetermined time. The second person monitors the descent of the centrally weighted sheet and stops the timer when the dime hits the floor. The descent time is the lapsed time shown on the stopwatch minus the predetermined time (e.g., 5 seconds) when the sheet was released. The sheet should descend such that the dime contacts the floor within the circle having a three-foot diameter around the target that was directly below the dime when the sheet was released. If the dime contacts the floor outside the circle, the descent time is discarded. The test is repeated seven times for a given sheet and the mean is reported as the Falling Drape value.

For tissue of the present invention, the Falling Drape value can be about 1.5 seconds or less, more specifically about 1.4 seconds or less, and more specifically still about 1.3 seconds of less, such as from about 0.8 seconds to about 1.5 seconds, or from about 1.0 seconds to about 1.4 seconds.

Within some practical ranges of basis weights, the Falling Drape value for a sheet with good drape may be expected to increase as basis weight increases, since the increased basis weight may increase stiffness of the web proportionately more than it decreases the relative effect of aerodynamic drag. Thus, variable basis weight among samples may be normalized to a degree by assuming a linear relationship between Falling Drape value and basis weight. A Normalized Falling Drape value is obtained by dividing the Falling Drape value with basis weight of the towel in grams per square meter and multiplying by 30 grams per square meter (i.e., Normalized Falling Drape=Falling Drape/basis weight*30 gsm). For tissues of the present invention, Normalized Falling Drape can be about 1.5 seconds or less, about 1.3 seconds or less, about 1.1 seconds or less, or less than 1 second, such as from about 0.6 seconds to about 1.5 seconds, or from about 0.8 seconds to about 1.3 seconds. In one embodiment, the webs of the present invention can have a Falling Drape value roughly equal to or less than that of VIVA® paper towels (specifically, less than 1.3 seconds) while having a Normalized Falling Drape substantially greater than that of VIVA® paper towels (specifically, greater than 0.70 seconds) reflecting the lower basis weights required to obtain suitable soft, strong, bulky towels under the present invention.

Example 1

Sample No. 1

A pilot tissue machine was used to produce a layered, uncreped throughdried towel basesheet in accordance with this invention generally as described in FIG. 2. After manufacture on the tissue machine, the uncreped throughdried basesheet was printed on each side with a latex binder (moisture barrier coating). The binder-treated sheet was adhered to the surface of a Yankee dryer to re-dry the sheet and thereafter the sheet was creped. The resulting sheet was converted into rolls of single-ply paper towels in a conventional manner.

More specifically, the basesheet was made from a stratified fiber furnish containing a center layer of fibers positioned between two outer layers of fibers. Both outer layers of the basesheet contained 100% northern softwood kraft pulp and about 3.75 kilograms (kg)/metric ton (Mton) of dry fiber of a debonding agent (ProSoft® TQ1003 from Hercules, Inc.). Each of the outer layers comprised 25% of the total fiber weight of the sheet. The center layer, which comprised 50% of the total fiber weight of the sheet, was comprised of 100% by weight of northern softwood kraft pulp. The fibers in this layer were also treated with 3.75 kg/Mton of ProSoft® TQ1003 debonder.

The machine-chest furnish containing the chemical additives was diluted to approximately 0.2 percent consistency and delivered to a layered headbox. The forming fabric speed was approximately 1840 feet per minute (fpm) (561 meters per minute). The basesheet was then rush transferred to a transfer fabric (Voith Fabrics, 807) traveling 15% slower than the forming fabric using a vacuum roll to assist the transfer. At a second vacuum-assisted transfer, the basesheet was transferred and wet-molded onto the throughdrying fabric (Voith Fabrics, t1203-8). The sheet was dried with a through air dryer resulting in a basesheet having an air-dry basis weight of 45.2 grams per square meter (gsm).

As shown in FIG. 3, the resulting sheet was fed to a gravure printing line where the latex binder was printed onto the surface of the sheet. The first side of the sheet was printed with a binder formulation using direct rotogravure printing. The sheet was printed with a 0.020 diameter "dot" pattern as shown in FIG. 5 wherein 28 dots per inch were printed on the sheet in both the machine and cross-machine directions. The resulting surface area coverage was approximately 25%. Then the printed sheet passed over a heated roll to evaporate water.

Next, the second or opposite side of the sheet was printed with the same latex binder formulation using a second direct rotogravure printer. The sheet was printed with discrete shapes, where each shape was comprised of three elongated hexagons as illustrated in FIG. 7. Each hexagon within each discrete shape was approximately 0.02 inches long with a width of about 0.006 inches. The hexagons within a discrete shape were essentially in contact with each other and aligned in the machine direction. The spacing between discrete shapes was approximately the width of one hexagon. The sheet was printed with 37.5 discrete shapes per inch in the machine direction and 40 elements per inch in the cross-machine direction. The resulting surface area coverage was approximately 50%. Of the total latex binder material applied, roughly 60% was applied to the first side and 40% to the second side of the web, even though the surface area coverage of the second side was greater than that of the first side. This arrangement provided for greater penetration of the binder material into the sheet by the first pattern than the second pattern, which remained substantially on the surface of the second side of the sheet.

The sheet was then pressed against and doctored off a rotating drum, which had a surface temperature of 100C. Finally the sheet was wound into a roll. Thereafter, the resulting print/print/creped sheet was converted into rolls of single-ply paper toweling in a conventional manner. The finished product had an air dry basis weight of approximately 55.8 gsm.

The latex binder material in this example was a carboxylated vinyl acetate-ethylene terpolymer, AIRFLEX® A426, which was obtained from Air Products and Chemicals, Inc. of Allentown, Pa. The add-on amount of the binder applied to the sheet was approximately 7 weight percent.

The bonding formulation for this example was prepared as two separate mixtures, called the "latex" and "reactant". The "latex" material contained the epoxy-reactive polymer and the "reactant" was the epoxy-functional polymer. The procedure calls for each mixture to be made up independently, and then combined together prior to use. After the latex and reactant mixtures were combined, the appropriate amount of "thickener" (Natrosol solution) was added to adjust viscosity. The "latex" and "reactant" mixtures contained the following ingredients, listed in their order of addition.

| | |
|---|---|
| Latex | |
| 1. AIRFLEX ® 426 (62% solids) | 34,200 g |
| 2. Defoamer (Nalco 7565) | 200 g |
| 3. Water | 7,633 g |
| 4. LiCl solution tracer (10% solids) | 200 g |
| Reactant | |
| 1. Kymene ® 2064 (20% solids) | 5,435 g |
| 2. Water | 8,005 g |
| 3. NaOH (10% solution) | 2,800 g |

When the NaOH had been added, the pH of the reactant mixture was approximately 12. After all reactant ingredients were added, the mixture was allowed to mix for at least 15 minutes prior to adding to the latex mixture.

| Thickener | |
|---|---|
| 1. Natrosol 250MR, Hercules (2% solids) | 500 g |

After all ingredients had been added, the print fluid was allowed to mix for approximately 5-30 minutes prior to use in the gravure printing operation. For this bonding formulation, the weight percent ratio of epoxy-functional polymer based on carboxylic acid-functional polymer (epoxy-reactive polymer) was about 5.1%.

The viscosity of the print fluid was 110 cps, when measured at room temperature using a viscometer (Brookfield® Synchro-lectric viscometer Model RVT, Brookfield Engineering Laboratories Inc. Stoughton, Mass.) with a #1 spindle operating at 20 rpm. The oven-dry solids of the print fluid was 39.1 weight percent. The print fluid pH was 5.2.

The resulting single-ply bonded sheet was tested for tensile strength, basis weight and caliper shortly after manufacture. As used herein, dry machine direction (MD) tensile strengths represent the peak load per sample width when a sample is pulled to rupture in the machine direction. In comparison, dry cross-machine direction (CD) tensile strengths represent the peak load per sample width when a sample is pulled to rupture in the cross-machine direction. Samples for tensile strength testing are prepared by cutting a 3 inches (76.2 mm) wide×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD dry tensile strength" or the "CD dry tensile strength" of the specimen depending on the sample being tested. At least six (6) representative specimens are tested for each product and the arithmetic average of all individual specimen tests is either the MD or CD tensile strength for the product.

Wet tensile strength measurements are measured in the same manner, but are only typically measured in the cross-machine direction of the sample. Prior to testing, the center portion of the CD sample strip is saturated with tap water immediately prior to loading the specimen into the tensile test equipment. CD wet tensile measurements can be made both immediately after the product is made and also after some time of natural aging of the product. For simulating natural aging, experimental product samples were artificially aged for 10 minutes in an oven at 105° C. Sample wetting is performed by first laying a single test strip onto a piece of blotter paper (Fiber Mark, Reliance Basis 120). A pad is then used to wet the sample strip prior to testing. The pad is a Scotch-Brites brand (3M) general purpose commercial scrubbing pad. To prepare the pad for testing, a full-size pad is cut approximately 2.5 inches (63.5 mm) long by 4 inches (101.6 mm) wide. A piece of masking tape is wrapped around one of the 4 inch (101.6 mm) long edges. The taped side then becomes the "top" edge of the wetting pad. To wet a tensile strip, the tester holds the top edge of the pad and dips the bottom edge in approximately 0.25 inch (6.35 mm) of tap water located in a wetting pan. After the end of the pad has been saturated with water, the pad is then taken from the wetting pan and the excess water is removed from the pad by lightly tapping the wet edge three times on a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry tensile tests, the characterization of a product is determined by the average of six representative sample measurements.

Sample 2

A single-ply bonded sheet was produced as described above, except the fibers were treated with 3.5 kg/Mton of ProSoft TQ1003 debonder, the forming fabric speed was approximately 1700 fpm (518 meters per minute), with the resulting basesheet having an air-dry basis weight of 45.0 gsm. The sheet was then run through the print/print/creped process except that the second or opposite side of the sheet was printed with the discrete pattern shown in FIG. 7, with 40 discrete shapes per inch in the machine direction and 40 elements per inch in the cross-machine direction. The sheet was then cured using air heated to approximately 38° C. and then wound into a roll. Thereafter, the resulting print/print/creped sheet was converted into rolls of single-ply paper toweling in a conventional manner. The finished product had an air dry basis weight of approximately 55.1 gsm.

A different binder recipe was used which also incorporated glyoxal as a crosslinking agent in the latex formulation. The ingredients of the "latex", "reactant" and "thickener" are listed below.

| | |
|---|---|
| Latex | |
| 1. AIRFLEX ® 426 (62% solids) | 17,200 g |
| 2. Defoamer (Nalco 7565) | 100 g |
| 3. Water | 0 g |
| 4. LiCl solution tracer (10% solids) | 100 g |
| 5. Glyoxal (40% solids) | 2,715 g |
| Reactant | |
| 1. Kymene ® 2064 (20% solids) | 5,475 g |
| 2. Water | 8,000 g |
| 3. NaOH (10% solution) | 2,800 g |

When the NaOH had been added, the pH of the reactant mixture was approximately 12. After all reactant ingredients were added, the mixture was allowed to mix for at least 15 minutes prior to adding to the latex mixture.

| Thickener | |
|---|---|
| 1. Natrosol 250MR, Hercules (2% solids) | 0 g |

After all ingredients had been added, the print fluid was allowed to mix for approximately 5-30 minutes prior to use in the gravure printing operation. For this bonding formulation, the weight percent ratio of epoxy-functional polymer based on carboxylic acid-functional polymer was 10% and the weight percent ratio of glyoxal based on carboxylic acid-functional polymer was 10%.

The viscosity of the print fluid was 120 cps, when measured at room temperature using a viscometer (Brookfielde Synchro-lectric viscometer Model RVT, Brookfield Engineering Laboratories Inc. Stoughton, Mass.) with a #1 spindle operating at 20 rpm. The oven-dry solids of the print fluid was 35.7 weight percent. The print fluid pH was 5.2.

The resulting single-ply bonded sheet was tested for tensile strength, basis weight and caliper shortly after manufacture. The test results are summarized in Table 1 below. Please note that samples used for wet tensile strength measurements were artificially aged for 10 minutes in an oven at 105° C. to simulate naturally aged wet tensile.

TABLE 1

| | Sample No. 1 | Sample No. 2 |
|---|---|---|
| MD Tensile g/76.2 mm | 1273 | 1614 |
| MD Stretch % | 37.2 | 33.7 |
| MD TEA g*cm/sq.cm | 24.5 | 26.7 |
| MD Slope g | 1584 | 2201 |
| CD Tensile g/76.2 mm | 1072 | 1210 |
| CD Stretch % | 17.4 | 15.4 |
| CD TEA g*cm/sq.cm | 14.1 | 13.1 |
| CD Slope g | 6408 | 6354 |
| CD Wet Tensile Water g/76.2 mm | 451 | 777 |
| Wet/Dry % | 42 | 64 |
| Basis Weight gsm | 55.8 | 55.1 |

Example 2

Topography was examined in sheets from single perforated sheets taken from five different paper towel products, including Samples Nos. 1 and 2 described above, all of which were conditioned under TAPPI conditions at 73° F. and 50% relative humidity:

1. VIVA® paper towels, manufactured by Kimberly-Clark (Dallas, Tex.), obtained November 2003 in Neenah, Wis. The sheet studied had dimensions of 28.5 cm by 25.5 cm, a conditioned mass of 5.03 grams.
2. SCOTT® paper towels, manufactured by Kimberly-Clark (Dallas, Tex.), obtained November 2003 in Neenah, Wis. The sheet studied had dimensions of 28 cm by 28 cm, and a conditioned mass of 2.86 grams.
3. BOUNTY® paper towels, manufactured by Procter & Gamble (Cincinnati, Ohio), obtained November 2003 in Neenah, Wis. The sheet studied had dimensions of 28.5 cm by 28.5 cm, and a conditioned mass of 3.26 grams.
4. Sample No. 1, having dimensions of 28 cm by 29.5 cm, and a conditioned mass of 4.38 grams.
5. Sample No. 2, having dimensions of 28.5 cm by 26 cm, and a conditioned mass of 4.14 grams.

Falling Drape measurements were conducted, giving the results of Table 2:

TABLE 2

| Falling Drape Results. | | | |
|---|---|---|---|
| Sample | Falling Drape | St. Dev. | Norm. Drape |
| BOUNTY ® | 1.69 | 0.070 | 1.68 |
| SCOTT ® | 1.38 | 0.049 | 1.51 |
| VIVA ® | 1.21 | 0.105 | 0.70 |
| Sample No. 1 | 1.21 | 0.125 | 0.91 |
| Sample No. 2 | 1.16 | 0.080 | 0.83 |

Figure 8:
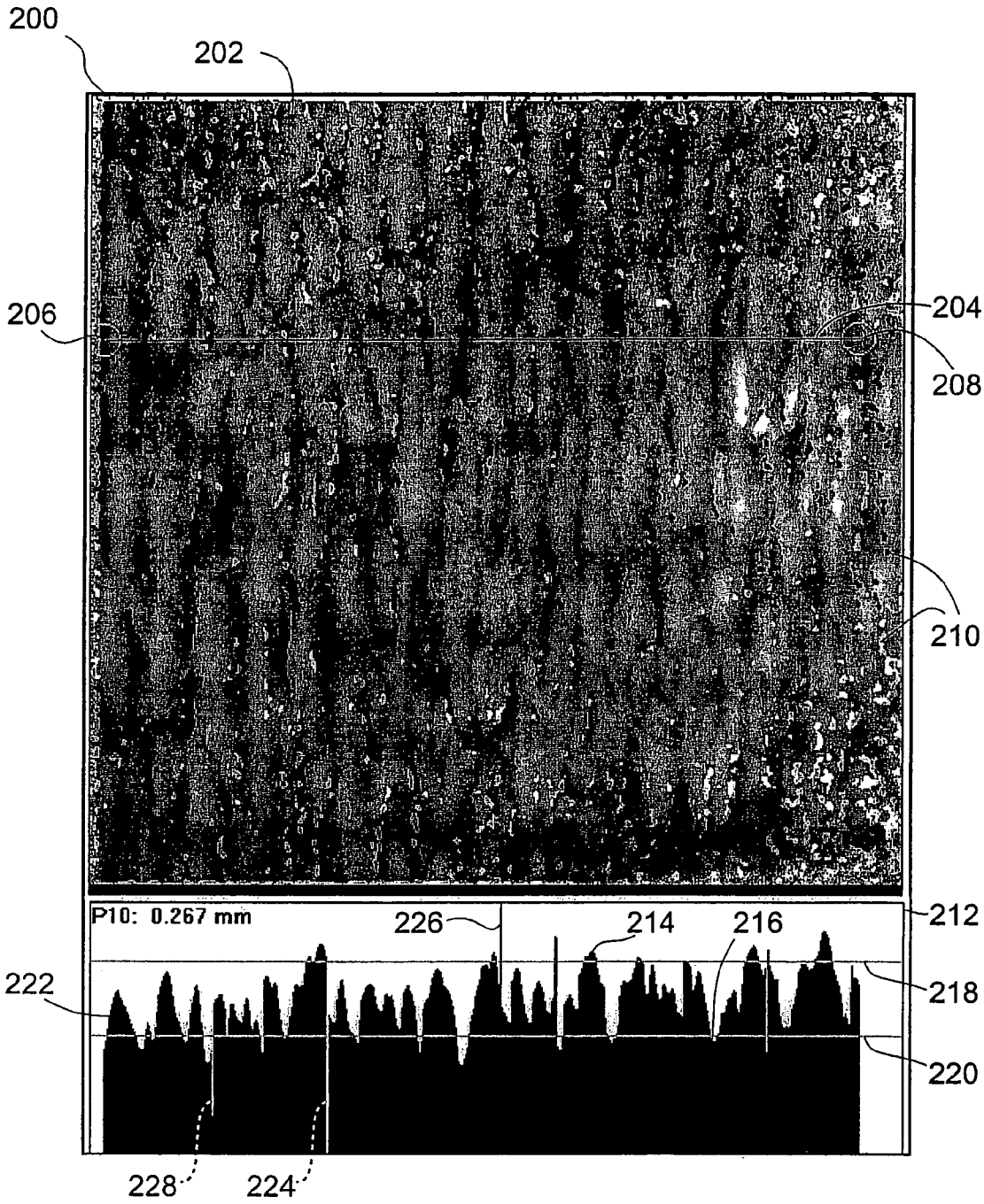
FIGS. 8-25 and 27-41 are surface depth analysis graphs and photographs of samples discussed in the Examples.

The topography of each sample was examined by performing moiré interferometry measurements on sections of both surfaces of the samples. FIG. 8 shows a screenshot 200 from CADEYES-related software depicting a height map 202 for a first side of Sample No. 2. The height map 202 depicts a grayscale representation of the topography of an approximately 38-mm square region of Sample No. 2. In the height map 202, light regions correspond to elevated regions of the web and dark regions correspond to depressed regions of the web. The horizontal direction here corresponds to the machine direction, as is generally the case in following height maps, unless indicated otherwise. A manually selected profile line 204 has been drawn across the height map 202, where it spans first and second endpoints 204, 206. The various elevations along the profile line 204 are graphically portrayed below the height map 202 in a profile box 212, where the two-dimensional height profile 222 is depicted. The height profile 222 shows a series of peaks 216 and valleys 214, punctuated by occasional drop outs 224 where a measurement could not be obtained (often due to an undefined surface or out-of-range surface corresponding to the affected pixels on the height map 222), or by upward spikes 226 or downward spike 228 which typically differ from the height of adjacent pixels by an amount equal to one fringe count, a problem arising when there is optical noise 210 in the sample, particularly nearly the sides of the measured area where the signal-to-noise ratio may be relatively low. Measurements are best made in regions with relatively little noise (e.g., spikes affecting less than about 4% of the points being measured).

In the profile box 212, the 90% material line 218 and the 10% material line 220 are shown. The vertical gap between the 90% material line 218 and the 10% material line 220 is the P10 value for the height profile 222, which is 0.267 mm in FIG. 8, although the peak-to-valley depth for several individual peaks is larger (e.g., about 0.35 mm). P10 tends to be a conservative estimate of peak-to-valley depth because the highest and lowest points are excluded from the measurement.

Figure 9:
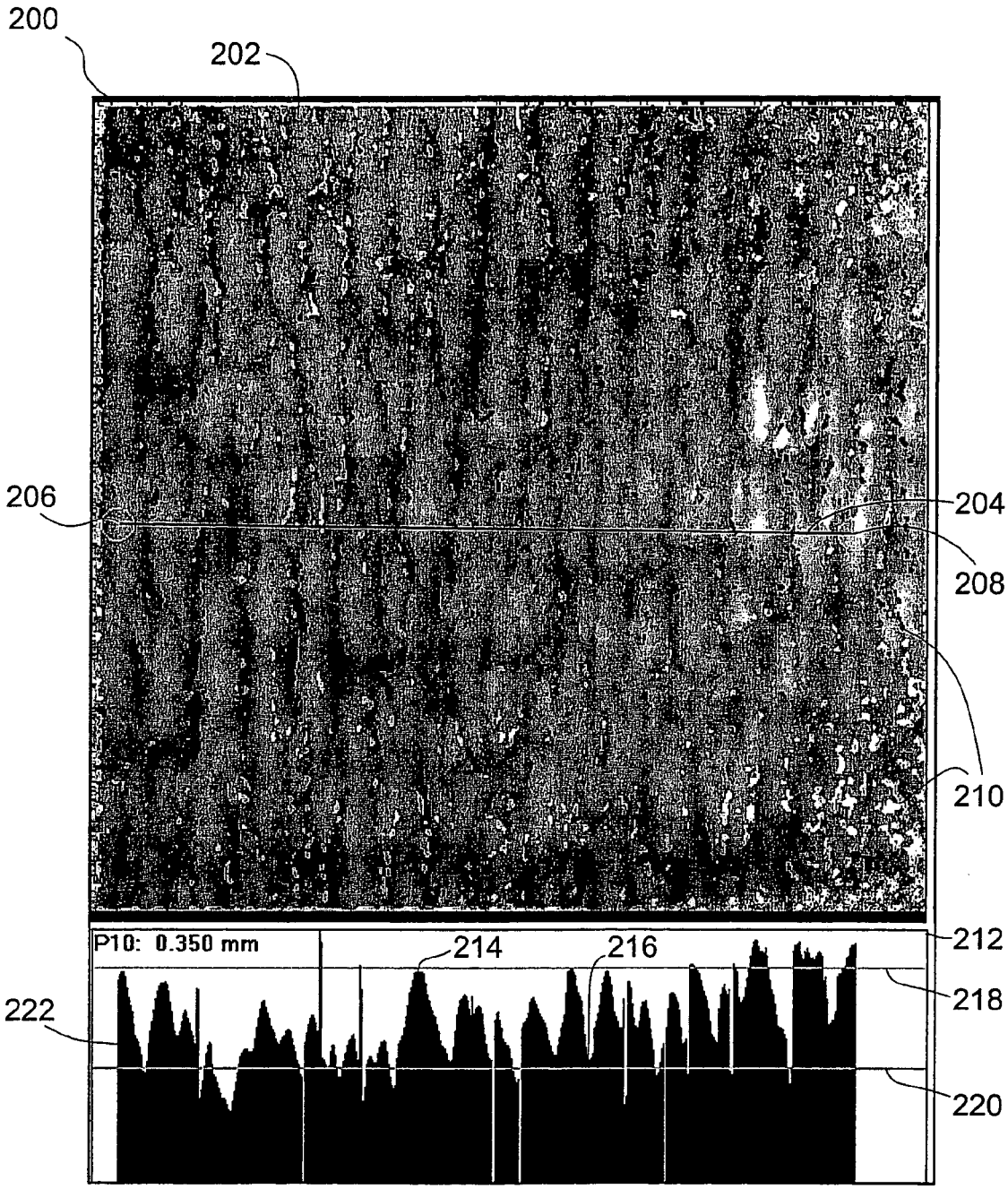

FIG. 9 shows the same height map 200 as in FIG. 8 but with a different profile line 204 selected and thus a different height profile 222, the P10 value in this case now being 0.350 mm. In general, topographic measurements of Sample No. 2 indicate that the Surface Depth is about 0.3 mm, and that characteristic peak-to-valley depths are somewhat greater, such as about 0.35 mm.

The height map 200 also shows that the surface being measured has a series of rounded peaks extending laterally in the cross-direction. The large, dominant structures have a width of about 2 mm (i.e., there are roughly 20 large peaks along a 38-mm machine-direction profile), although other smaller peaks also occur.

Figure 10:
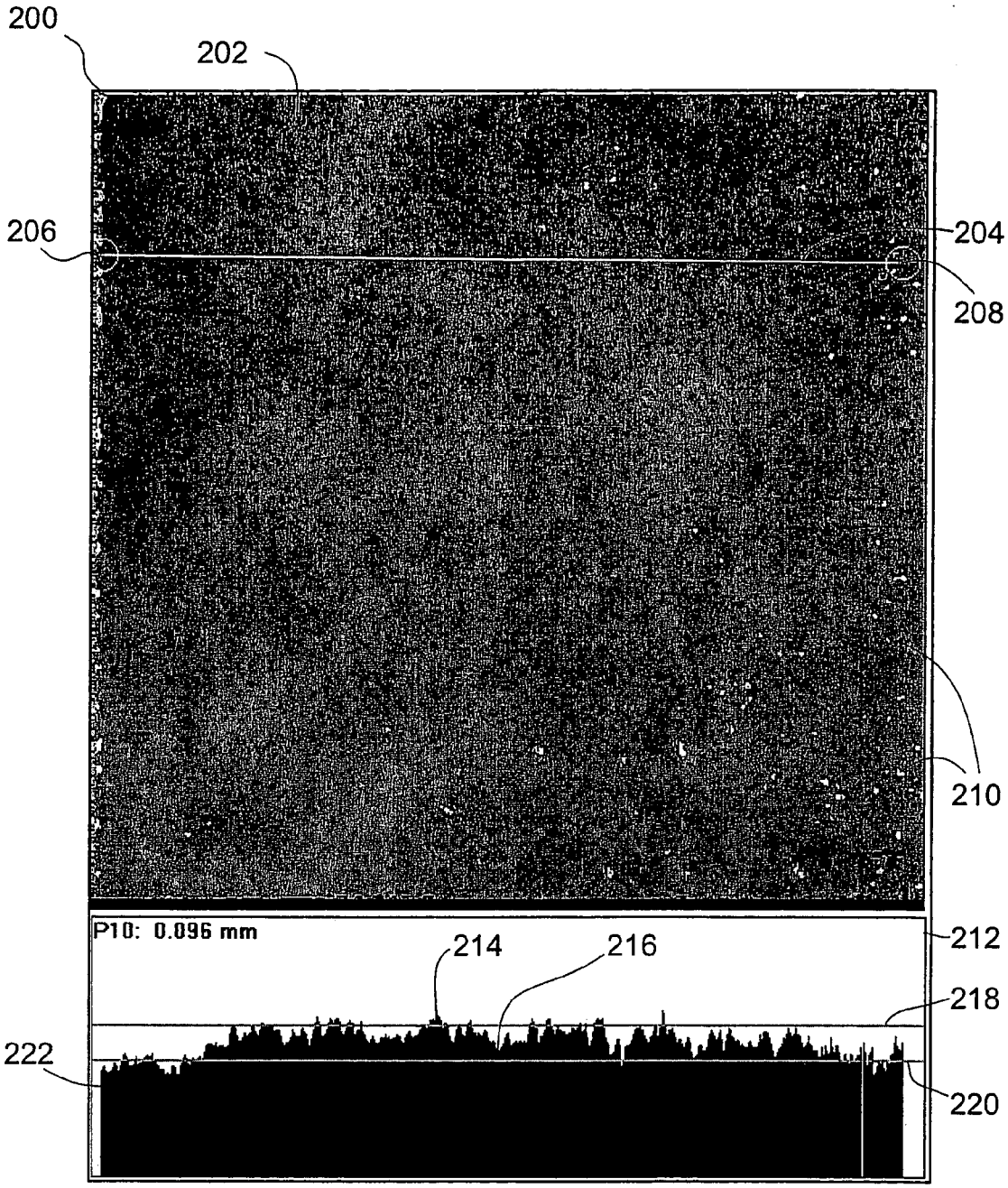

FIG. 10 shows the height map 202 for the second side (creped side) of Sample No. 2, the side opposite to what was measured in FIGS. 8 and 9. For the profile line 204 shown, also taken in the machine direction, the corresponding height profile 222 yields a P10 value of 0.096 mm, and other measurements give similar results, indicating that the Surface Depth of the second side of Sample No. 2 is about 0.1 mm, and that characteristic peak-to-valley heights for individual peaks 216 is also about 0.1 mm or less. In this case, a lack of flatness (macroscopic waviness) in the sheet may slightly inflate the measurement of P10 such that it may be slightly higher than the characteristic height of typical peaks.

Figure 11:
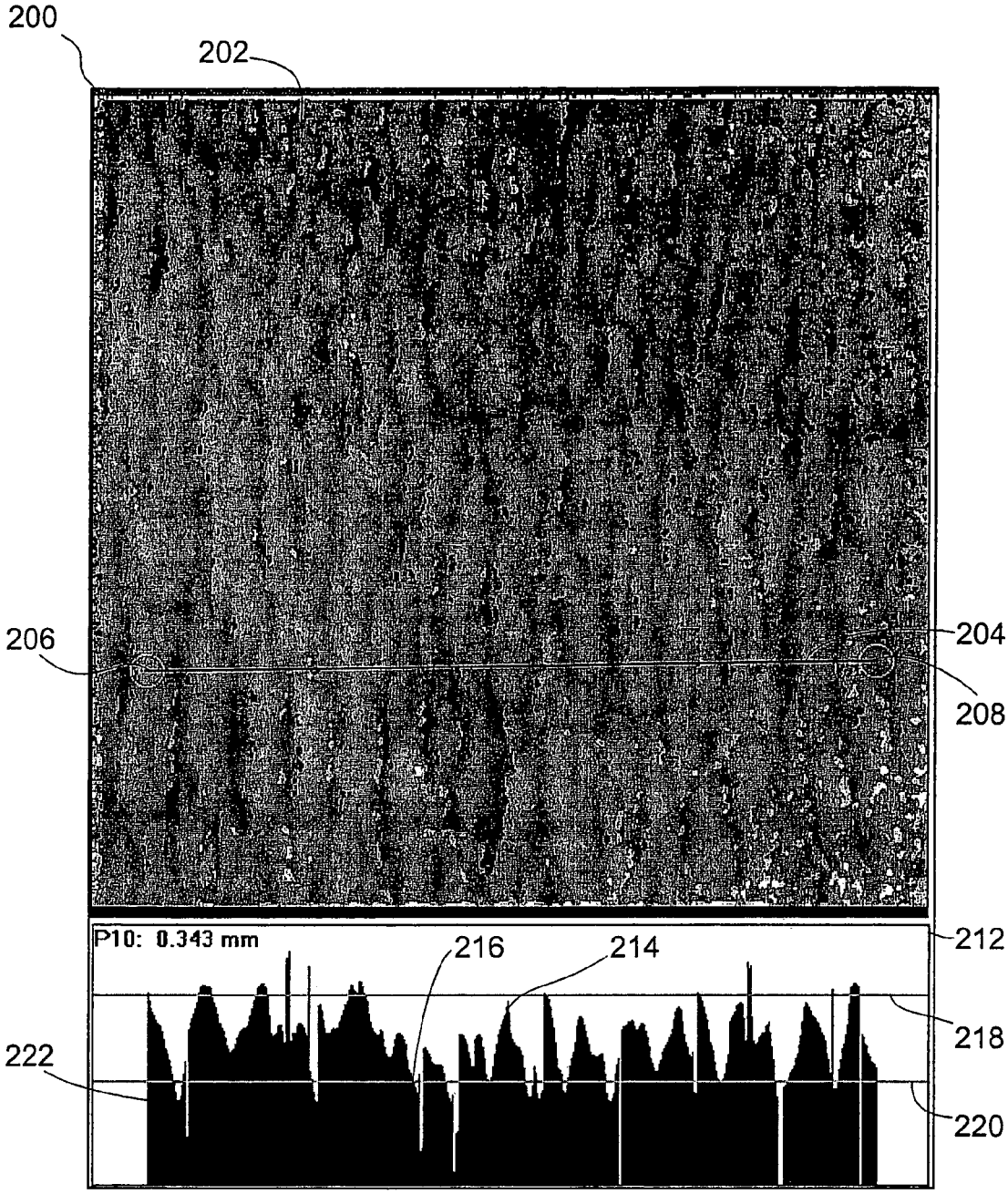

FIG. 11 is another screenshot 200 depicting a height map 202 for the first side of Sample No. 1, made according to the present invention. Structures similar to those of the first side of Sample No. 2 are evident. The P10 value along the profile line 204 is 0.343 mm.

Figure 12:
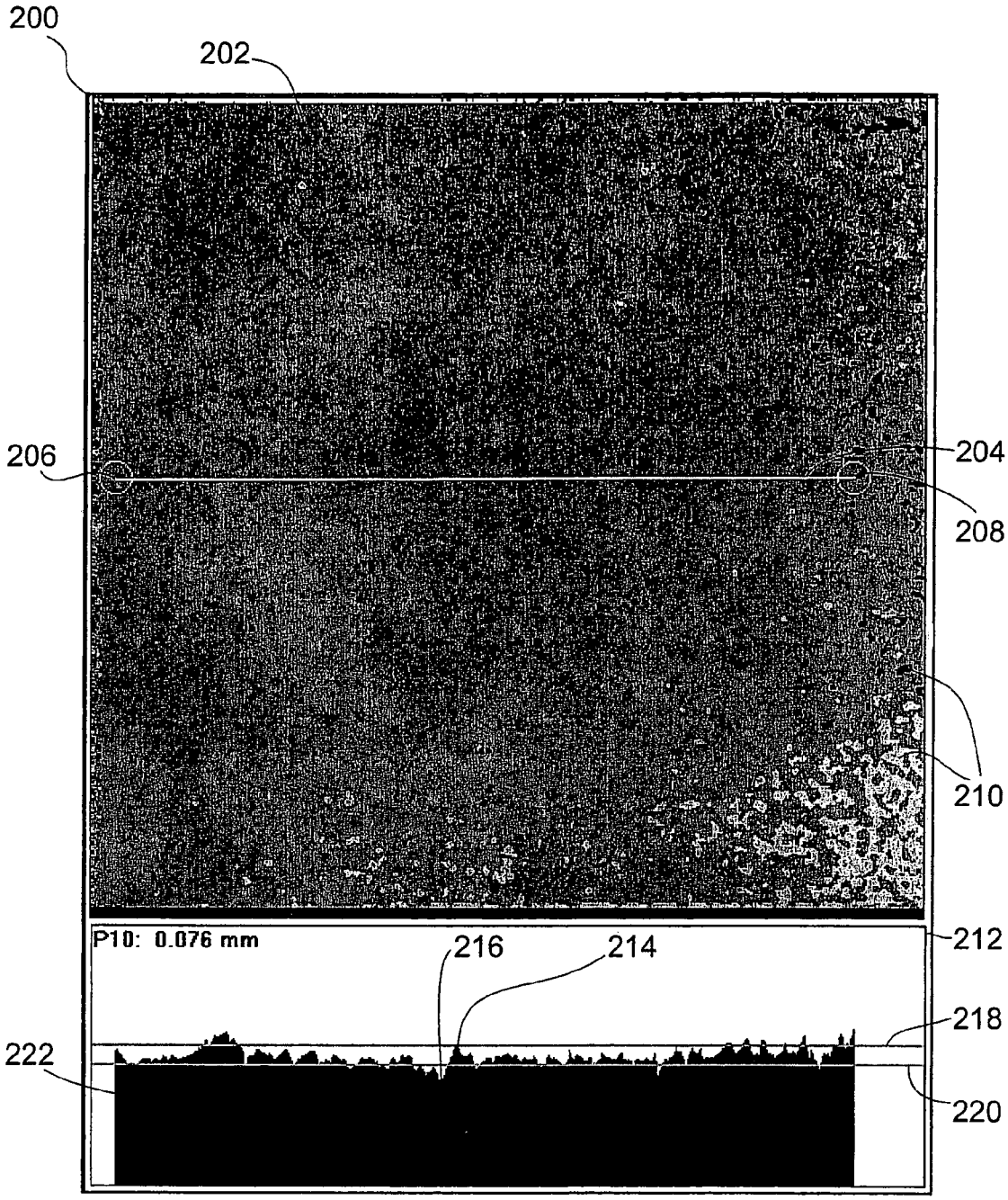

FIG. 12 shows the height map 202 for the second side of Sample No. 1. The P10 value along the profile line 204 is 0.076 mm.

Figure 13:
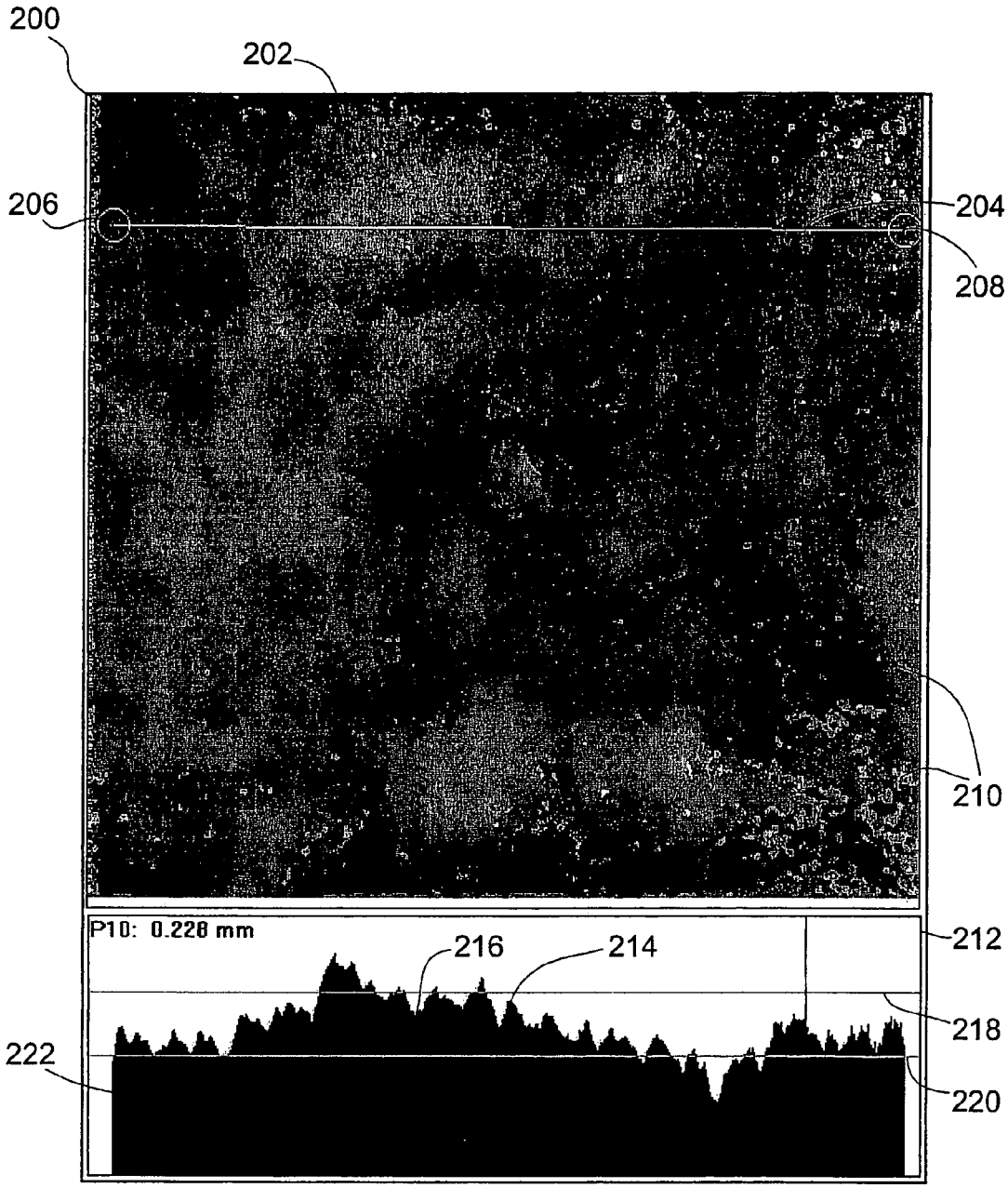

FIG. 13 is a screenshot 200 depicting a height map 202 for the first side of the commercial VIVA® paper towel. The P10 value along the profile line 204 is 0.228 mm. Individual peaks tend to have characteristic heights on the order of about 0.1 mm to about 0.2 mm.

Figure 14:
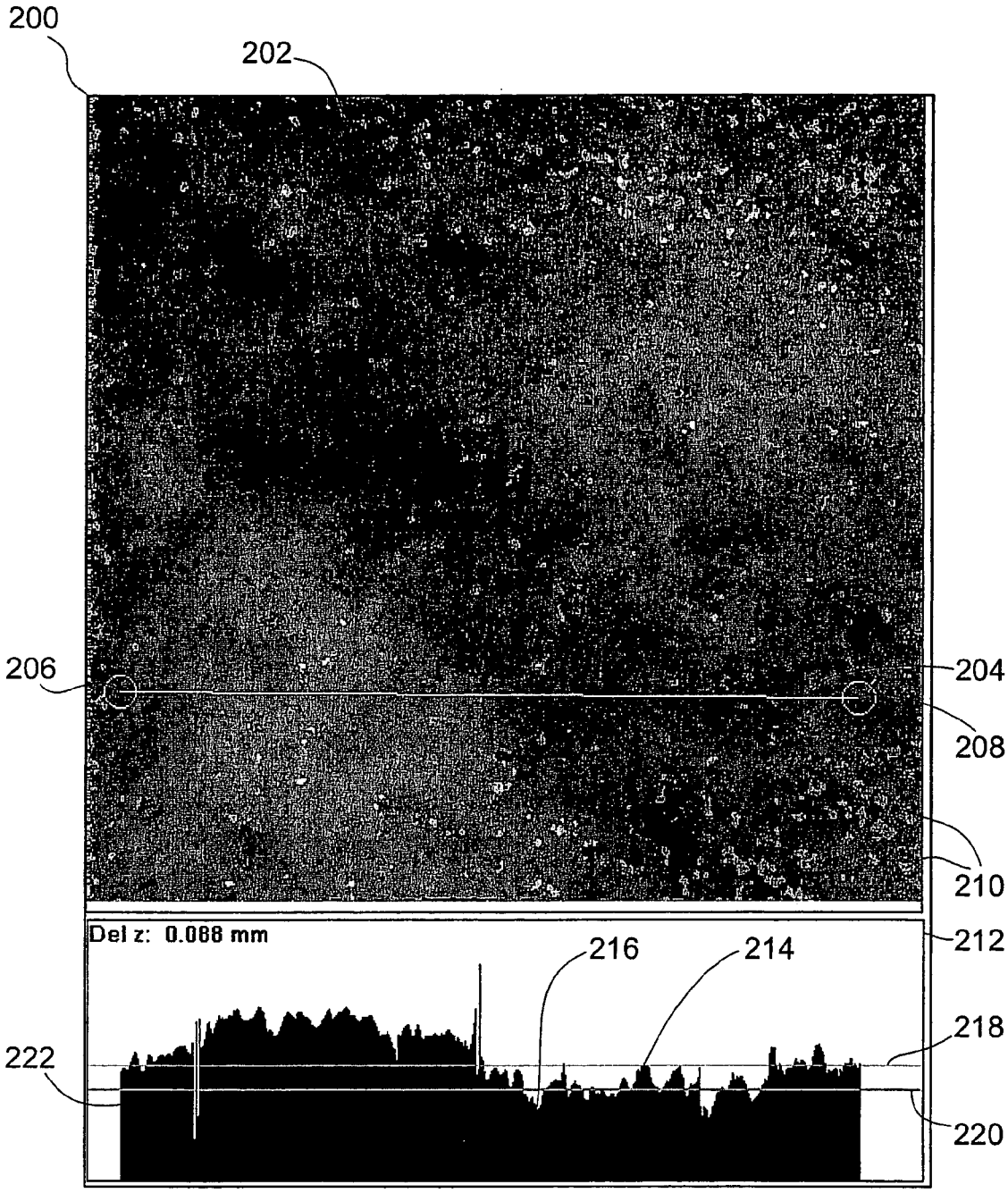

FIG. 14 shows the height map 202 for the second side of the VIVA® paper towel. The P10 value along the profile line 204 is 0.088 mm.

Figure 15:
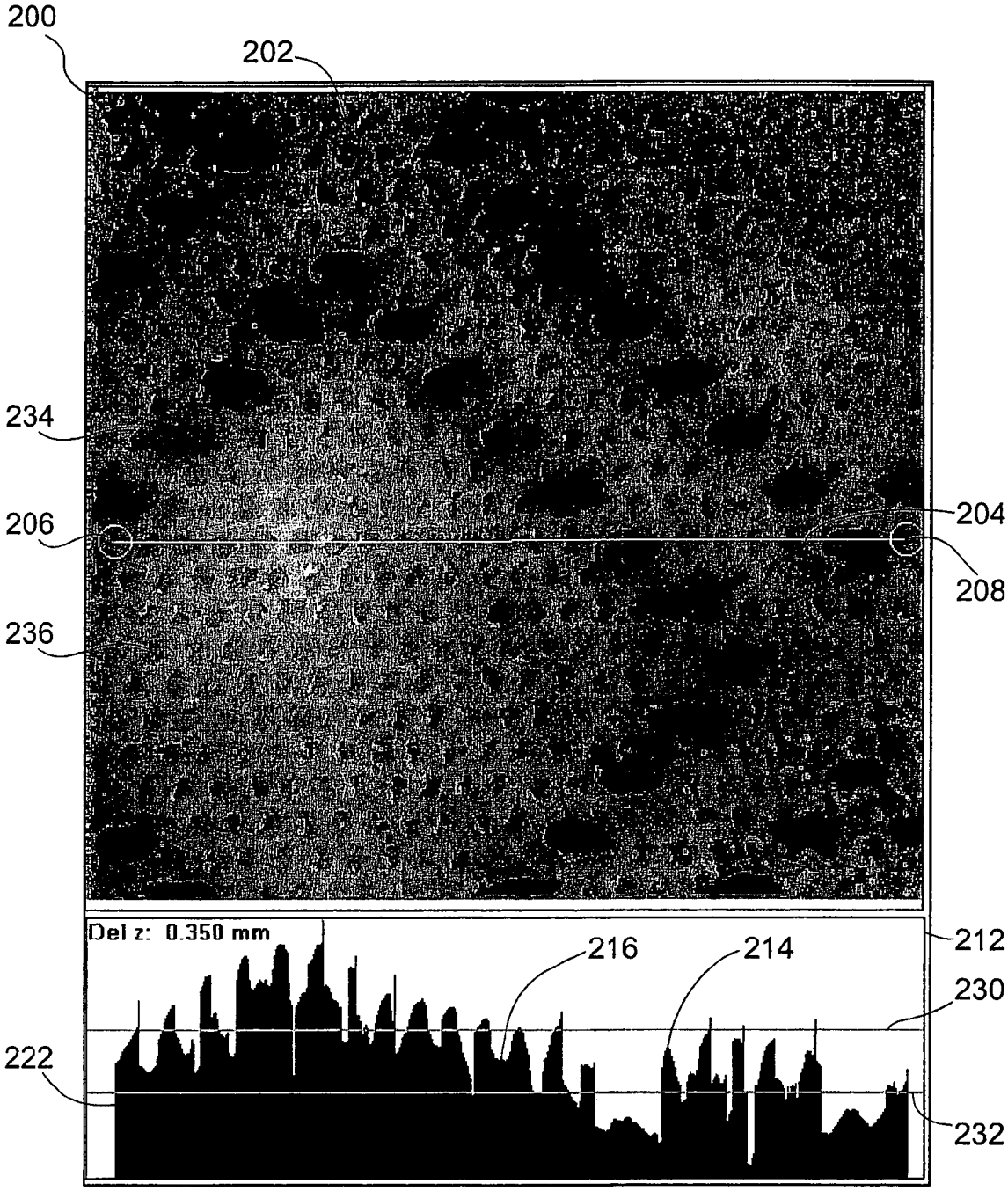

FIG. 15 shows the height map 202 for the first side of the BOUNTY® paper towel. Here the surface is sufficiently wavy that the P10 value along a profile line of more than about 10 mm would be excessively inflated. Instead of automatically generated material lines, the horizontal lines 230 and 232 were selected manually, and the vertical distance between them was then computed to be 0.35 mm by software based on the topographical data associated with the height map 202. The "del z" value of 0.35 mm is an estimate of the characteristic peak-to-valley height for the sample and is an estimate of the Surface Depth. The height map 202 shows that there is an array of relatively deep depressed regions 234 corresponding to embossed markings on the tissue surface. The smaller depressed regions 236 are believed to correspond to the underside of "domes" or "pillows" imposed in the web during the imprinting and throughdrying processes used in the manufacture of the BOUNTY® product, and are not believed to be embossments.

Figure 16:
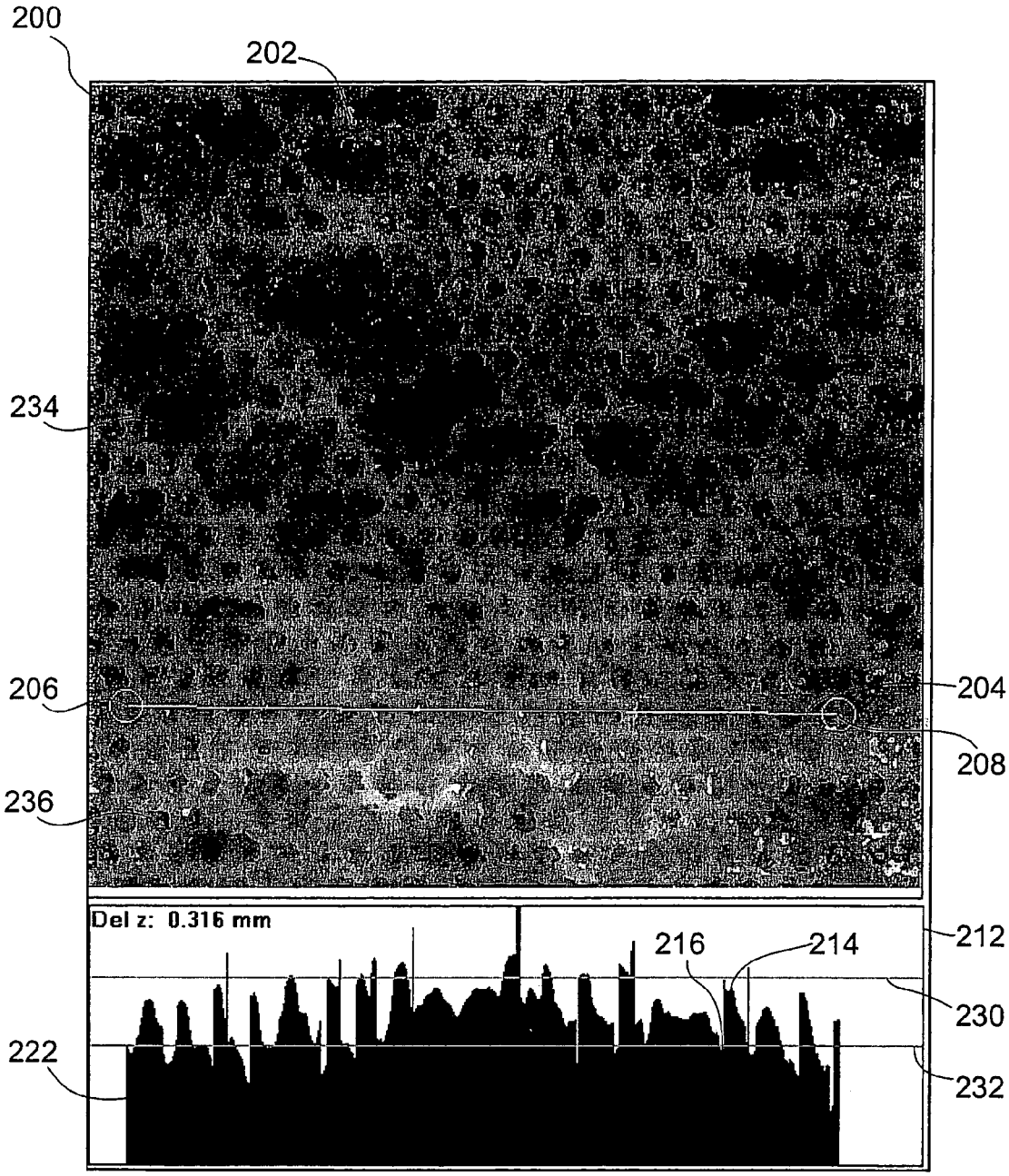

FIG. 16 shows the height map 202 for the second side of the BOUNTY® paper towel. The "del z" value of 0.316 mm is an estimate of the characteristic peak-to-valley height for the sample.

Following the topography measurements of the dry, conditioned samples as previously described, each of the four sheets from the four samples was wetted in one corner. Each sheet was placed on a flat black surface, and then one corner of the sample was saturated with deionized water at room temperature by spraying the sample until the wetted corner was completed saturated. The wetted area represented about 20% of the surface area of the sheet. After wetting, the sample was draped over the edge of a table in a TAPPI conditioned room, with the wetted corner hanging down and the opposing dry corner held in place with a weight, such that the lower half of the towel was suspended in a vertical orientation to allow the wetted corner pointing directly downward to permit drip drying. The wetted sample was allowed to dry for several hours, and then the topography of the now dry but once-wetted region was examined again. Generally, it was observed that the basic topography of the commercial samples, as observed with the 38-mm field of view, did not change dramatically by wetting and drying, though some increased mottle or waviness was evident. However, the topography of the samples made according to the present invention showed increased texture corresponding to the topography of the TAD fabric.

Figure 17:
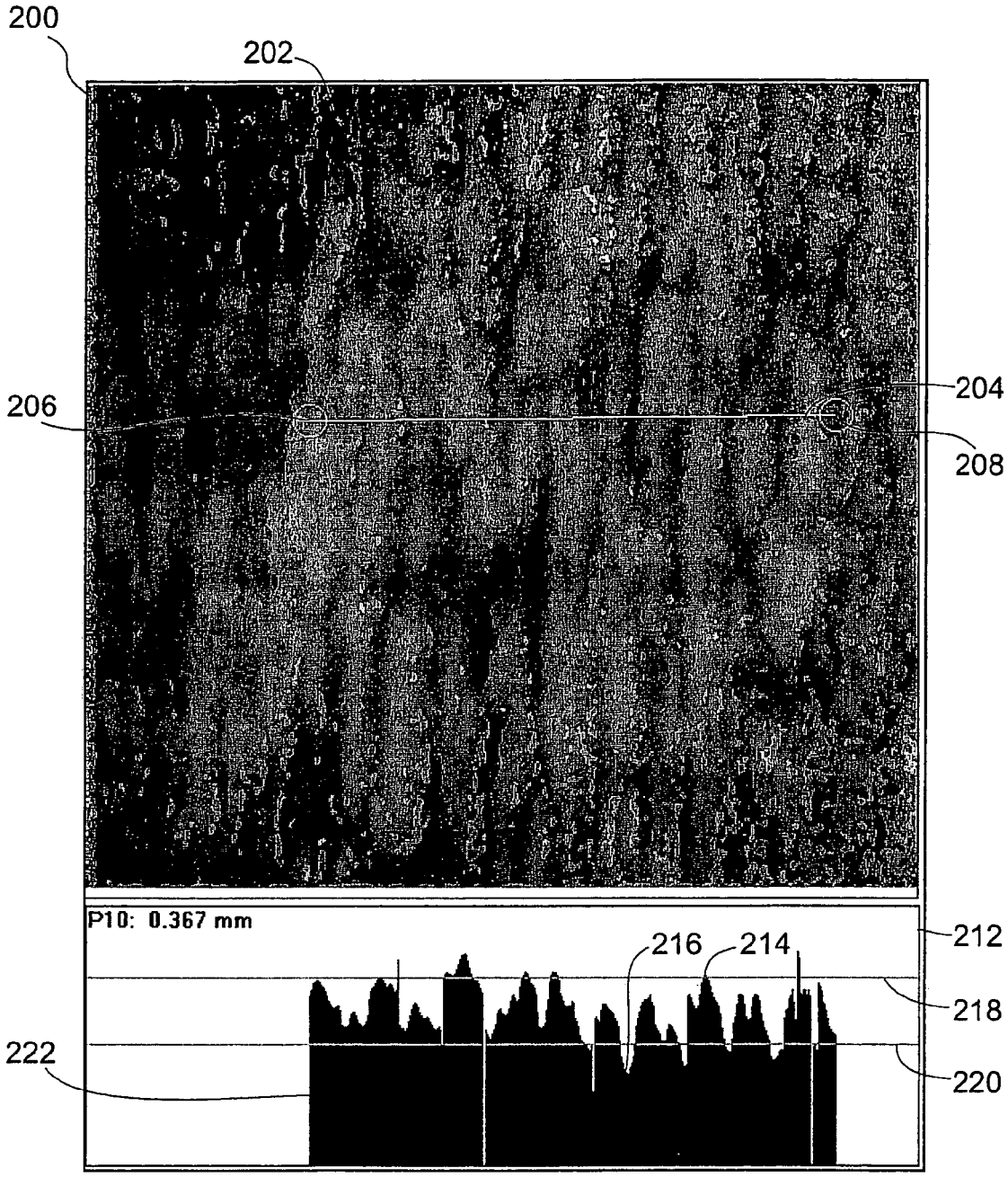
Figure 18:
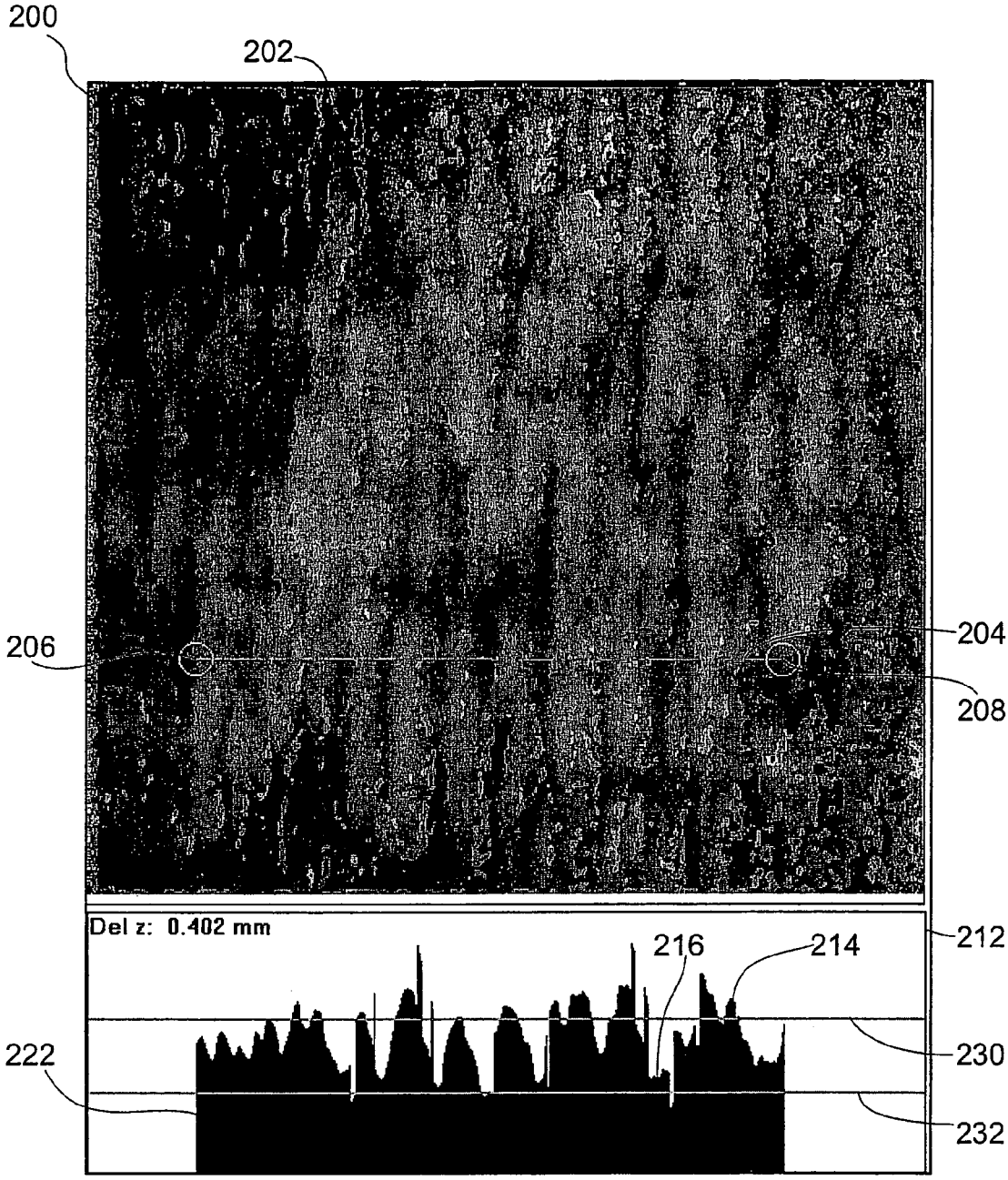

FIG. 17 shows the height map 202 for the once-wetted first side of Sample No. 2 of the present invention, showing a P10 value of 0.367 mm. FIG. 18 shows the same height map 202 with a different profile line 204 selected. A "del z" value of 0.402 mm is shown for the height between two manually select height lines 230, 232. In general, the characteristic peak height of the structures on the first side of Sample No. 2 have increased relative to the measurements made before wetting, as shown in FIGS. 8 and 9.

Figure 19:
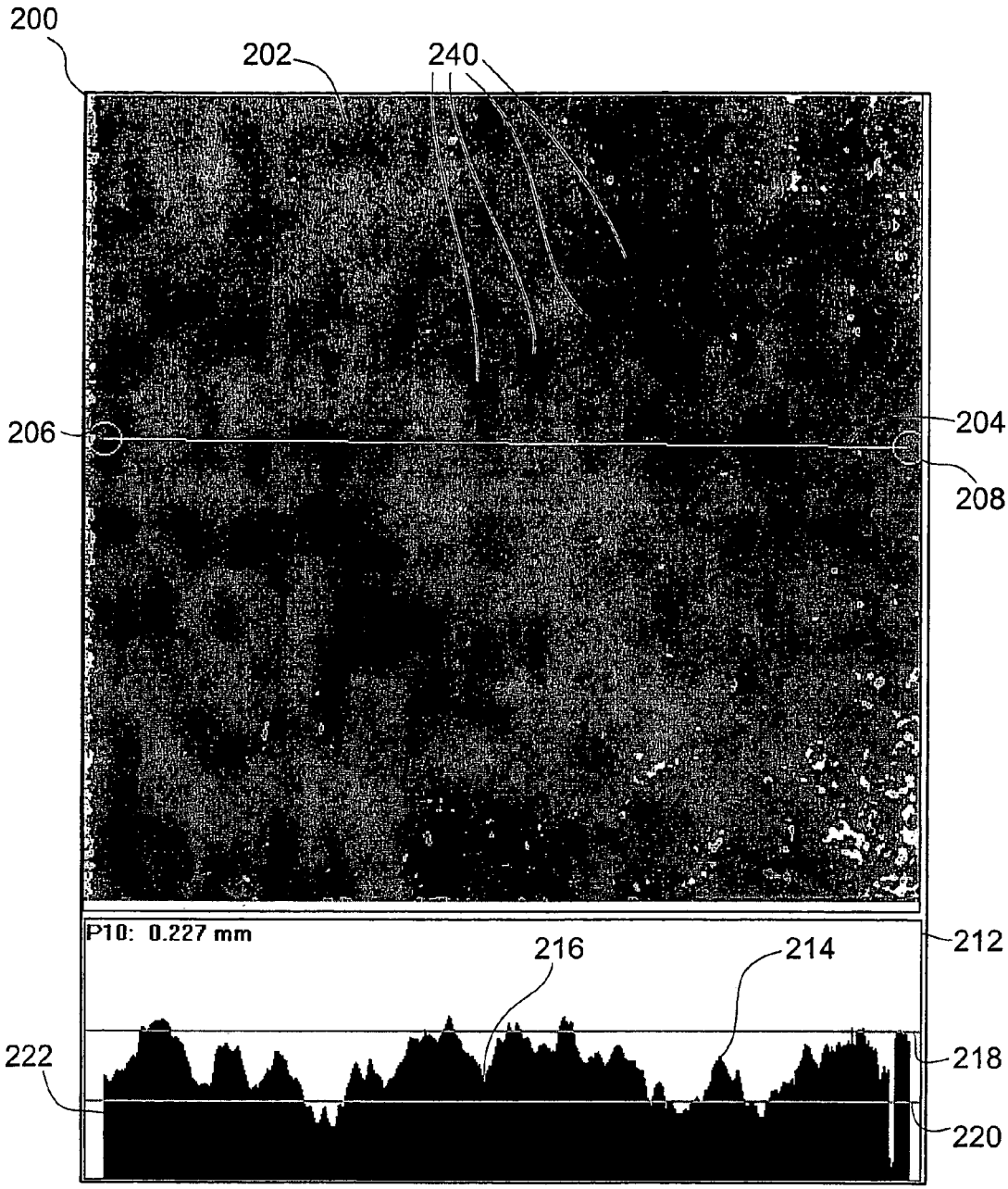

FIG. 19 shows the height map 202 for the once-wetted second side of Sample No. 2, with a P10 value of 0.227 mm for the profile line 204, which is over twice the P10 value shown in FIG. 10 prior to wetting. A pattern of spaced apart depressions 240 is seen in the height map 202 that is believed to correspond to the texture of the through-drying fabric that created the base sheet prior to recreping. The depressions 240 have a characteristic depth of about 0.2 mm relative the immediately surrounding surface.

Figure 20:
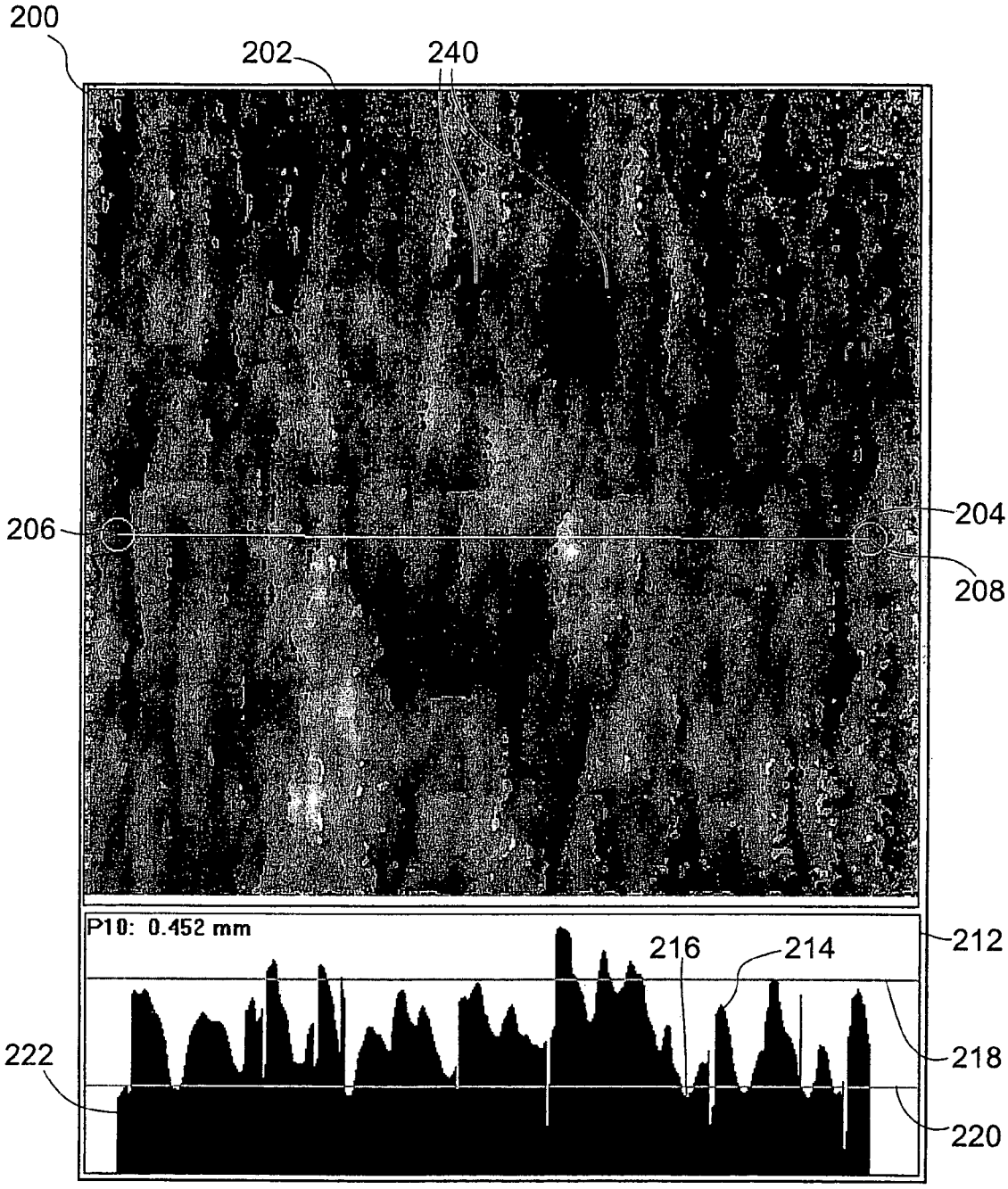

FIG. 20 shows the height map 202 for the once-wetted first side of Sample No. 1 of the present invention, showing a P10 value of 0.452 mm and showing a pattern of spaced apart depressions 240 that is believed to correspond to the texture of the through-drying fabric that created the base sheet prior to recreping.

Figure 21:
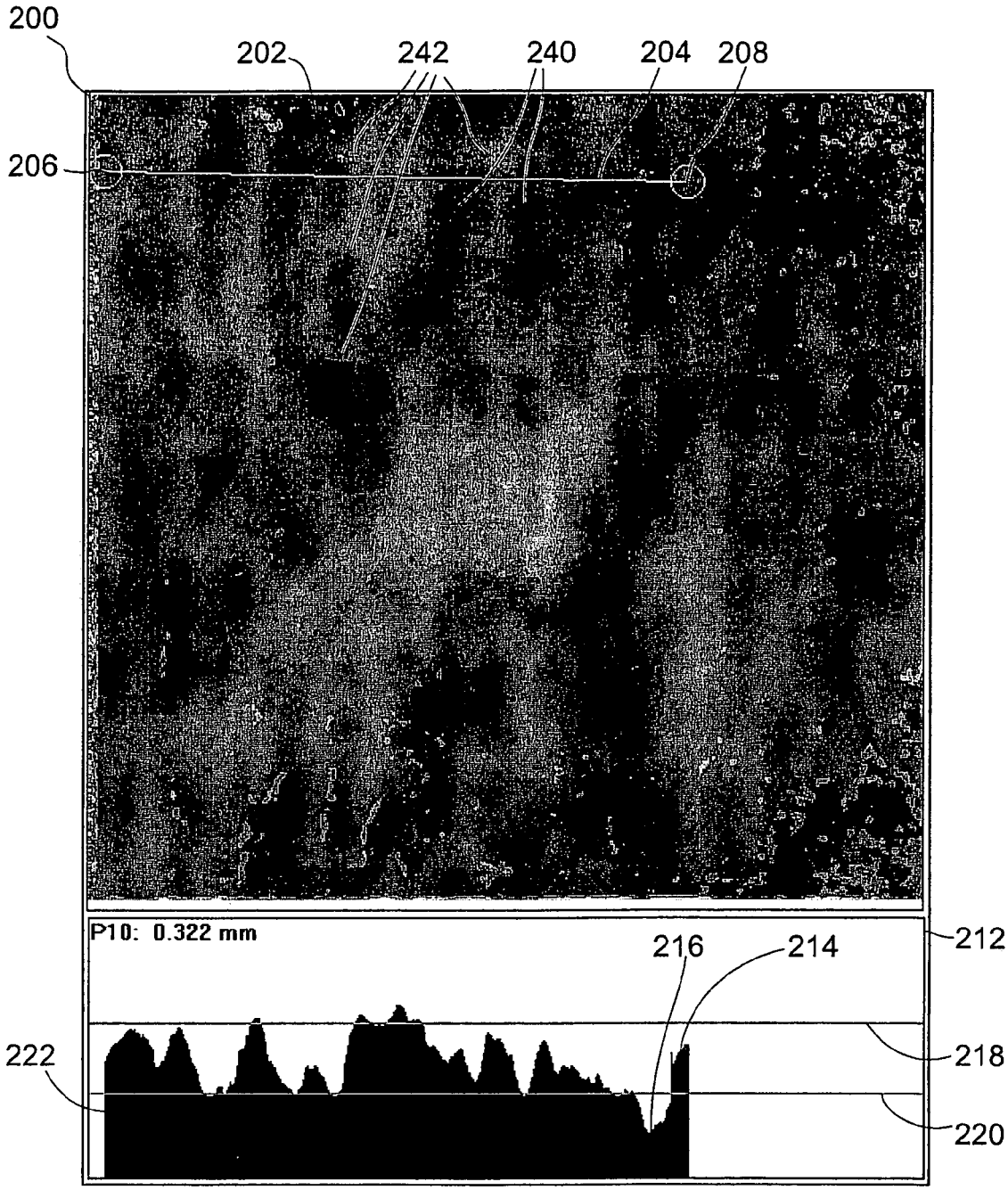

FIG. 21 shows the height map 202 for the once-wetted second side of Sample No. 1, showing a P10 value of 0.322 mm. There is a pattern of spaced apart depressions 240 and a pattern of spaced apart elevations 242 that are believed to correspond to the texture of the through-drying fabric that created the base sheet prior to recreping.

In general, the webs of the present invention have a two-sided topography with a relatively textured first side, a relatively smooth second side, and a tendency for the second side to exhibit increased texture after wetting and drying, having a spaced apart pattern of elevated and depressed regions corresponding to the pattern of a throughdrying fabric.

Figure 22:
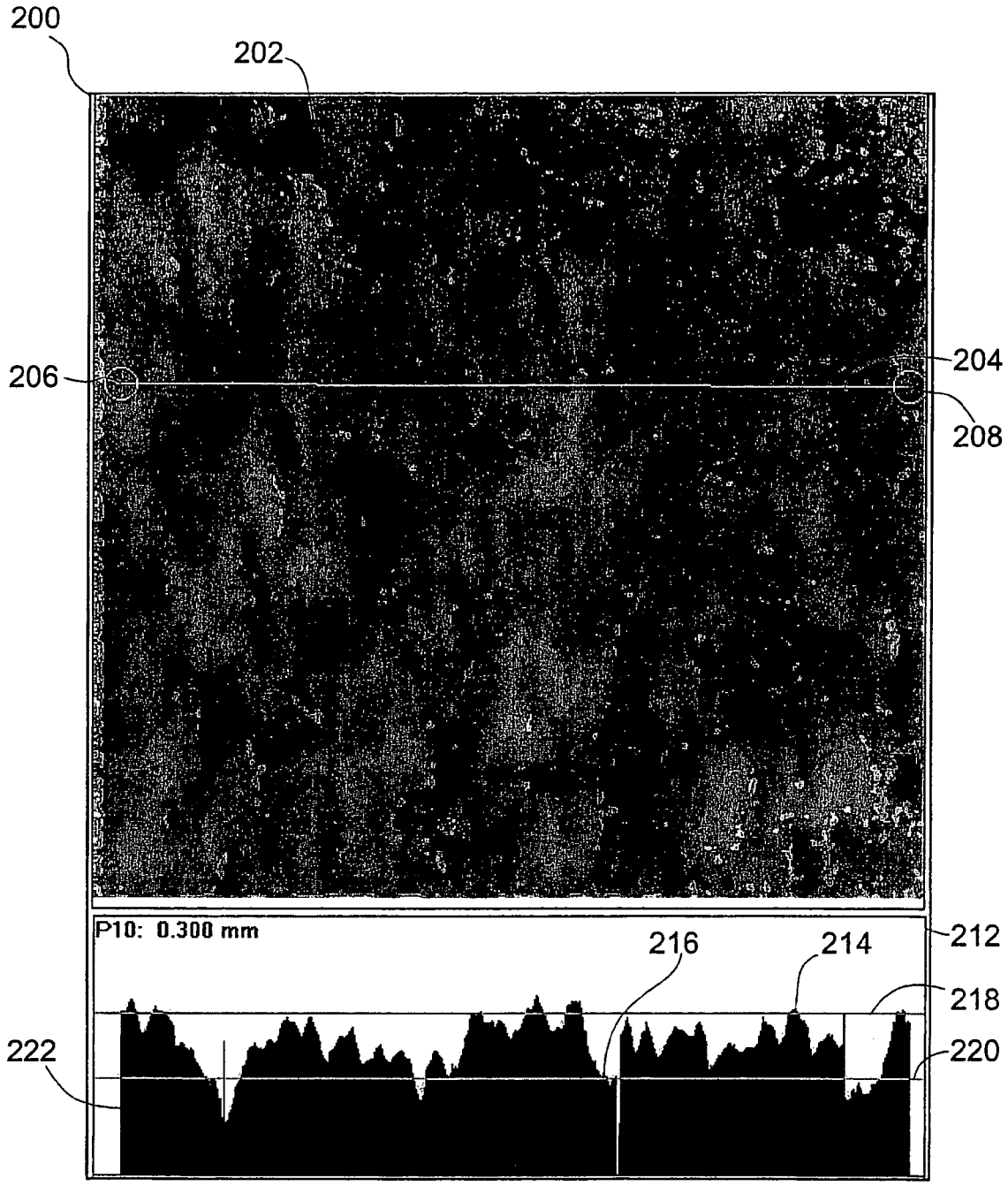

FIG. 22 is a screenshot 200 depicting a height map 202 for the first side of the commercial VIVA® paper towel after wetting and drying. The P10 value along the profile line 204 is 0.300 mm, which is greater than was observed prior to drying (see FIG. 13).

Figure 23:
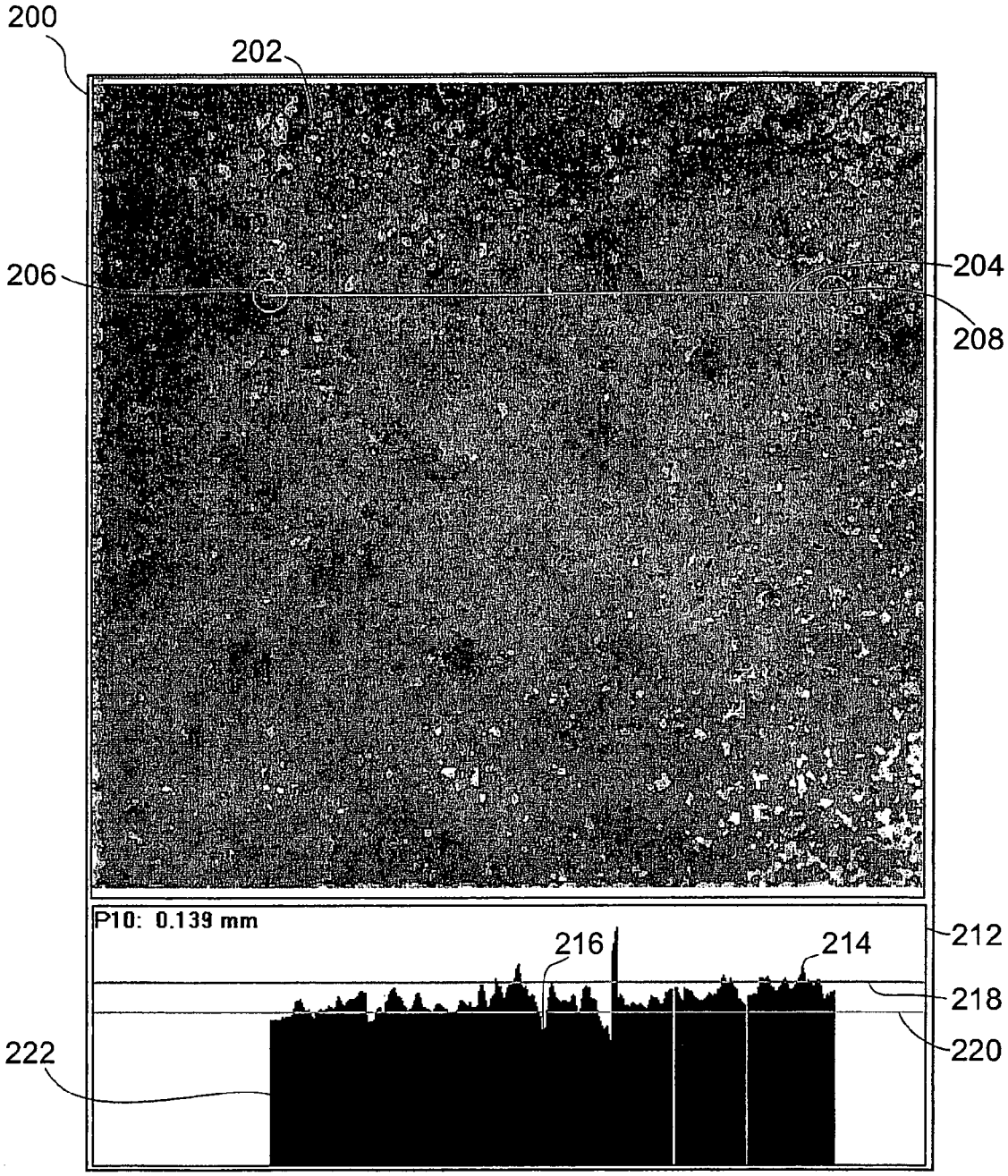

FIG. 23 shows the height map 202 for the second side of the VIVA® paper towel after wetting and drying. The P10 value along the profile line 204 is 0.139 mm, which is greater than was observed prior to drying (see FIG. 14).

Figure 24:
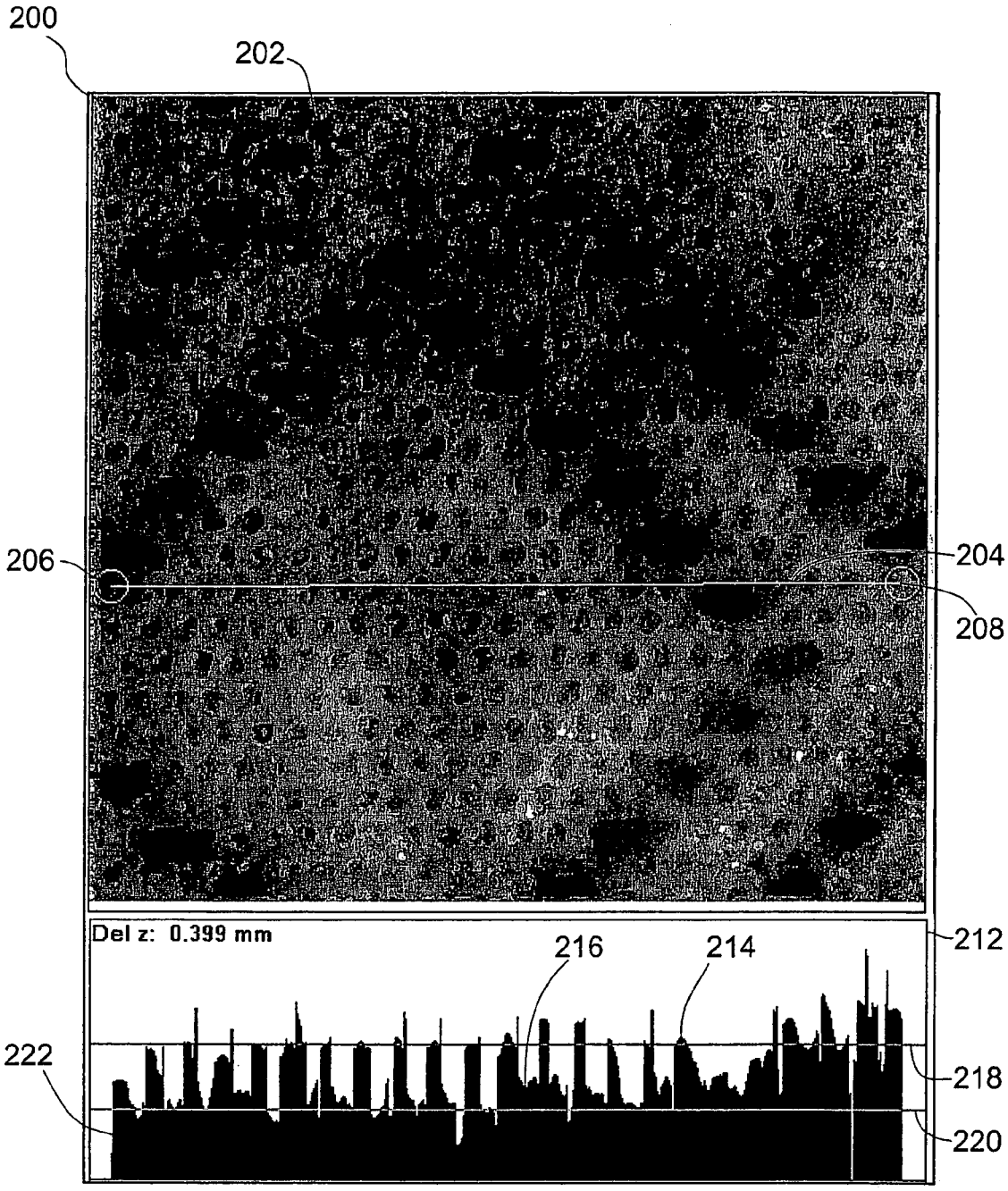

FIG. 24 is a screenshot 200 depicting a height map 202 for the first side of the commercial BOUNTY® paper towel after wetting and drying. The "del z" value along the profile line 204 is 0.399 mm, which is about 14% greater than was observed prior to drying (see FIG. 15).

Figure 25:
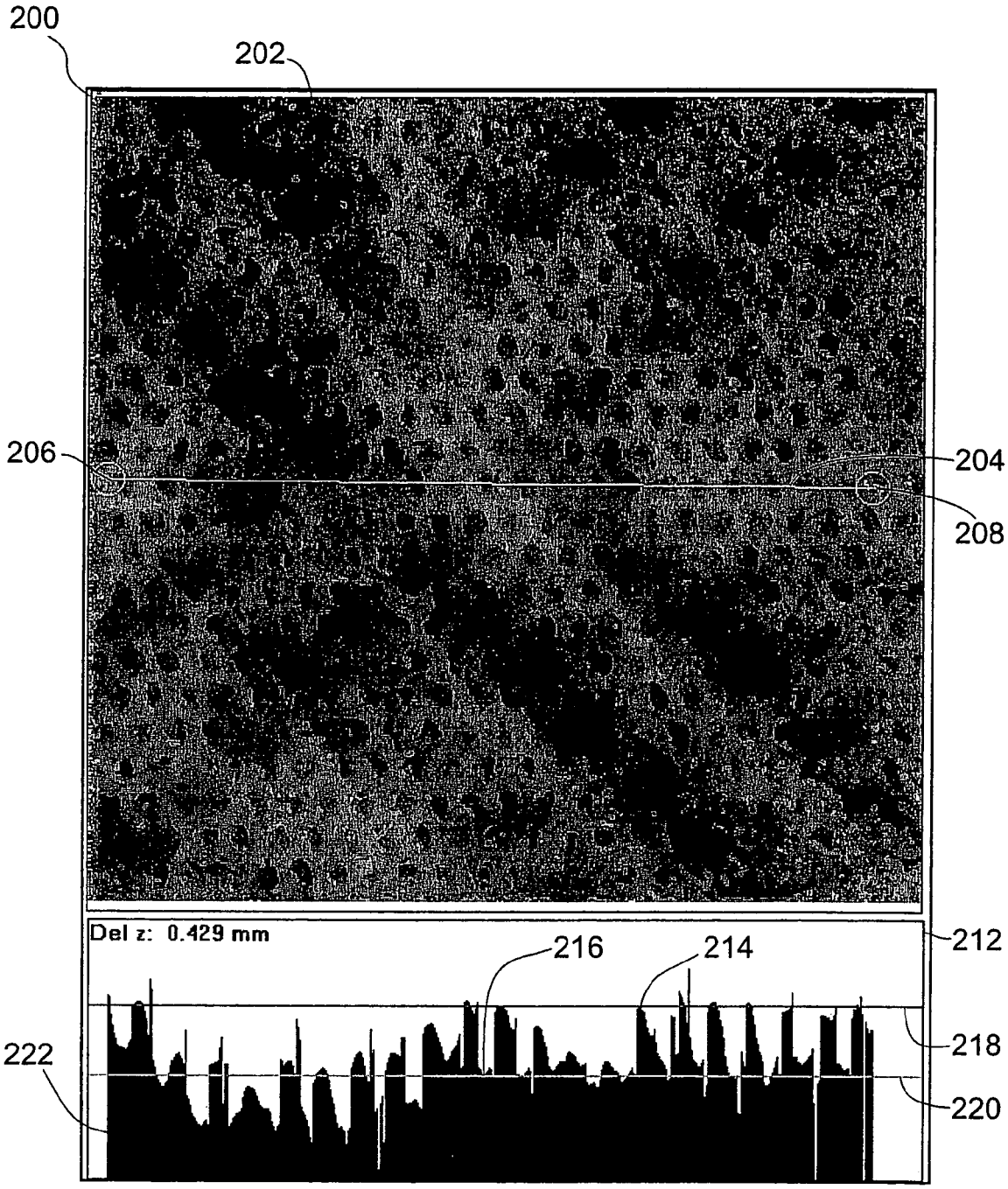

FIG. 25 shows the height map 202 for the second side of the BOUNTYS paper towel after wetting and drying. The "del z" value along the profile line 204 is 0.429 mm.

Figure 27:
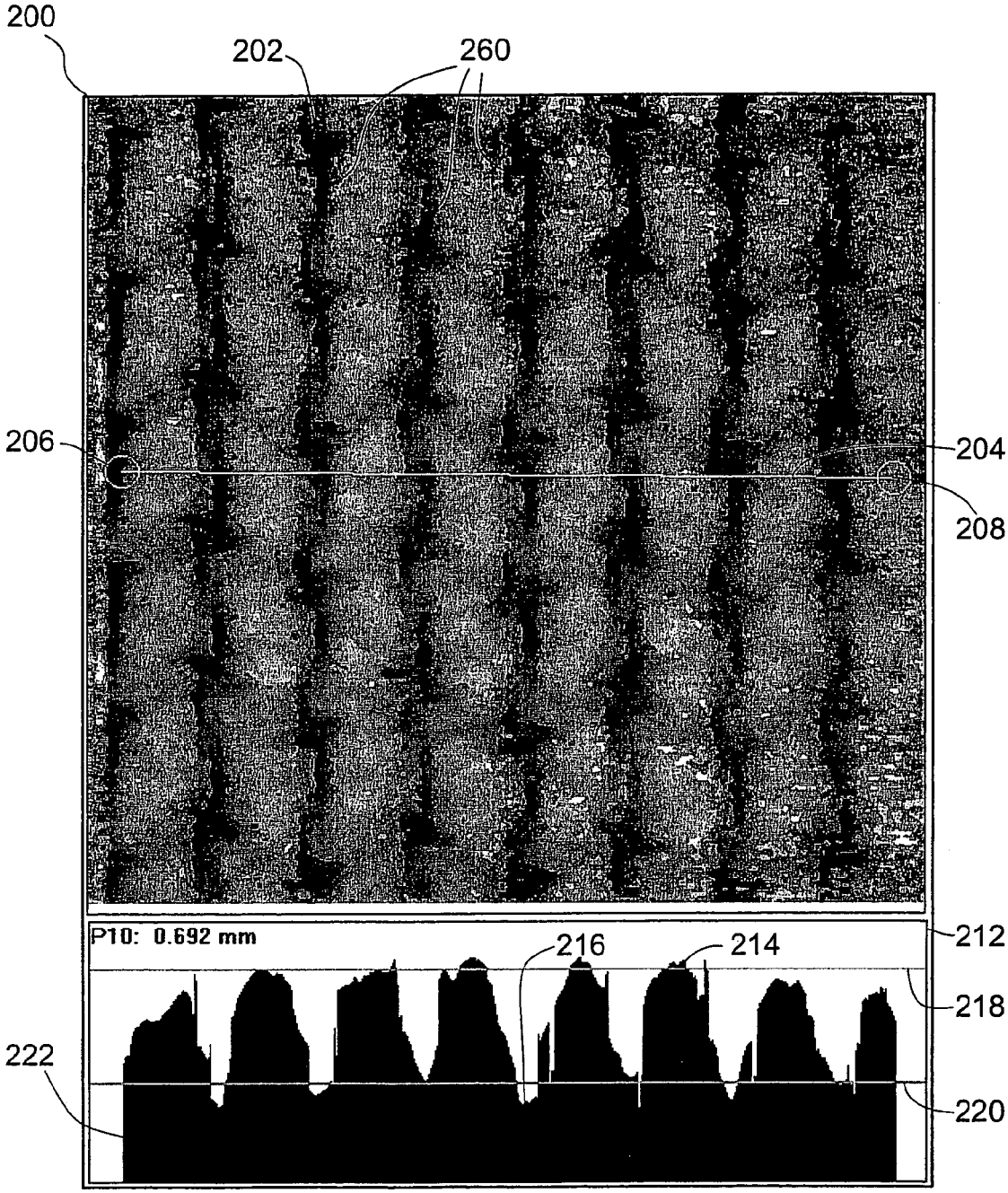

FIG. 27 shows a height map 202 of the first side of an uncreped through-dried tissue basesheet made substantially as Sample No. 1, but without printing and creping. In this case, the horizontal direction on the height map 202 corresponds with the cross-direction of the web, so that the orientation of the web in the height map is rotated by 90 degrees relative to the height maps in previous figures. The height map 202 shows the texture created by molding on the Voith Fabrics T1203-8 through-drying fabric, which is a highly three-dimensional sculpted fabric believed to be made according to the teachings of U.S. Pat. No. 5,429,686, issued to Chiu, et al. on Jul. 4, 1995, herein incorporated by reference. For the cross-direction profile line 204 shown, the P10 value is 0.692, and individual peaks have a height of about 0.7 mm or greater.

The depressed regions 260 are believed to correspond to the depressed regions 240 noted on FIG. 20, which became clearly defined after the web had been wetted and dried, bringing out some of the original three-dimensional structure of the basesheet.

Figure 28:
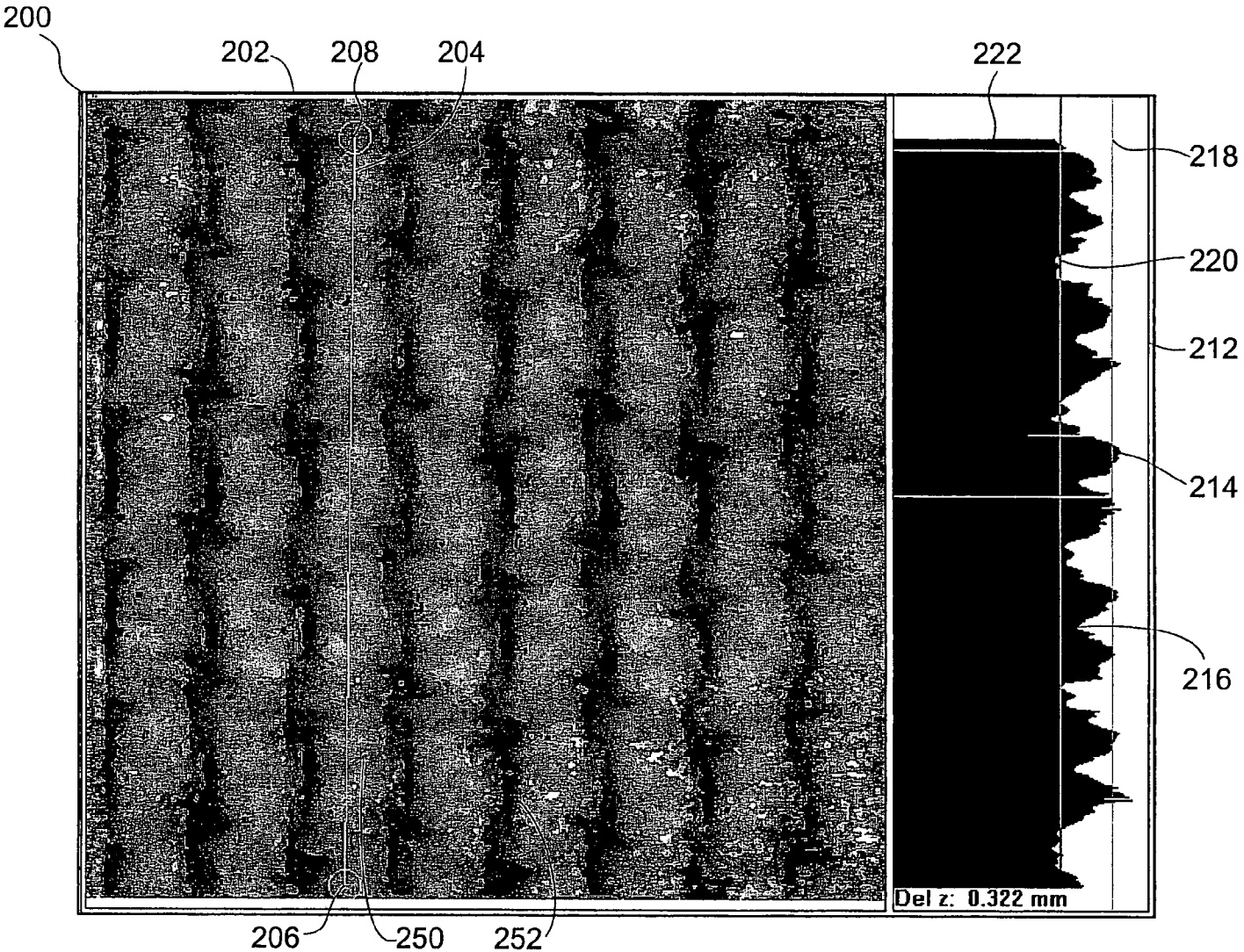

FIG. 28 shows the same height map 202 as in FIG. 27 but with a machine-direction profile line 204 drawn along an elevated region 250 having a P10 value of 0.322 mm.

Figure 29:
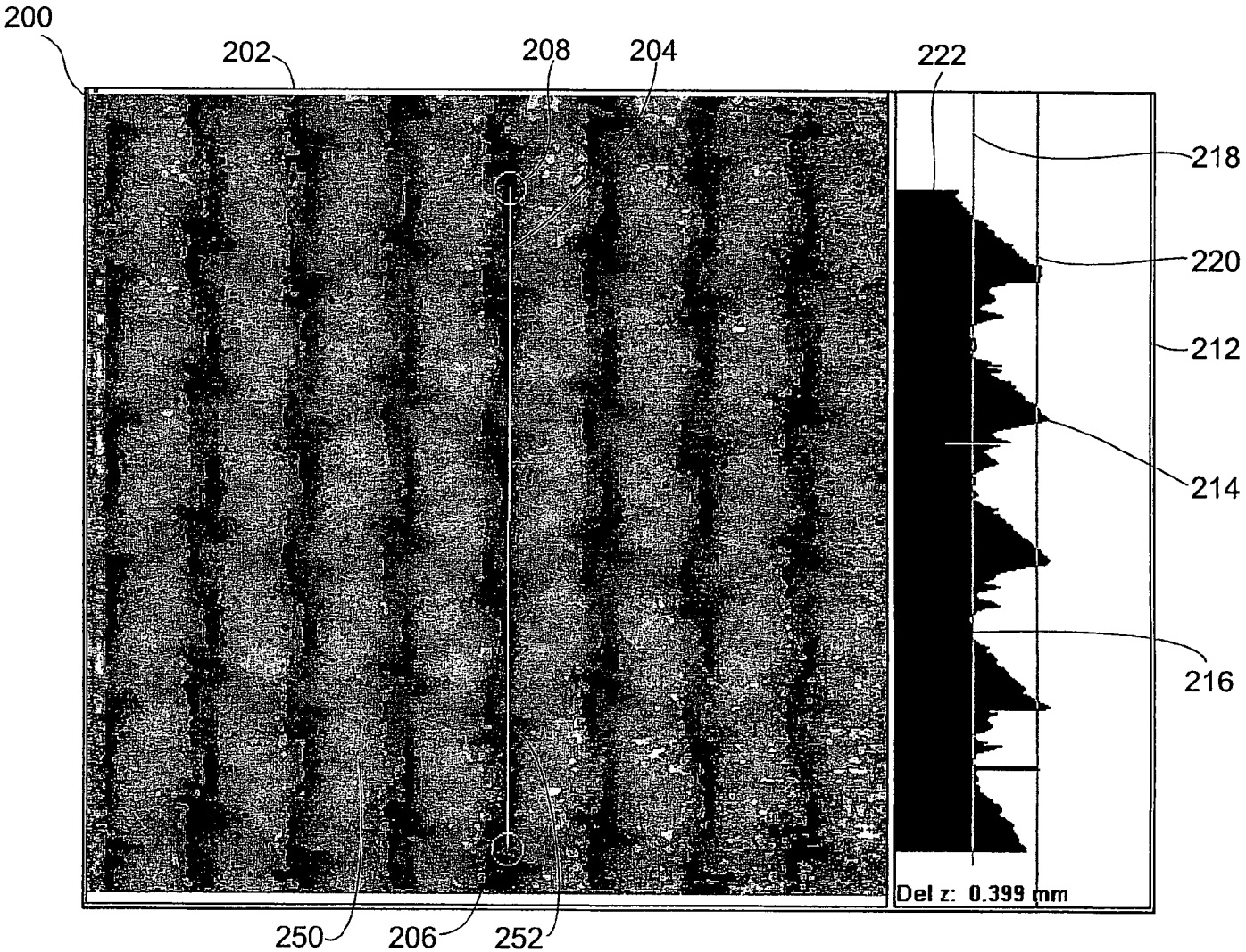

FIG. 29 shows the same height map 202 as in FIG. 28 but with a machine direction profile line drawn in a depressed region 252 between the elevated regions 250. A P10 value of about 0.4 mm is shown.

Figure 30:
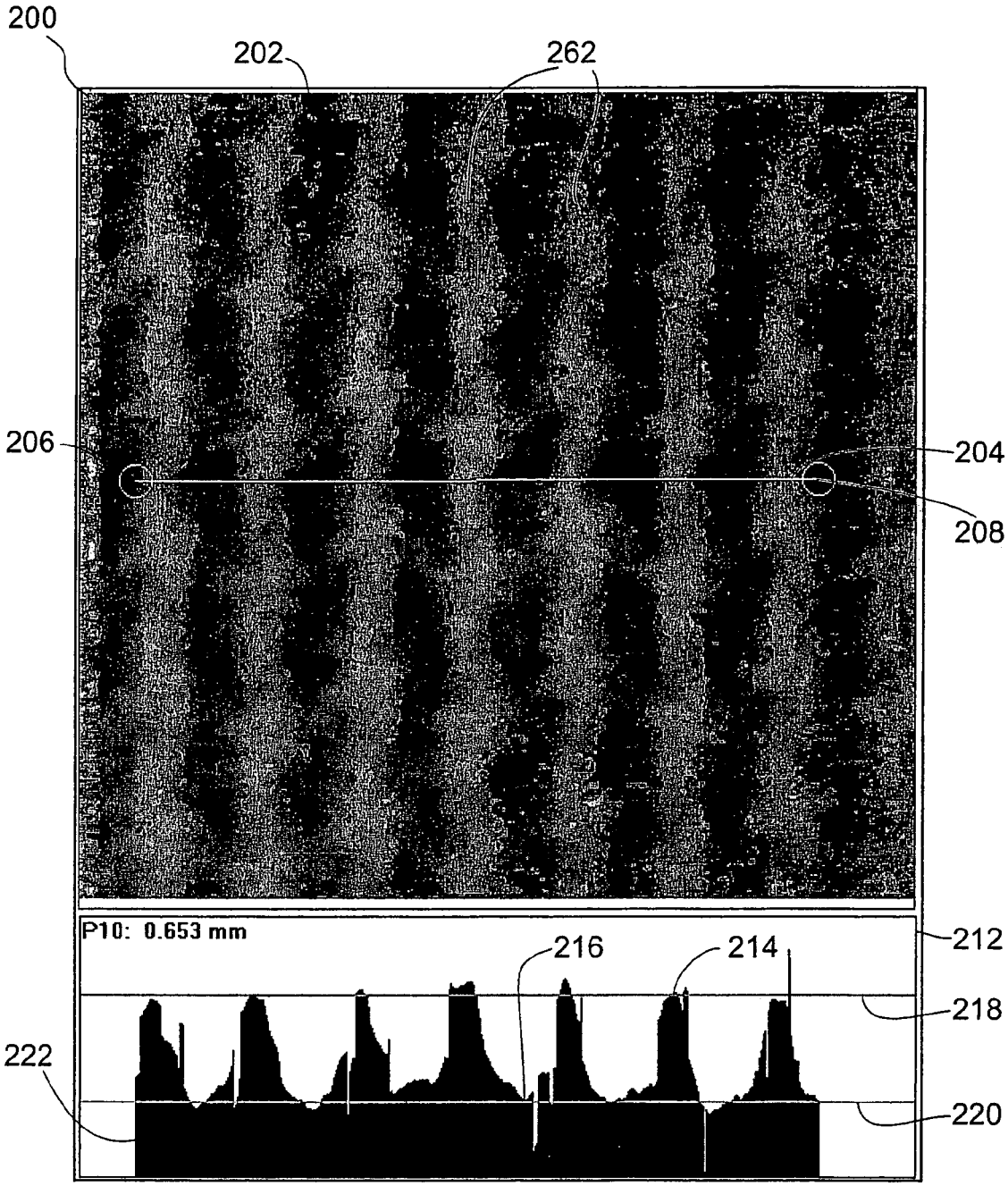

FIG. 30 shows the height map 202 for the second side of the uncreped through-dried tissue basesheet of FIG. 27. A cross-direction profile line 204 is drawn showing a profile 222 having a P10 value of 0.653 mm. The narrow elevated regions 262 are believed to correspond with the narrow elevated regions 242 of FIG. 21.

Figure 31:
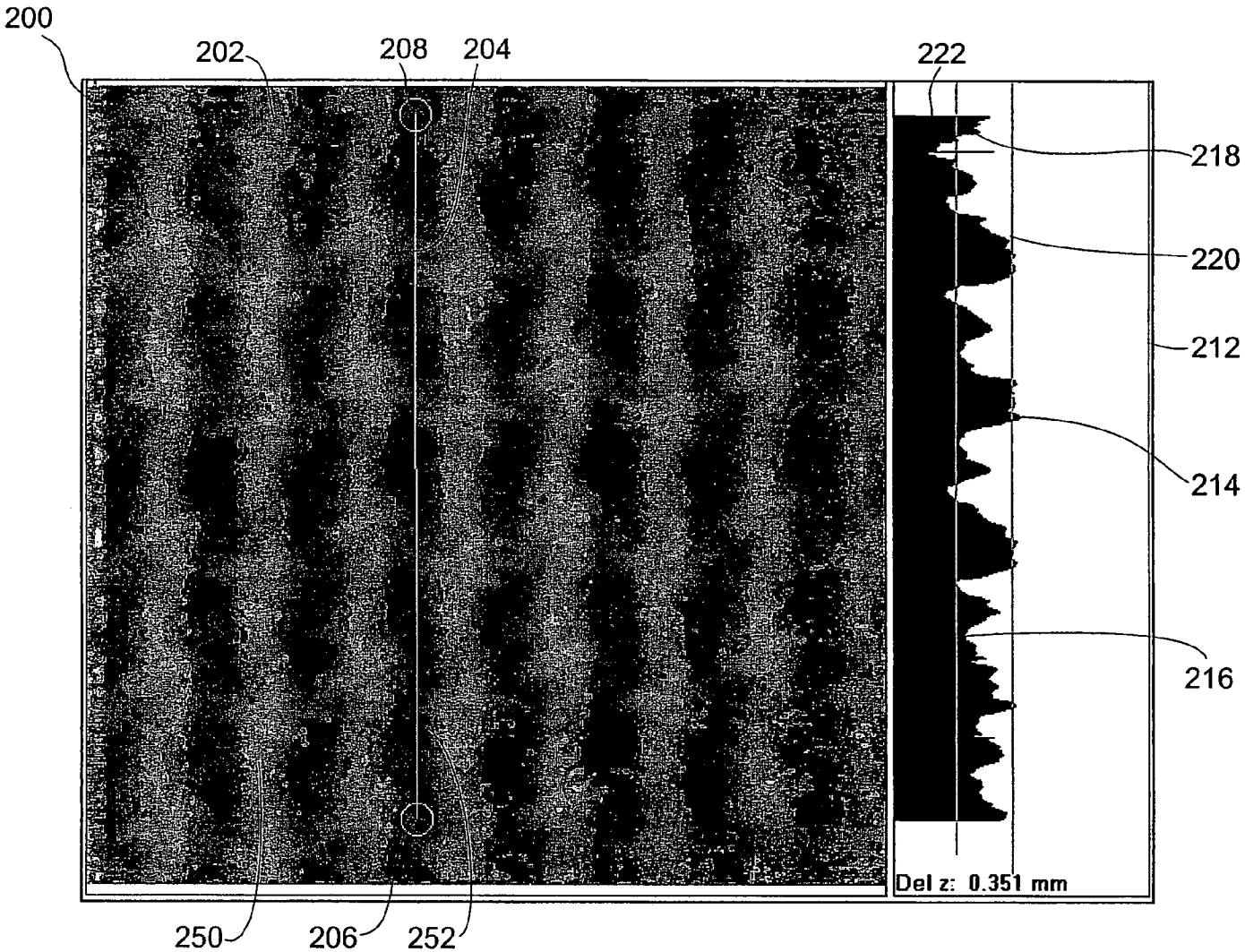

FIG. 31 shows the same height map 202 as in FIG. 30 but with a machine direction profile line 204 drawn along a relatively depressed region 252 with a P10 value of about 0.35 mm along the elevated structures and about 0.35 mm along the depressed regions.

Further assessment of surface topography was conducted using stylus profilometry with a Taylor-Hobson S5 surface profilometer (Taylor-Hobson Ltd., Leicester, England) equipped with a 2-micron radius diamond stylus and laser interferometric pickup. Surface topography data was collected over a 15 mm×15 mm area of the VIVA® towel surface and also the surface of the web of Sample 1. The maximum of 256 traces were collected with spacing between each trace of 58 micrometers. Data were analyzed using TalyMap 2.02 software.

Table 3 below summarizes the surface roughness amplitude measurements assessed over the 15 mm×15 mm area per side. In Table 3, all results are reported in micrometers. The parameter "Sa" is the average surface roughness, the three-dimensional analog of the arithmetic mean roughness Ra known from stylus profilometry; "Sq" is the rms mean roughness; "Sv" is the depth of the deepest valley in the assessed area; "St" is the total height spanned by the measured volume (the Z-envelope); and "Sz" is the 10-point roughness parameter.

TABLE 3

Surface Roughness Measurements

| Surface | Sa | Sq | Sv | St | Sz |
|---|---|---|---|---|---|
| VIVA ® side A | 91 | 110 | 330 | 653 | 611 |
| VIVA ® side B | 51 | 64 | 301 | 535 | 491 |
| Sample 1 textured side | 101 | 122 | 370 | 773 | 707 |
| Sample 1 smooth side | 46 | 59 | 289 | 588 | 499 |

The average roughness amplitude parameters for the textured side of Sample 1 are about 10% higher than for VIVA® side A, the side with the most texture. However the geometric form of the two surfaces is clearly different, with Sample No.

1 having an approximately sinusoidal, anisotropic structure whereas VIVA® side A had a more isotropic, broadly undulating form.

Figure 32:
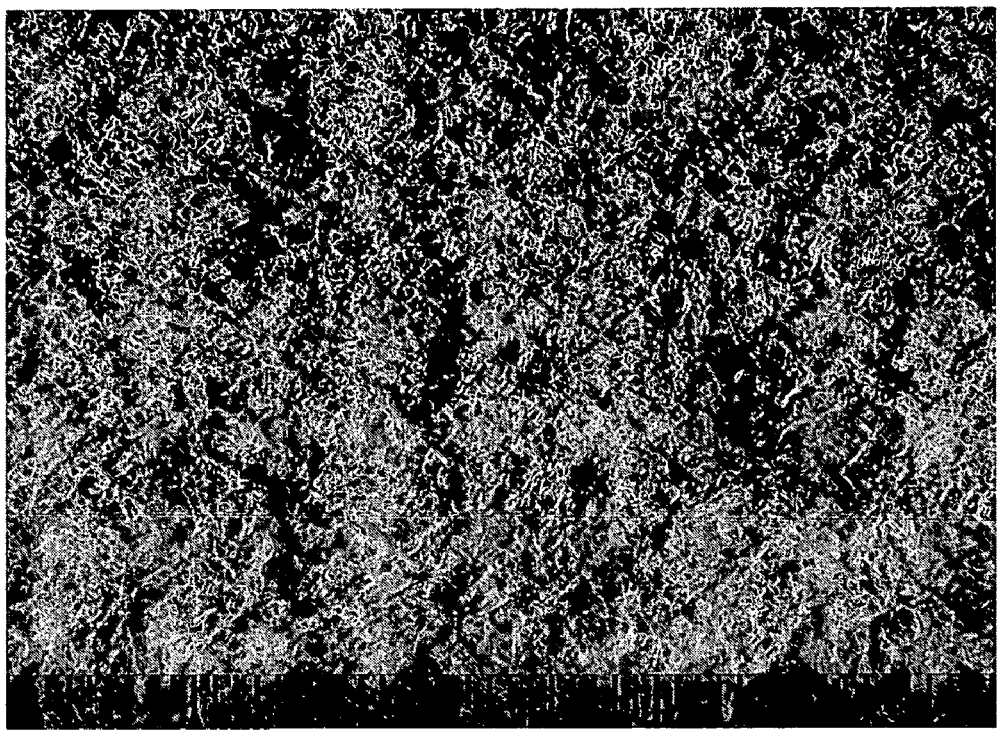
Figure 33:
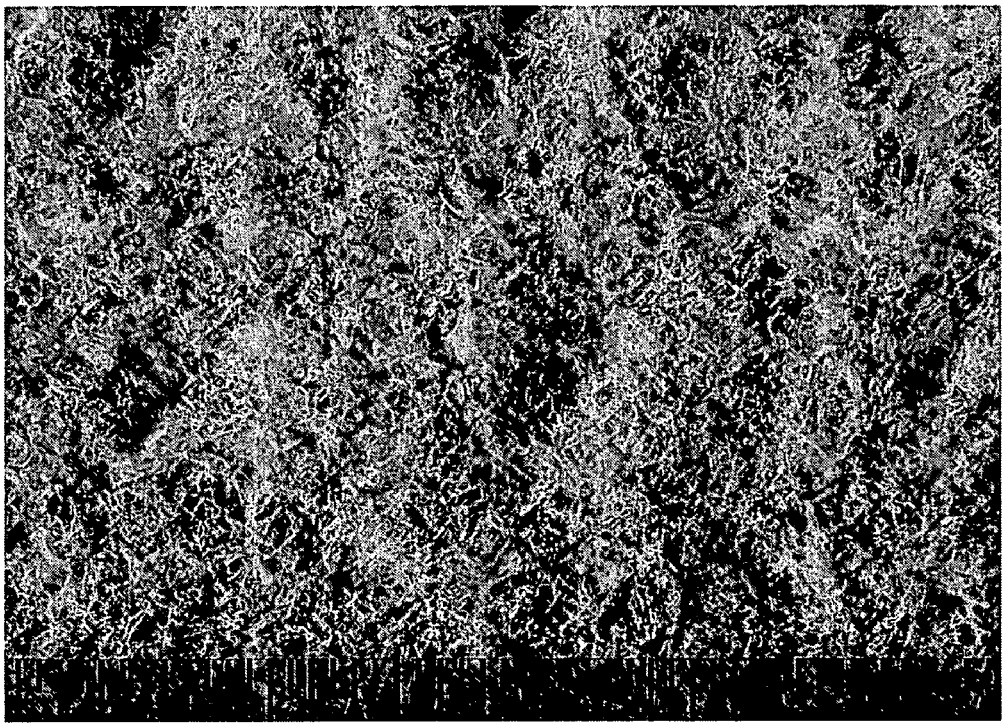

FIGS. 32 and 33 show optical photomicrographs of both sides of a VIVA® towel taken using grazing incident illumination. Surface photos were taken using a Wild M420 Photoscope (Leica Optics, Wetzlar, Germany) and incident lighting directed at approximately 30 degrees incidence. A scale with 0,5 mm divisions is included.

Figure 34:
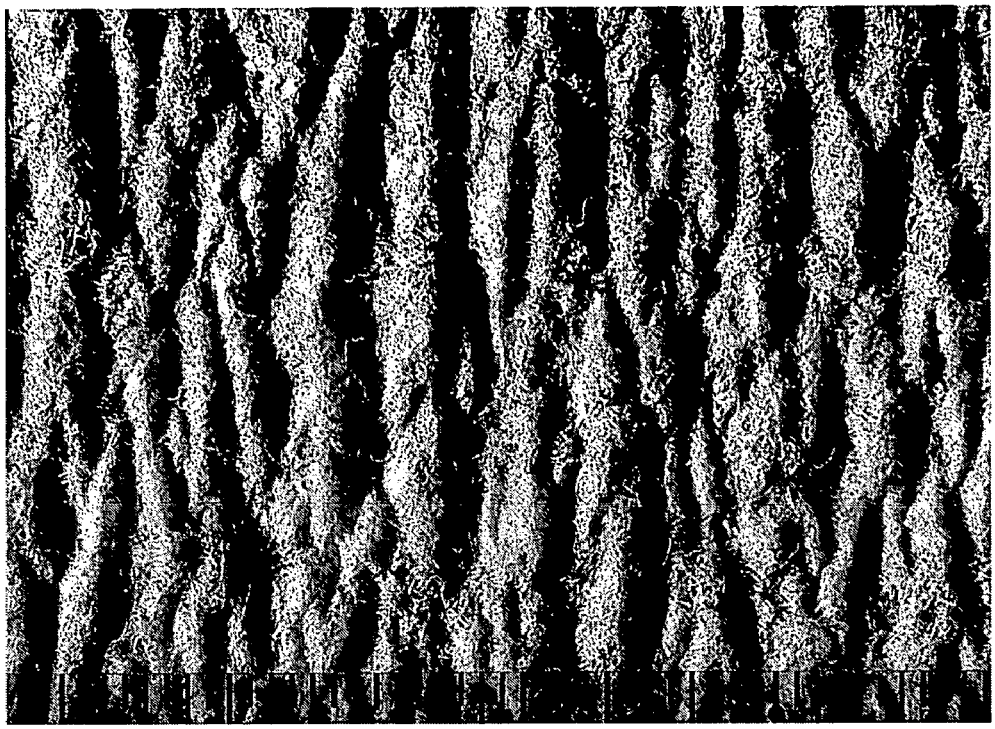
Figure 35:
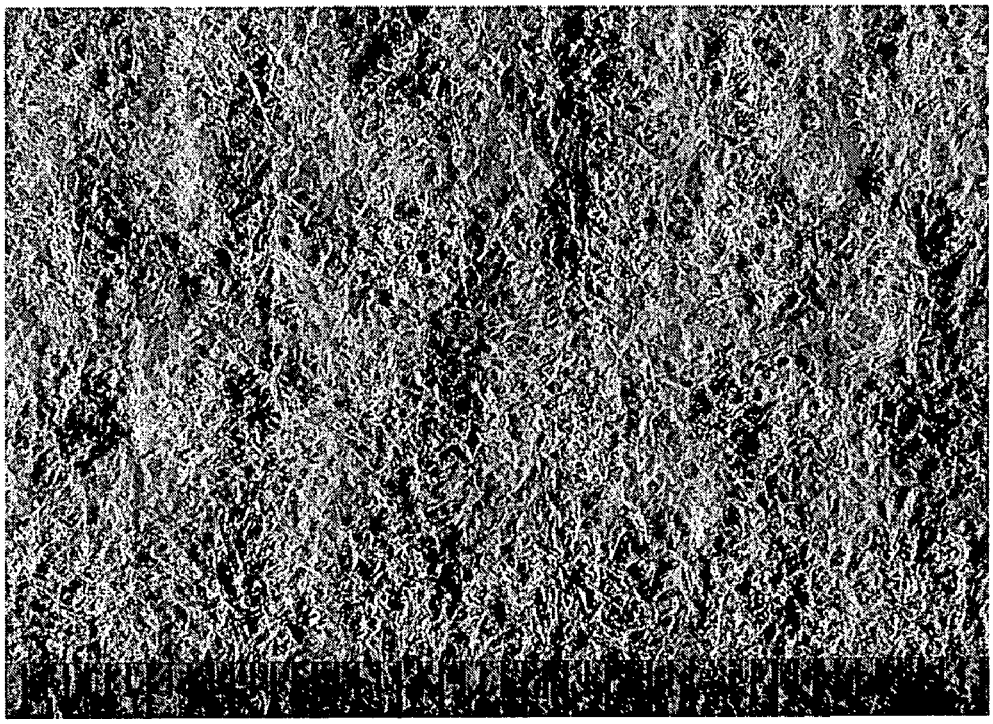

FIGS. 34 and 35 shows optical photomicrographs of both sides of Sample No. 1 according to the present invention.

Figure 36:
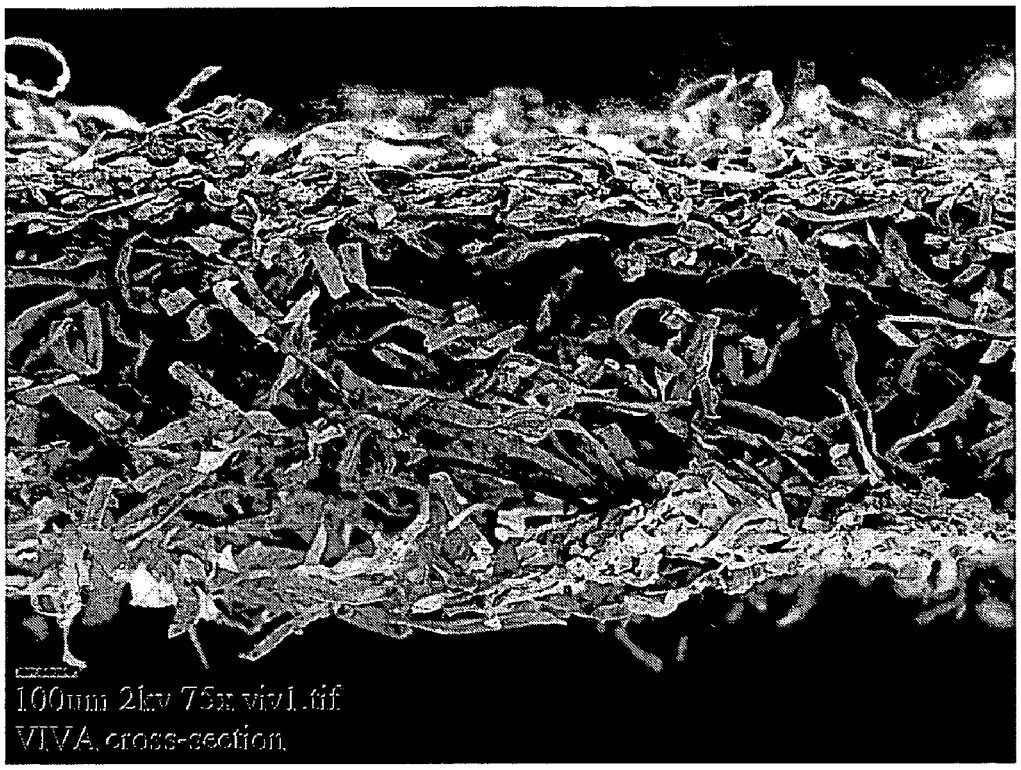
Figure 37:
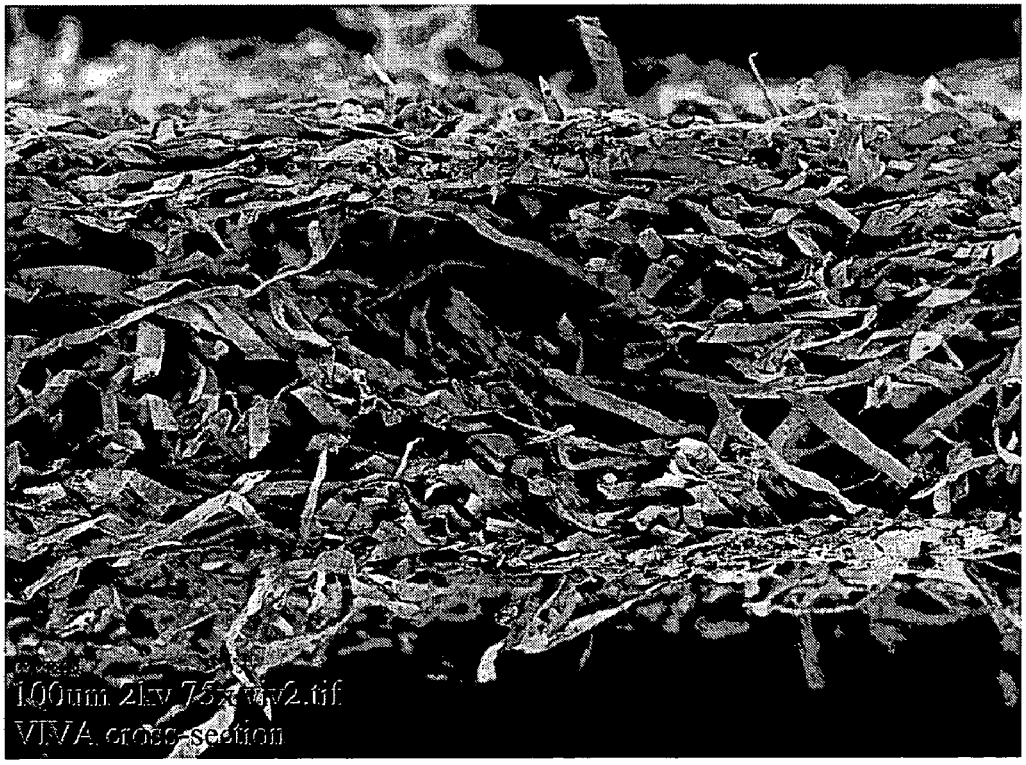
Figure 38:
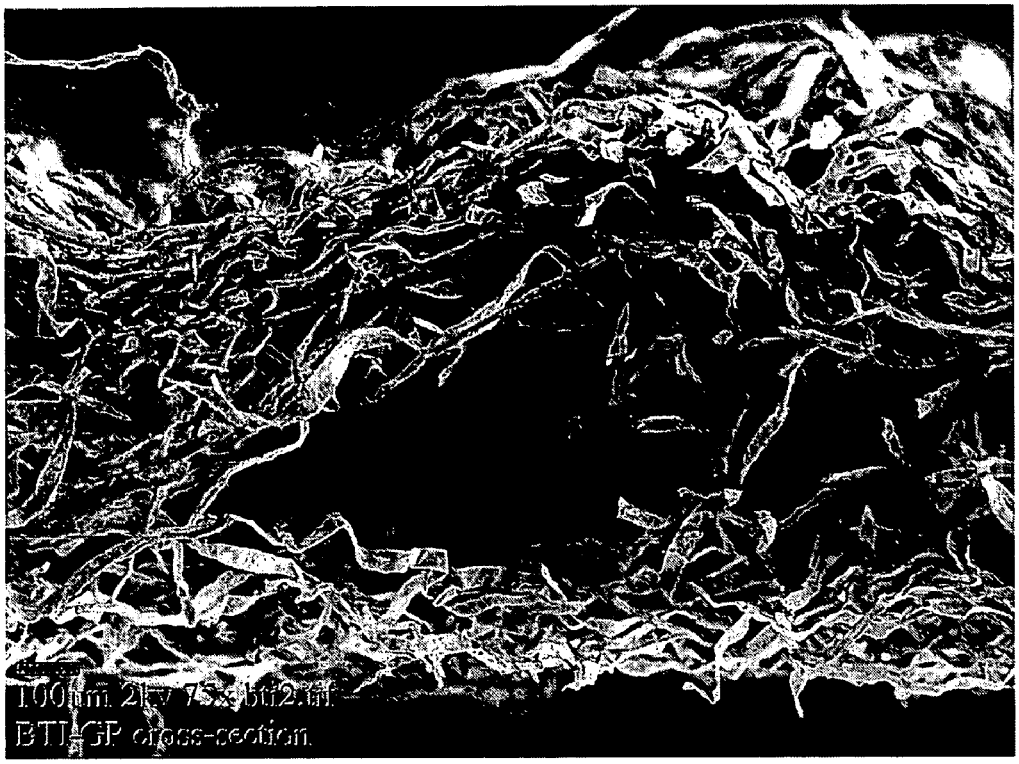
Figure 39:
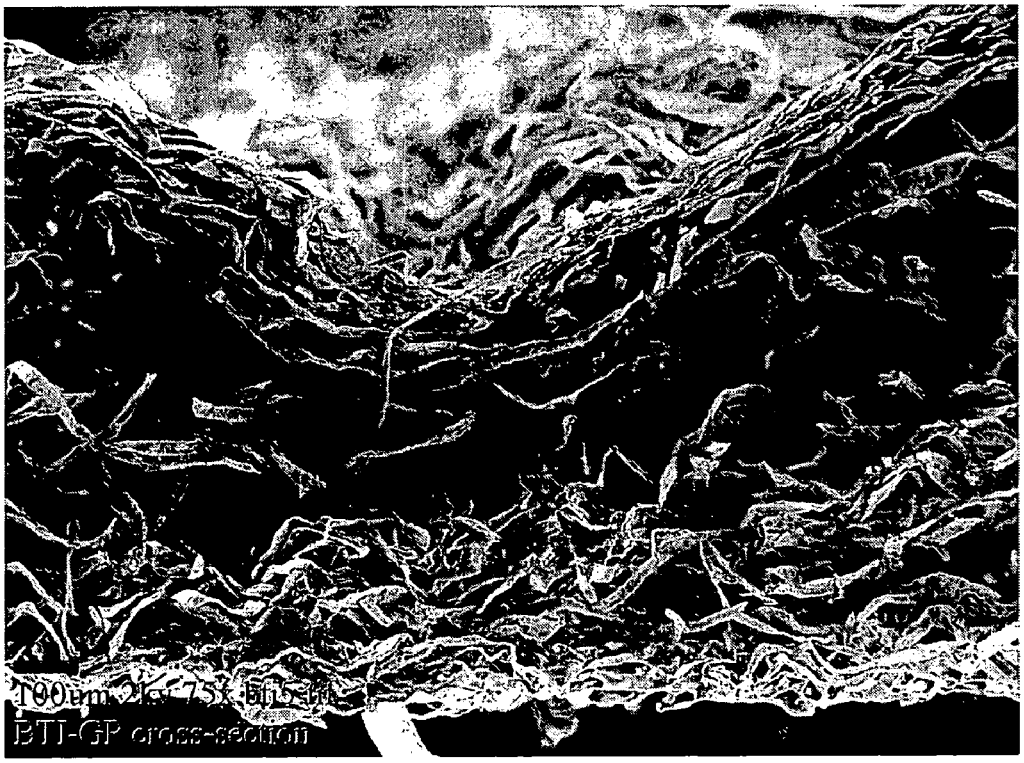
Figure 40:
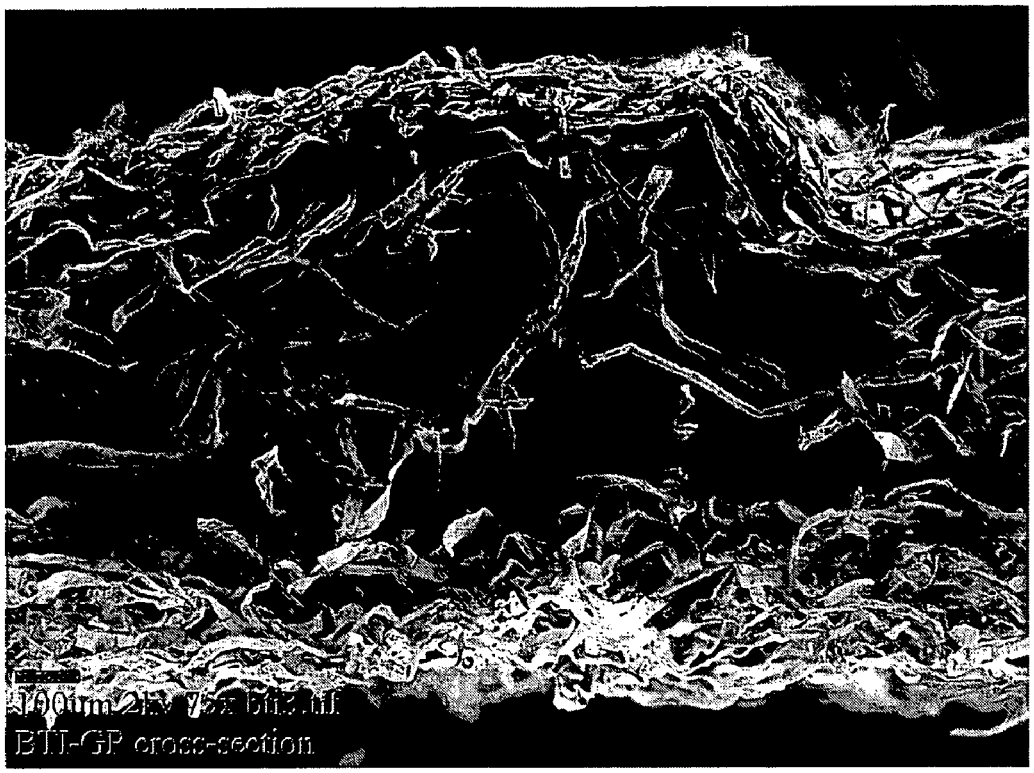
Figure 41:
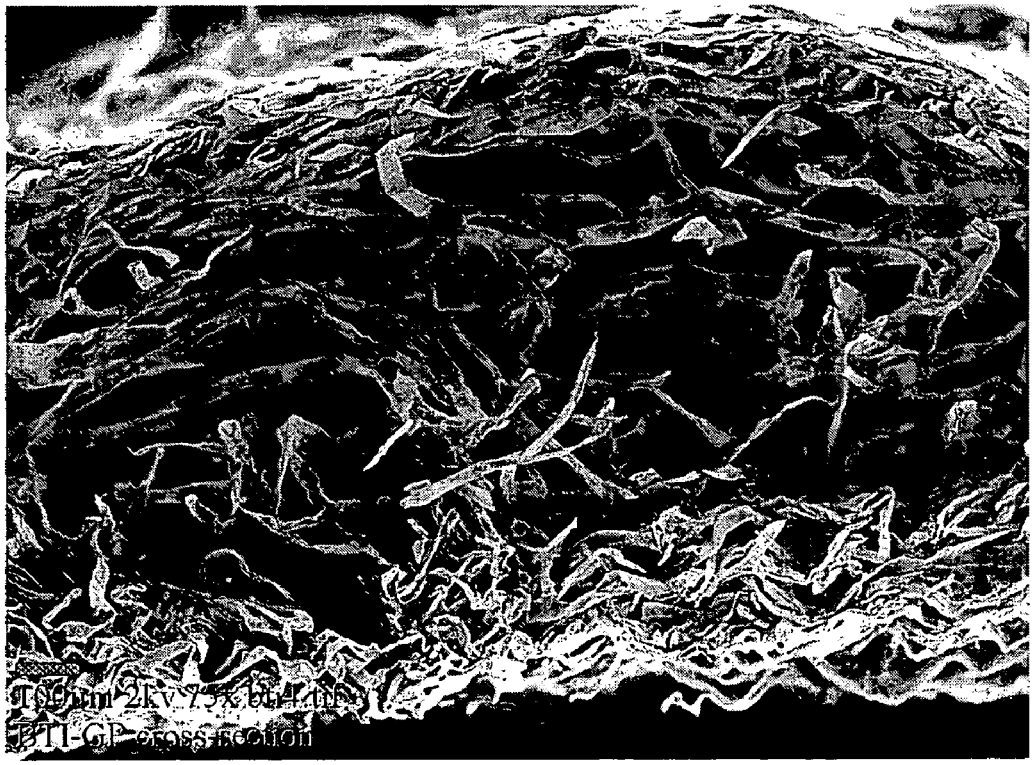

FIGS. 36 and 37 show scanning electron microscope (SEM) micrographs of cross-sections of VIVA® paper towel. Cross-sections of tissue samples were produced using a new surgical single edge blade for each cut. The sheet was frozen in liquid nitrogen vapor to adequately stiffen it for a clean cut. Sections were sputter coated with gold and examined in a JEOL 840 SEM manufactured by JEOL USA, Inc. (Peabody, Mass.) operating with a 3 kV electron beam. The magnification shown is 75×. The micrographs show a structure that appears to have relatively dense outer layers and bulkier interior layers.

FIGS. 38 to 41 show scanning electron microscope (SEM) micrographs of cross-sections of the paper towel of Sample No. 1 of the present invention. The cross-sections were taken cut across the lay of the ridges on the textured side. The SEM photos show that Sample No. 1 had a low-density interior/high-density surface structure. In contrast to the structure of VIVA®, Sample No. 1 exhibited large, very low density internal regions, which are believed to contribute to the ease of splitting observed with this web.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A tissue product comprising:

an initially uncreped tissue web comprising a first side and a second and opposite side, the tissue web comprising pulp fibers;

a first bonding material applied to the first side of the tissue web according to a first preselected pattern comprising a plurality of dots, the first side of the tissue web having been creped after application of the first bonding material;

a second bonding material applied to the second side of the tissue web according to a second preselected pattern, wherein the second bonding material is applied to a greater amount of surface area than the first bonding material covers on the first side of the tissue web, and further wherein the first bonding material applied to the first side of the tissue web has greater penetration into the web than the second bonding material applied to the second side of the tissue web; and wherein the characteristics of the first side of the tissue web are different than the characteristics of the second side of the tissue web, the first side of the tissue web having a dry surface depth of less than about 0.15 mm and a wetted surface depth of greater than about 0.2 mm, the second side of the tissue web having a dry surface depth of greater than about 0.2 mm.

2. A tissue product as defined in claim 1, wherein the first side of the tissue web has a dry surface depth of less than about 0.12 mm and wherein the second side of the tissue web has a dry surface depth of greater than about 0.25 mm.

3. A tissue product as defined in claim 1, wherein the first side of the tissue web has a dry surface depth of less than about 0.12 mm and wherein the second side of the tissue web has a dry surface depth of greater than about 0.30 mm.

4. A tissue product as defined in claim 1, wherein the first side of the tissue web has a dry surface depth of less than about 0.1 mm and wherein the second side of the tissue web has a dry surface depth of greater than about 0.33 mm.

5. A tissue product as defined in claim 4, wherein the first side of the tissue web has a wetted surface depth of greater than about 0.3 mm.

6. A tissue product as defined in claim 1, wherein the first side of the tissue web has a wetted surface depth of greater than about 0.25 mm.

7. A tissue product as defined in claim 1, wherein the first side of the tissue web has a wetted surface depth of greater than about 0.3 mm.

8. A tissue product as defined in claim 1, wherein the tissue web has a falling drape of less than about 1.5 seconds.

9. A tissue product as defined in claim 1, wherein the tissue web has a falling drape of less than about 1.5 seconds, when normalized to a basis weight of 30 gsm.

10. A tissue product as defined in claim 1, wherein the tissue web has a falling drape of less than about 1.3 seconds, when normalized to a basis weight of 30 gsm.

11. A tissue product as defined in claim 1, wherein the tissue web comprises an uncreped through-air dried web.

12. A tissue product as defined in claim 11, wherein the tissue web includes an air side and a fabric side, the first side of the tissue web being the air side of the web.

13. A tissue product as defined in claim 1, wherein the bonding material comprises an ethylene vinyl acetate copolymer.

14. A tissue product as defined in claim 1, wherein the bonding material comprises a styrene-butadiene copolymer, a polyvinyl acetate polymer, a vinyl-acetate acrylic copolymer, an ethylene-vinyl chloride copolymer, an ethylene-vinyl chloride-vinyl acetate polymer, an acrylic polyvinyl chloride polymer, an acrylic polymer, or a nitrile polymer.

15. A tissue product as defined in claim 1, wherein the tissue web comprises a stratified web having a first outer layer, a middle layer, and a second outer layer, the middle layer comprising hardwood fibers or high-yield fibers.

16. A tissue product as defined in claim 1, wherein the product comprises a single ply wiping product.

17. A tissue product as defined in claim 1, wherein the tissue web has a basis weight of from about 10 gsm to about 120 gsm.

18. A tissue product as defined in claim 1, wherein the tissue web has a basis weight of from about 35 gsm to about 80 gsm.

19. A tissue product as defined in claim 1, wherein the bonding material is applied to the first side of the tissue web in an amount of from about 2% to about 10% by weight of the web.

20. A tissue product as defined in claim 1, wherein the bonding material is applied to the first side of the tissue web so as to cover at least 50% of the surface area of the first side of the web.

21. A tissue product as defined in claim 1, wherein the second preselected pattern by which the second bonding material is applied comprises a succession of discrete shapes.

22. A tissue product as defined in claim 1, wherein the tissue product has a bulk greater than 10 cc/g.

23. A tissue product as defined in claim 1, wherein the second side of the tissue side remains uncreped.

24. A tissue product as defined in claim 1, wherein the tissue web contains a strength agent.

25. A tissue product as defined in claim 24, wherein the tissue web is made from a stratified fiber furnish including a first outer layer and a second outer layer, the strength agent being incorporated into the first outer layer, the first outer layer forming the first side of the tissue web.

26. A tissue product as defined in claim 25, wherein the tissue web further includes a center layer, the strength agent being incorporated in the center layer.

27. A tissue product as defined in claim 26, wherein the strength agent is incorporated in the first outer layer, the center layer, and the second outer layer, the second outer layer forming the second side of the tissue web.

28. A tissue product as defined in claim 24, wherein the strength agent is coated, sprayed or printed onto the tissue web.

29. A tissue product as defined in claim 24, wherein the strength agent comprises a permanent strength agent.

30. A tissue product as defined in claim 24, wherein the strength agent comprises a temporary strength agent.

31. A tissue product comprising:

a tissue web comprising a first side and a second and opposite side, the tissue web comprising an uncreped through-air dried web, the tissue web comprising pulp fibers;

a bonding material applied to both the first side and the second side of the tissue web according to a first and second preselected pattern, respectfully, the first side of the tissue web having been creped after application of the bonding material, wherein the first preselected pattern comprises a succession of discrete dots, and wherein the second preselected pattern comprises a discrete shapes, and further wherein the first bonding material applied to the first side of the tissue web has greater penetration into the web than the second bonding material applied to the second side of the tissue web; and wherein the first side of the tissue web is smoother than the second side of the tissue web, the second side of the tissue web having a textured surface, the first side of the tissue web having a dry surface depth of less than about 0.15 mm and the second side of the tissue web having a dry surface depth of greater than about 0.2 mm.

32. A tissue product as defined in claim 31, wherein the first side of the tissue web has a wetted surface depth of greater than about 0.2 mm.

33. A tissue product as defined in claim 32, wherein the first side of the tissue web has a dry surface depth of less than about 0.12 mm and wherein the second side of the tissue web has a dry surface depth of greater than about 0.25 mm.

34. A tissue product as defined in claim 32, wherein the first side of the tissue web has a dry surface depth of less than about 0.12 mm and wherein the second side of the tissue web has a dry surface depth of greater than about 0.30 mm.

35. A tissue product as defined in claim 32, wherein the first side of the tissue web has a dry surface depth of less than about 0.1 mm and wherein the second side of the tissue web has a dry surface depth of greater than about 0.33 mm.

36. A tissue product as defined in claim 35, wherein the first side of the tissue web has a wetted surface depth of greater than about 0.3 mm.

37. A tissue product as defined in claim 31, wherein the first side of the tissue web has a wetted surface depth of greater than about 0.25 mm.

38. A tissue product as defined in claim 31, wherein the first side of the tissue web has a wetted surface depth of greater than about 0.3 mm.

39. A tissue product as defined in claim 31, wherein the tissue web has a falling drape of less than about 1.5 seconds.

40. A tissue product as defined in claim 31, wherein the tissue web has a falling drape of less than about 1.5 seconds, when normalized to a basis weight of 30 gsm.

41. A tissue product as defined in claim 31, wherein the tissue web has a falling drape of less than about 1.5 seconds, when normalized to a basis weight of 30 gsm.

42. A tissue product as defined in claim 31, wherein the bonding material comprises an ethylene vinyl acetate copolymer.

43. A tissue product as defined in claim 31, wherein the bonding material comprises a styrene-butadiene copolymer, a polyvinyl acetate polymer, a vinyl-acetate acrylic copolymer, an ethylene-vinyl chloride copolymer, an ethylene-vinyl chloride-vinyl acetate polymer, an acrylic polyvinyl chloride polymer, an acrylic polymer, or a nitrile polymer.

44. A tissue product as defined in claim 31, wherein the tissue web comprises a stratified web having a first outer layer, a middle layer, and a second outer layer, the middle layer comprising hardwood fibers or high-yield fibers.

45. A tissue product as defined in claim 31, wherein the product comprises a single ply wiping product.

46. A tissue product as defined in claim 31, wherein the tissue web has a basis weight of from about 10 gsm to about 120 gsm.

47. A tissue product as defined in claim 31, wherein the bonding material is applied to the first side of the tissue web in an amount of from about 2% to about 10% by weight of the web.

48. A tissue product as defined in claim 31, wherein the bonding material is applied to the first side of the tissue web so as to cover at least 50% of the surface area of the first side of the web.

49. A tissue product as defined in claim 31, wherein the second preselected pattern by which the bonding material is applied to the second side of the tissue web comprises a succession of discrete shapes that are each comprised of three elongated hexagons.

50. A tissue product as defined in claim 31, wherein the tissue product has a bulk greater than 10 cc/g.

51. A tissue product as defined in claim 31, wherein the tissue web includes an air side and a fabric side, the first side of the tissue web being the air side of the web.

52. A tissue product as defined in claim 31, wherein the second side of the tissue side remains uncreped.

53. A tissue product comprising:

a tissue web comprising a first side and a second and opposite side, the tissue web comprising pulp fibers, the tissue web comprising an uncreped through-air dried web, the tissue web having a basis weight of from about 35 gsm to about 120 gsm wherein the first and second side each define a surface area;

a bonding material applied to the first side and the second side of the tissue web according to a first and second preselected pattern, respectfully, the first side of the tissue web having been creped after application of the bonding material, the bonding material being applied to the first side in an amount from about 2% to about 10% based on the weight of the tissue web, wherein the first preselected pattern comprises a plurality of discrete dots, and wherein the second preselected pattern covers from about 40% to about 60% of the surface area of the second side of the tissue web, and further wherein the first bonding material applied to the first side of the tissue web has greater penetration into the web than the second bonding material applied to the second side of the tissue web; and wherein the characteristics of the first side of the tissue web are different than the characteristics of the second side of the tissue web, the first side of the tissue web being smoother than the second side of the tissue web while the second side of the tissue web having a more textured surface than the first side of the tissue web, the first side of the tissue web having a dry surface depth of less than about 0.12 mm and a wetted surface depth of greater than about 0.25 mm, the second side of the tissue web having a dry surface depth of greater than about 0.3 mm, the tissue web having a falling drape of less than about 1.5 seconds.

54. A tissue product as defined in claim 53, wherein the first side of the tissue web has a dry surface depth of less than about 0.1 mm and wherein the second side of the tissue web has a dry surface depth of greater than about 0.33 mm.

55. A tissue product as defined in claim 53, wherein the first side of the tissue web has a wetted surface depth of greater than about 0.3 mm.

56. A tissue product as defined in claim 53, wherein the tissue web has a falling drape of less than about 1.5 seconds, when normalized to a basis weight of 30 gsm.

57. A tissue product as defined in claim 53, wherein the tissue web has a falling drape of less than about 1.1 seconds, when normalized to a basis weight of 30 gsm.

58. A tissue product as defined in claim 53, wherein the bonding material comprises an ethylene vinyl acetate copolymer.

59. A tissue product as defined in claim 53, wherein the bonding material comprises a styrene-butadiene copolymer, a polyvinyl acetate polymer, a vinyl-acetate acrylic copolymer, an ethylene-vinyl chloride copolymer, an ethylene-vinyl chloride-vinyl acetate polymer, an acrylic polyvinyl chloride polymer, an acrylic polymer, or a nitrile polymer.

60. A tissue product as defined in claim 53, wherein the tissue web comprises a stratified web having a first outer layer, a middle layer, and a second outer layer, the middle layer comprising hardwood fibers or high-yield fibers.

61. A tissue product as defined in claim 53, wherein the product comprises a single ply wiping product.

62. A tissue product as defined in claim 53, wherein the second preselected pattern by which the bonding material is applied to the second side comprises a succession of discrete shapes.

63. A tissue product as defined in claim 53, wherein the tissue product has a bulk greater than 10 cc/g.

64. A tissue product as defined in claim 53, wherein the tissue web includes an air side and a fabric side, the first side of the tissue web being the air side of the web.

65. A tissue product as defined in claim 53, wherein the second side of the tissue side remains uncreped.

* * * * *